US011457763B2

(12) United States Patent
Mullet et al.

(10) Patent No.: US 11,457,763 B2
(45) Date of Patent: Oct. 4, 2022

(54) STABILIZED ROTATING DRAPERY ROD RING SYSTEM

(71) Applicant: Current Products Corp., Pensacola, FL (US)

(72) Inventors: Willis J. Mullet, Gulf Breeze, FL (US); Scott Hand, Pace, FL (US); Phillip Dugger, Pensacola, FL (US)

(73) Assignee: Current Products Corp., Pensacola, FL (US)

( * ) Notice: Subject to any disclaimer, the term of this patent is extended or adjusted under 35 U.S.C. 154(b) by 168 days.

(21) Appl. No.: 16/744,933

(22) Filed: Jan. 16, 2020

(65) Prior Publication Data

US 2020/0229630 A1 Jul. 23, 2020

Related U.S. Application Data

(60) Provisional application No. 62/793,959, filed on Jan. 18, 2019.

(51) Int. Cl.

| | |
|---|---|
| ***A47H 5/08*** | (2006.01) |
| ***A47H 13/02*** | (2006.01) |
| *A47H 1/02* | (2006.01) |

(52) U.S. Cl.

CPC ..... *A47H 5/08* (2013.01); *A47H 13/02* (2013.01); *A47H 1/02* (2013.01); *A47H 2001/0215* (2013.01)

(58) Field of Classification Search

CPC ... A47H 5/02; A47H 5/06; A47H 5/08; A47H 5/0325; A47H 1/02; A47H 2001/0215;

(Continued)

(56) References Cited

U.S. PATENT DOCUMENTS

| | | | |
|---|---|---|---|
| D5,178 | S | 8/1871 | Gould |
| D22,271 | S | 3/1893 | Ruxton |

(Continued)

FOREIGN PATENT DOCUMENTS

| | | | | |
|---|---|---|---|---|
| DE | 3402122 | | 8/1984 | |
| EP | 0012263 | A1 * | 6/1980 | ..... E06B 9/36 |

(Continued)

OTHER PUBLICATIONS

European Search Report, EP13837043.2, PCT-US2013-060205, dated Jun. 27, 2016.

(Continued)

*Primary Examiner* — Daniel P Cahn
*Assistant Examiner* — John W Hanes, Jr.
(74) *Attorney, Agent, or Firm* — Christopher A. Proskey; BrownWinick Law Firm

(57) ABSTRACT

A drapery system having a drive element extending the length that is connected to a structure by a pair of brackets. The drive element has a cylindrical shape with an exterior surface. The exterior surface of the drive element has a guide structure, which in one arrangement is a plurality of helical grooves. A plurality of rings are positioned around the drive element that are used to connect shade material to the drive element. The rings include a partial driver ring, a full driver ring and idler rings. In a center closing arrangement, partial driver rings are positioned as the inward most rings followed by full driver ring which is followed by a plurality of idler rings. The partial driver ring and the idler rings have a stabilizer that fits around the exterior surface of the drive element thereby providing smoother and quieter travel along the drive element.

39 Claims, 41 Drawing Sheets

(58) Field of Classification Search
CPC .. A47H 2005/025; A47H 13/02; A47H 23/00; E06B 9/362; E06B 9/364; E06B 9/368
See application file for complete search history.

(56) References Cited

U.S. PATENT DOCUMENTS 537,681 A 4/1895 Furbish
D25,521 S 5/1896 Ill
D41,567 S 7/1911 Rouse
1,823,909 A 9/1931 Meier
2,801,690 A * 8/1957 Bennett ..... A47H 5/06 160/343
3,208,507 A 9/1965 Breen
3,631,659 A 1/1972 Horowitz et al.
3,774,665 A 11/1973 Bourne
3,853,166 A 12/1974 Wrono
3,930,738 A 1/1976 Thuss et al.
3,999,110 A 12/1976 Ramstrom et al.
4,023,609 A 5/1977 Rosenquist
4,096,903 A 6/1978 Ringle, III
4,131,831 A 12/1978 Bochenek et al.
4,160,348 A 7/1979 Chapman et al.
4,171,845 A 10/1979 Hirsch
4,223,714 A 9/1980 Weinreich et al.
4,305,448 A 12/1981 Stoll
4,399,855 A 8/1983 Volfson
4,427,050 A 1/1984 Toppen
RE31,793 E 1/1985 Berman et al.
4,495,978 A 1/1985 Carroll
4,532,194 A 7/1985 Liautaud et al.
4,572,467 A 2/1986 Farrell
4,644,244 A 2/1987 Kittelson
4,724,885 A 2/1988 Chang
4,731,965 A 3/1988 Jensen
4,766,941 A 8/1988 Sloop et al.
4,807,686 A 2/1989 Schnebly et al.
4,831,509 A 5/1989 Jones et al.
4,832,104 A 5/1989 De Labarthe et al.
4,865,107 A 9/1989 Dube
4,926,922 A 5/1990 Shimazaki
4,956,588 A 9/1990 Ming
4,979,582 A 12/1990 Forester
D315,415 S 3/1991 Anthony et al.
5,054,605 A 10/1991 Bavis
D324,328 S 3/1992 Pagan
D324,645 S 3/1992 Magro et al.
5,123,079 A 6/1992 Tanii et al.
5,133,330 A 7/1992 Sharp
5,133,399 A 7/1992 Hiller et al.
5,271,446 A 12/1993 Hwang
5,278,480 A 1/1994 Murray
D355,353 S 2/1995 Pozzi
D355,587 S 2/1995 Pozzi
5,419,010 A 5/1995 Mullet
5,434,487 A 7/1995 Long et al.
5,445,209 A 8/1995 Lichy
5,462,105 A 10/1995 Supernak
5,467,808 A 11/1995 Bell
5,482,100 A 1/1996 Kuhar
5,509,239 A 4/1996 Fullwood
5,547,008 A 8/1996 Sullivan
5,566,736 A 10/1996 Crider et al.
5,655,342 A 8/1997 Guillemet et al.
5,655,343 A 8/1997 Seals
5,714,855 A 2/1998 Domel et al.
D391,476 S 3/1998 Gourlay
5,729,103 A 3/1998 Domel et al.
5,752,557 A 5/1998 Crider et al.
5,760,558 A 6/1998 Popat
5,785,105 A 7/1998 Crider et al.
5,793,174 A 8/1998 Kovach et al.
5,813,447 A 9/1998 Lysyj
RE36,058 E 1/1999 Sokol
5,883,480 A 3/1999 Domel et al.
5,889,377 A 3/1999 Mao
5,905,442 A 5/1999 Mosebrook et al.
5,907,227 A 5/1999 Domel et al.
5,929,580 A 7/1999 Mullet et al.
5,960,847 A 10/1999 Crider et al.
5,990,646 A 11/1999 Kovach et al.
6,004,298 A 12/1999 Levander
D418,741 S 1/2000 Rouse
6,020,829 A 2/2000 Hormann
6,024,156 A 2/2000 Chu
6,055,885 A 5/2000 Shea
6,060,852 A 5/2000 Domel et al.
6,069,465 A 5/2000 De Boois et al.
6,082,433 A 7/2000 Vafaie et al.
6,125,907 A 10/2000 Tokuyama et al.
6,144,177 A 11/2000 Mao
6,181,089 B1 1/2001 Kovach et al.
6,189,592 B1 2/2001 Domel
6,212,221 B1 4/2001 Wakayama et al.
6,259,218 B1 7/2001 Kovach et al.
6,286,579 B1 9/2001 Gottschalk
6,369,530 B2 4/2002 Kovach et al.
6,376,832 B1 4/2002 Smith et al.
6,433,498 B1 8/2002 Domel et al.
6,489,169 B1 12/2002 Cohen et al.
6,497,267 B1 12/2002 Azar et al.
6,533,017 B1 3/2003 Toti
6,550,733 B1 4/2003 Lassen et al.
6,606,072 B1 8/2003 Hayward et al.
6,680,594 B2 1/2004 Huber et al.
6,708,750 B2 3/2004 Collett et al.
6,733,413 B2 5/2004 Lagarde et al.
6,736,186 B2 5/2004 Anderson et al.
6,850,017 B1 2/2005 Domel et al.
6,870,338 B2 3/2005 Walker et al.
6,959,748 B2 11/2005 Hudoba
6,967,565 B2 11/2005 Lingemann
6,979,962 B2 12/2005 Cavarec et al.
7,033,695 B2 4/2006 Sawachi
7,104,305 B1 9/2006 Apollon
7,111,659 B2 9/2006 Harper et al.
7,137,530 B2 11/2006 Chirnomas
7,193,502 B2 3/2007 Vandrunen et al.
7,231,953 B2 6/2007 Varley et al.
7,240,716 B2 7/2007 Nichols, Jr. et al.
7,259,485 B2 8/2007 Cavarec et al.
D553,965 S 10/2007 Ellbogen
7,281,561 B2 10/2007 Anderson et al.
7,299,848 B2 11/2007 Streib et al.
7,346,016 B2 3/2008 Nielsen et al.
7,350,736 B2 4/2008 Caamano et al.
7,356,041 B2 4/2008 Nielsen et al.
7,389,806 B2 6/2008 Kates
7,438,111 B2 10/2008 Grimes et al.
7,590,433 B2 9/2009 Sung et al.
7,673,667 B2 3/2010 Domel et al.
7,690,414 B2 4/2010 Knowles
7,931,068 B2 4/2011 Carmen, Jr. et al.
7,975,748 B2 7/2011 Yu et al.
8,125,167 B1 2/2012 Mullet et al.
8,299,734 B2 10/2012 Mullet et al.
8,340,975 B1 12/2012 Rosenberger
8,368,328 B2 2/2013 Mullet et al.
8,371,358 B1 2/2013 Mullet et al.
8,540,005 B2 9/2013 Baugh et al.
8,575,872 B2 11/2013 Mullet et al.
8,659,246 B2 2/2014 Mullet et al.
8,723,455 B2 5/2014 Mullet et al.
8,757,239 B2 6/2014 Douglas
D714,132 S 9/2014 Hazantonis
8,892,262 B2 11/2014 Mullet et al.
8,919,419 B2 12/2014 Mullet et al.
8,968,900 B2 3/2015 Mullet et al.
9,045,939 B2 6/2015 Blair et al.
2004/0169116 A1 9/2004 Nogare et al.
2006/0000565 A1 1/2006 Billebault
2006/0086874 A1 4/2006 Habel et al.
2007/0261801 A1 11/2007 Mullet et al.
2007/0284053 A1 12/2007 Mullet et al.
2009/0127369 A1 5/2009 Mullet et al.

(56) References Cited

U.S. PATENT DOCUMENTS

| | | | | |
|---|---|---|---|---|
| 2011/0056630 | A1 | 3/2011 | Buccola, Jr. | |
| 2012/0181979 | A1 | 7/2012 | Hudspeth et al. | |
| 2012/0279075 | A1 | 11/2012 | Amsel | |
| 2013/0199735 | A1 | 8/2013 | Colson et al. | |
| 2013/0204408 | A1 | 8/2013 | Thiruvengada | |
| 2013/0333848 | A1 | 12/2013 | Mullet et al. | |
| 2014/0014281 | A1 | 1/2014 | Mullet et al. | |
| 2016/0143470 | A1* | 5/2016 | Mullet | E06B 9/68 160/331 |

FOREIGN PATENT DOCUMENTS

| | | |
|---|---|---|
| JP | 2006304984 | 11/2006 |
| JP | 2006314389 | 11/2006 |
| JP | 2009034301 | 2/2009 |
| JP | 2011062497 | 3/2011 |
| KR | 100903201 | 6/2009 |
| KR | 20100006476 | 1/2010 |
| WO | 8602970 | 5/1986 |

OTHER PUBLICATIONS

International Preliminary Report on Patentability, PCT/US2013/060205, dated Mar. 26, 2015.
International Search Report, PCT/US2014/045633, dated Nov. 7, 2014.
Written Opinion of the International Searching Authority, PCT/US2014/045663, dated Nov. 7, 2014.

* cited by examiner

STABILIZED ROTATING DRAPERY ROD RING SYSTEM

CROSS REFERENCE TO RELATED APPLICATIONS

This application claims priority to U.S. Provisional Application No. 62/793,959 which was filed on Jan. 18, 2019, the entirety of which is incorporated herein fully by reference.

FIELD OF THE DISCLOSURE

This disclosure relates to window coverings. More specifically and without limitation, this disclosure relates to a rotating drapery rod system.

BACKGROUND OF THE DISCLOSURE

Architectural coverings, such as curtains, shades, draperies and the like are old and well known in the art and are frequently used to provide privacy and to limit the amount of light that is permitted to pass through a window and into a room or building. There are countless types, forms and designs of architectural coverings known in the art. The term architectural covering is used to describe any and all of these types, forms and designs including blinds, shades, draperies, and the like.

One form of architectural covering of particular interest in this application is commonly referred to as draperies. Common components of draperies include a support rod connected to brackets positioned above or adjacent to a window or door. In one arrangement of a drapery, the support rod rotates and drives the shade material across the length of the support rod. This arrangement is more fully described in Applicant's related U.S. Pat. No. 9,095,908 entitled Rotatable Drive Element For Moving A Window Covering, issued on Aug. 4, 2015 which is fully incorporated herein, including related applications; and Applicant's related patent application Ser. No. 14/786,877 filed on Oct. 23, 2015 entitled Motorized Drapery Apparatus, System and Method of Use which is also fully incorporated by reference herein, including any related applications.

In these related patent applications, a motorized drapery apparatus is presented having a plurality if rings positioned around or looped over the support rod (also referred to as the rotatable drive element). Shade material is attached to these rings by way of pins or hooks or any other connecting mechanism or arrangement. One problem with these rotating drapery rod systems is that as the rod is rotated, noise is created as the rings rattle against the guide structure, which is undesirable. Another disadvantage is the potential for the rings to angle or cant which can cause the rings to bind on the rotating drive element which can stop the opening or closing operation, tear the shade material, and/or wear or break components of the system.

Thus it is a primary object of the disclosure to provide a drapery rod system that improves upon the state of the art and provides superior operation by smoothing the movement of the rings across the rotating drive element.

Another object of the disclosure is to provide a drapery rod system that is easy to use.

Yet another object of the disclosure is to provide a drapery rod system that is simple in design.

Another object of the disclosure is to provide a drapery rod system that facilitates quiet operation.

Yet another object of the disclosure is to provide a drapery rod system that facilitates smooth operation.

Another object of the disclosure is to provide a drapery rod system that is relatively inexpensive or affordable.

Yet another object of the disclosure is to provide a drapery rod system that has a minimum number of parts.

Another object of the disclosure is to provide a drapery rod system that prevents or reduces the ability for rings to catch or bind on the rotating drapery rod.

Yet another object of the disclosure is to provide a drapery rod system that reduces the level of friction between the rings and the rotating drapery rod.

Another object of the disclosure is to provide a drapery rod system that has features in the rings that provide guidance along the rotating drapery rod.

Yet another object of the disclosure is to provide a drapery rod system that can be manually operated as well as operated by motorization.

Another object of the disclosure is to provide a drapery rod system that can be used with any shade material.

Yet another object of the disclosure is to provide a drapery rod system that facilitates robust operation.

Another object of the disclosure is to provide a drapery rod system that helps to guide and stabilize the rings over features in the rotating drapery rod.

Yet another object of the disclosure is to provide a drapery rod system helps to reduce light gaps.

These and other objects, features, or advantages of the present disclosure will become apparent from the specification, claims and drawings.

SUMMARY OF THE DISCLOSURE

A drapery system is presented having a drive element extending the length from a first end to a second end. The drive element is connected to a structure by a pair of brackets. The drive element has a cylindrical shape with an exterior surface. The exterior surface of the drive element has a guide structure, which in one arrangement is a plurality of helical grooves. A plurality of rings are positioned around the drive element that are used to connect shade material to the drive element. In the arrangement presented these rings include a partial driver ring, a full driver ring and a plurality of idler rings. In a center closing arrangement, partial driver rings are positioned as the inward most rings followed by full driver ring which is followed by a plurality of idler rings. The partial driver ring and the idler rings have a stabilizer with an interior surface that is configured to fit around the exterior surface of the drive element so as to facilitate smoother and quieter travel of the partial driver ring and idler rings across the surface of the drive element. This stabilizer also provides alignment which provides smoother operation and prevents or reduces the potential for a ring to cant and catch on the drive element.

DETAILED DESCRIPTION OF THE DISCLOSURE

Figure 1:
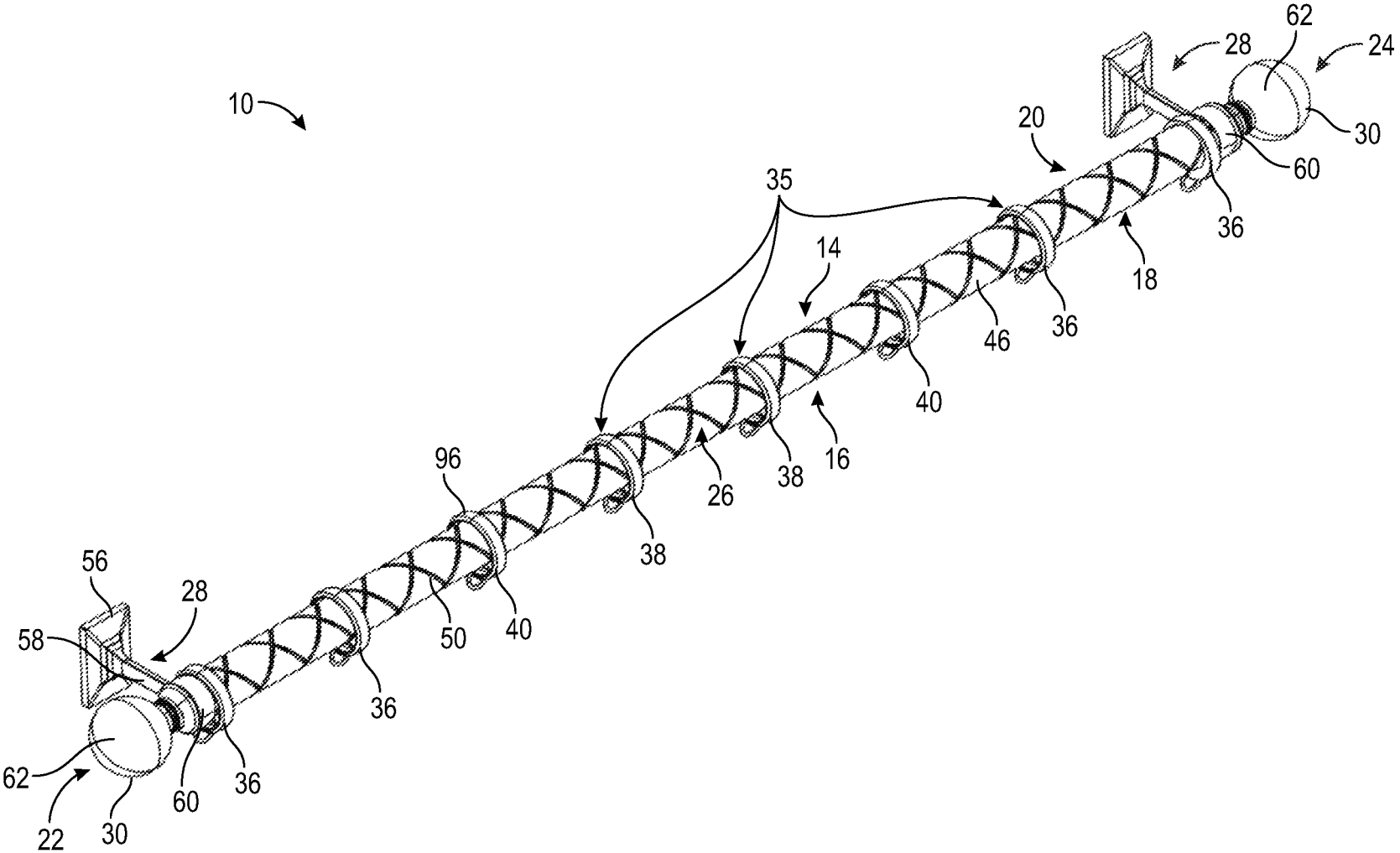
FIG. 1 is a perspective view of a drapery rod system having a drive element that extends a length between opposing ends and has a generally cylindrical exterior surface having a guide structure therein that is formed of a pair of left hand grooves on opposing sides of the drive element and a pair of right hand grooves on opposing sides of the drive element wherein the left hand grooves and right hand grooves intersect one another along the length of the drive element; the view showing a plurality of rings positioned around the drive element, the view showing a pair of brackets connected to the ends of the drive element and configured to attach the drive element to a structure; the view showing a pair of finials connected to the ends of the drive element.

In the following detailed description, reference is made to the accompanying drawings which form a part hereof, and in which is shown by way of illustration specific embodiments in which the disclosure may be practiced. These embodiments are described in sufficient detail to enable those skilled in the art to practice the disclosure, and it is to be understood that other embodiments may be utilized and that mechanical, procedural, and other changes may be made without departing from the spirit and scope of the disclosure. The following detailed description is, therefore, not to be taken in a limiting sense, and the scope of the disclosure is defined only by the appended claims, along with the full scope of equivalents to which such claims are entitled.

As used herein, the terminology such as vertical, horizontal, top, bottom, front, back, end, sides, left, right, and the like are referenced according to the views, pieces, parts, components and figures presented. It should be understood, however, that the terms are used only for purposes of description, and are not intended to be used as limitations. Accordingly, orientation of an object or a combination of objects may change without departing from the scope of the disclosure.

System:

With reference to the figures, a drapery rod system 10 (system 10) is presented. System 10 is formed of any suitable size, shape and design and is configured to facilitate the opening and closing of shade material 12 in a quick, easy, safe, quiet and smooth manner. In the arrangement shown, as one example, the drapery rod system 10 has a top side 14, a bottom side 16, a front side 18, a back side 20, a left side 22 and a right side 24. In the arrangement shown, as one example, the drapery rod system 10 includes the following component pieces, among others: drive element 26, brackets 28, finials 30, motor control assembly 32, power source 34, rings 35 including one or more idler rings 36, partial driver rings 38, full driver rings 40, and shade material 12, among other components.

Drive Element:

Drapery rod system 10 includes a drive element 26. Drive element 26 is formed of any suitable size, shape and design and is configured to support as well as open and close shade material 12. In the arrangement shown, as one example, drive element 26, is formed of an elongated member that extends a length between an opposing first end 42 and a second end 44. Drive element 26 may be formed of a single, unitary member or may be formed of a plurality of connected members that form a drive element 26.

In the arrangement shown, as one example, when viewed from an end 42, 44 drive element 12 has a generally cylindrical shape with an exterior surface 46 and a hollow interior 48. In the arrangement shown, as one example, exterior surface 46 is generally cylindrical in shape and has a smooth surface that includes guide structure 50.

Guide structure 50 is formed of any suitable size, shape and design and is configured to facilitate the movement of idler rings 36, partial driver rings 38 and full driver rings 40 along the length of the drive element 26 while also providing an aesthetically appealing appearance. In one arrangement, as is shown, guide structure 50 is formed of a helical guide structure positioned in exterior surface 46. The helical guide structure 50 can be a left-hand guide structure, a right-hand guide structure, or both, or a plurality or combination of left-hand guide structures and/or right-hand guide structures. Guide structure 50 can either be grooves, indentations, protrusions, threads or any other feature or the like, as is described herein. Guide structure 50 can either ground or machined into the surface of drive element 26, knurled or formed into the surface of drive element 26, cast or formed into the surface of drive element 26, extruded into the exterior surface of drive element 26, or created by any other means or methods known in the art.

With reference to FIG. 1, in the arrangement shown, as one example, four leads or four grooves are presented as guide structure 50. These leads are broken into two pairs, a first pair having a right hand twist, and a second pair having a left hand twist. The two grooves of both the first pair and the second pair are positioned opposite to one another on drive element 26, or said another way, the two grooves are diametrically opposed to one another and remain this way throughout their length as they rotate around drive element 26, or said another way, the two grooves are on opposing sides of drive element 26 as they twist around drive element 26. The two pairs, the left hand twist pair and the right hand twist pair, are approximately equally spaced to one another. As is shown, the two pairs of grooves, the left hand twist pair and the right hand twist pair, cross one another intermittently along the length of drive element 26. As the pitch or angle that the grooves extend around drive element 26 changes the angle of intersection of the left hand twist grooves and the right hand twist grooves change.

As is shown, the two pairs of grooves begin and/or end at the same position on rotatable drive element 26 and twist opposite one another. When the two pairs of grooves cross or intersect one another, both grooves cross one another at the same approximate position, opposite one another on the drive element 26. This is accomplished by having a consistent angle of rotation throughout the length of the grooves, and maintaining the position of the grooves within close tolerances throughout the length of the drive element 26. However, a varying pitch or angle of rotation is also hereby contemplated for use.

Figure 2:
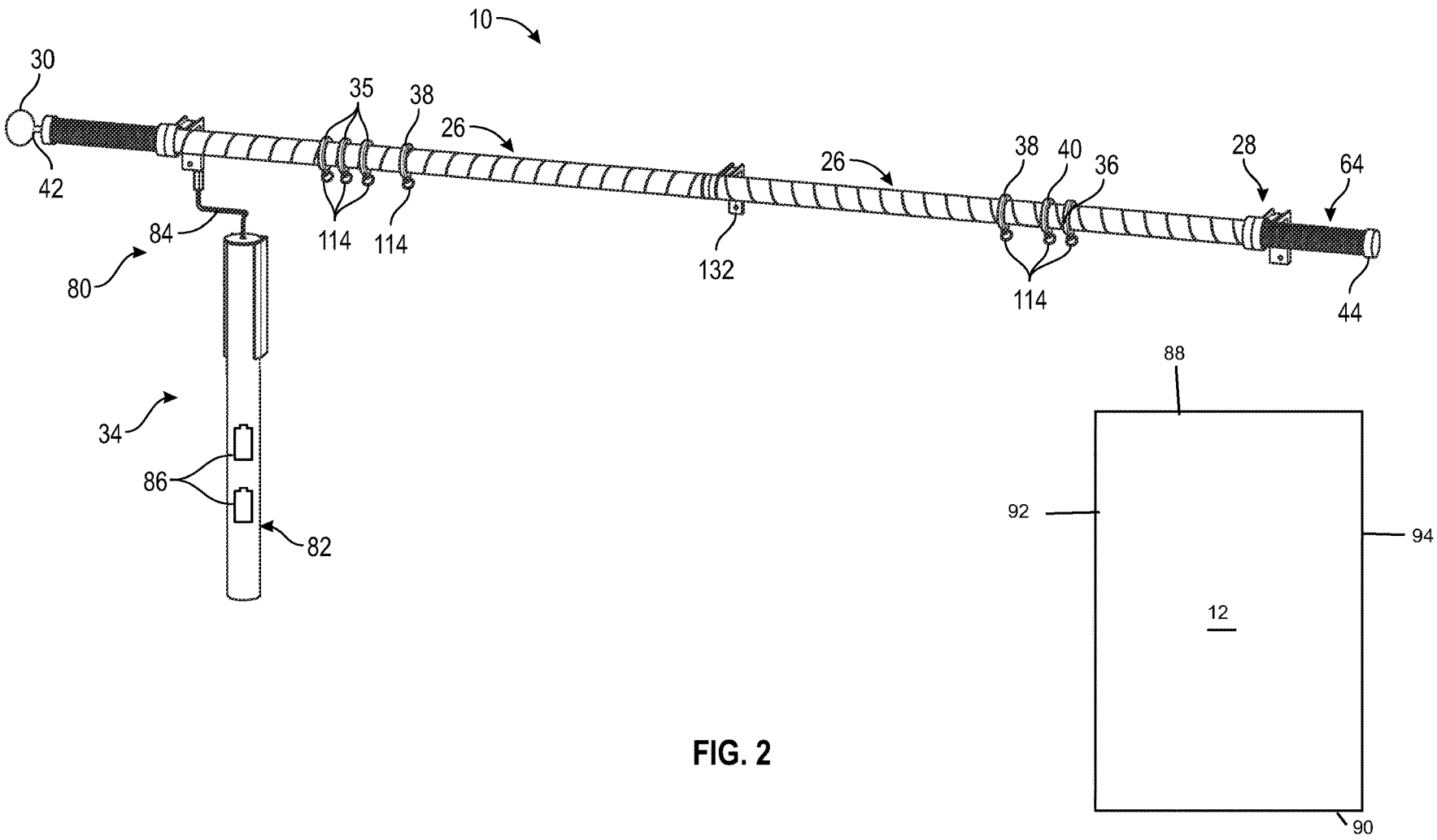
FIG. 2 is a perspective view of another configuration of a drapery rod system having a drive element that extends a length between opposing ends and has a generally cylindrical exterior surface having a guide structure therein that is formed of a pair of left hand grooves on opposing sides of the drive element and a pair of right hand grooves on opposing sides of the drive element wherein the left hand grooves and right hand grooves do not intersect one another along the length of the drive element; the view showing a plurality of rings positioned around the drive element, the view showing a pair of brackets connected to the ends of the drive element and configured to attach the drive element to a structure; the view showing a pair of finials connected to the ends of the drive element; the view also showing shade material configured to connect to the rings; the view also showing an exterior power source in the form of a battery tube configured to be connected to the drive element to power the drive element.
Figure 3:
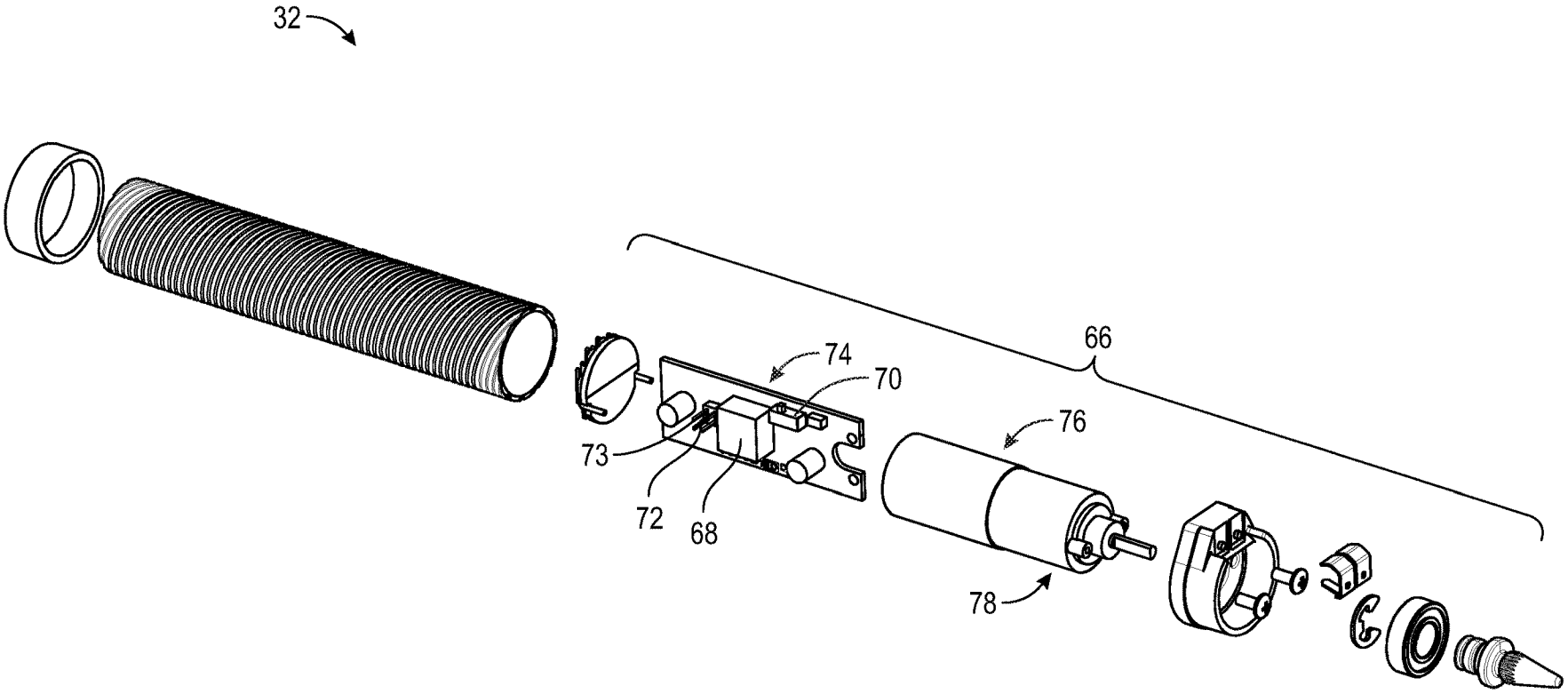
FIG. 3 is an exploded perspective view of one configuration of a motor control assembly configured to be connected to and power operation f the drapery rod system shown in FIGS. 1 and 2.
Figure 4:
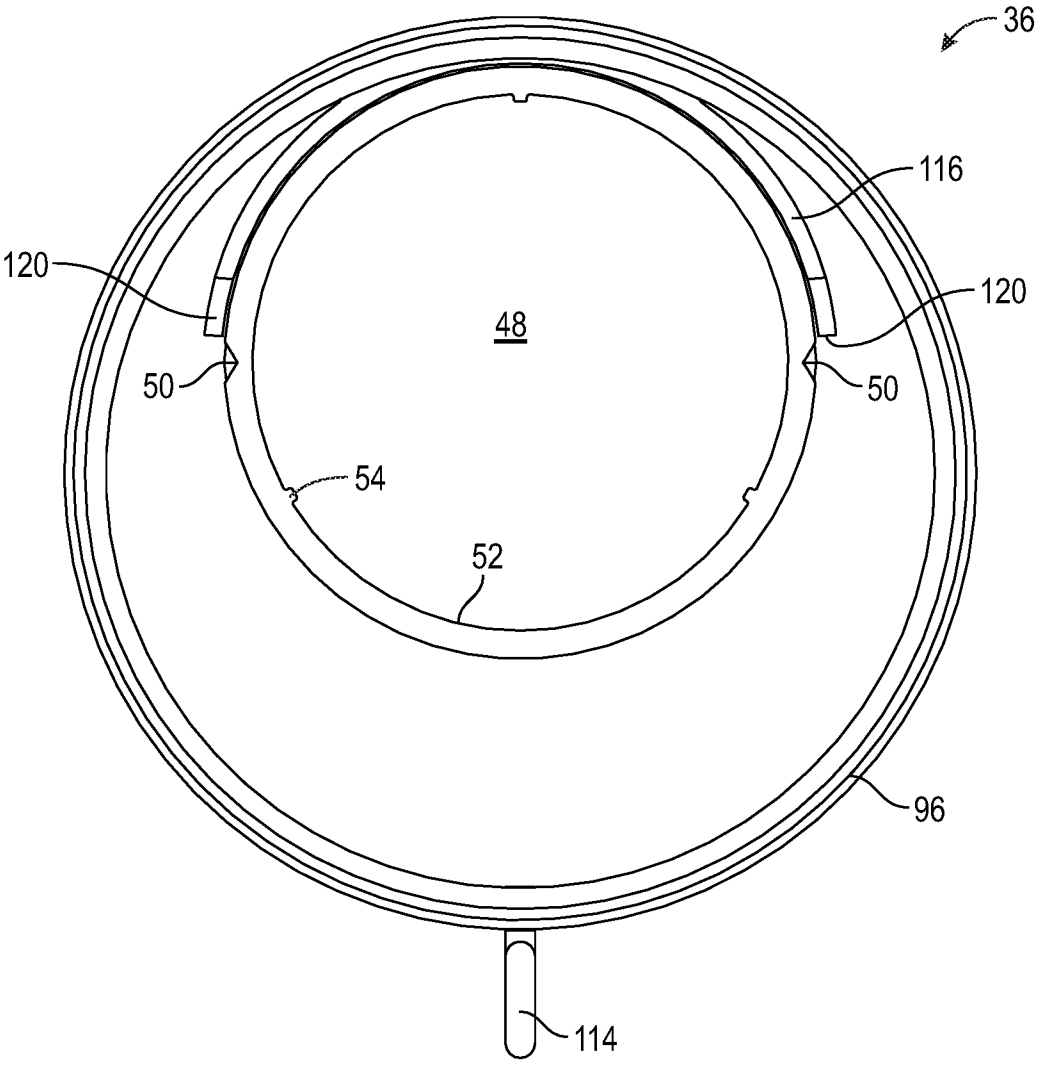
FIG. 4 is a side elevation view of a first configuration of an idler ring having an exterior hoop member and an interior member having a stabilizer; the view showing the idler ring positioned around the drive element; the view showing the stabilizer having an interior surface that has a diameter that is matches the exterior diameter of the drive element; the view showing the stabilizer extending approximately half or just less than half of the exterior surface of the drive element; the view showing the stabilizer extending on the forward side and rearward side of the drive element.

Similarly, any number of grooves for guide structure 50 is hereby contemplated for use. As one example, a single groove is hereby contemplated, that is one right hand twist groove and one left hand twist groove. Similarly, three grooves are hereby contemplated, that is three right hand twist grooves and three left hand twist grooves. Similarly, four grooves are hereby contemplated, that is four right hand twist grooves and four left hand twist grooves. And so on for any number of grooves. Similarly, the grooves may interest one another, as is shown in FIG. 1, alternatively the grooves may not intersect one another, as is shown in FIG. 2. In this arrangement of FIG. 2, the left hand twist grooves and right hand twist grooves meet at the approximate center of drive element 26, but do not intersect one another.

In the arrangement shown, as one example, drive element 26 includes a hollow interior 48. Hollow interior 48 is formed of any suitable size, shape and design and is configured to reduce the amount of material needed to form a drive element 26, as well as receive components of the system 10 such as finials 30, a motor control assembly 32, or other elements or components thereof. In the arrangement shown, as one example, hollow interior 48 includes an interior surface 52 which is generally smooth and cylindrical in shape and is positioned in approximate parallel spaced alignment to exterior surface 46 which is similarly generally smooth and cylindrical in shape, with interior surface 52 defining the interior diameter of drive element 26 and exterior surface 46. With that said, due to the wall thickness of drive element 26 the diameter of the interior surface 52 is less than the diameter of exterior surface 46.

Figure 5:
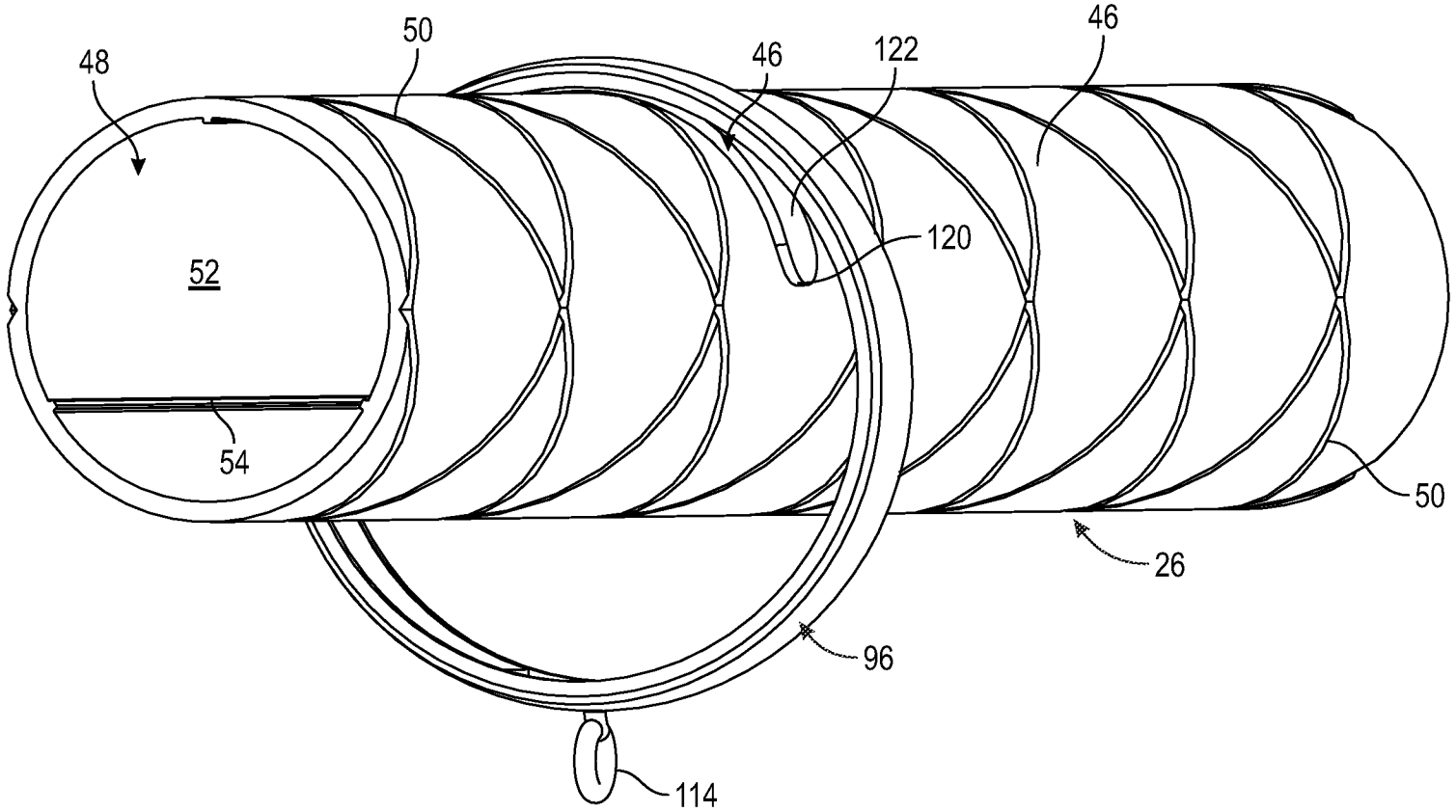
FIG. 5 is a perspective view of the first configuration of an idler ring shown in FIG. 4.
Figure 6:
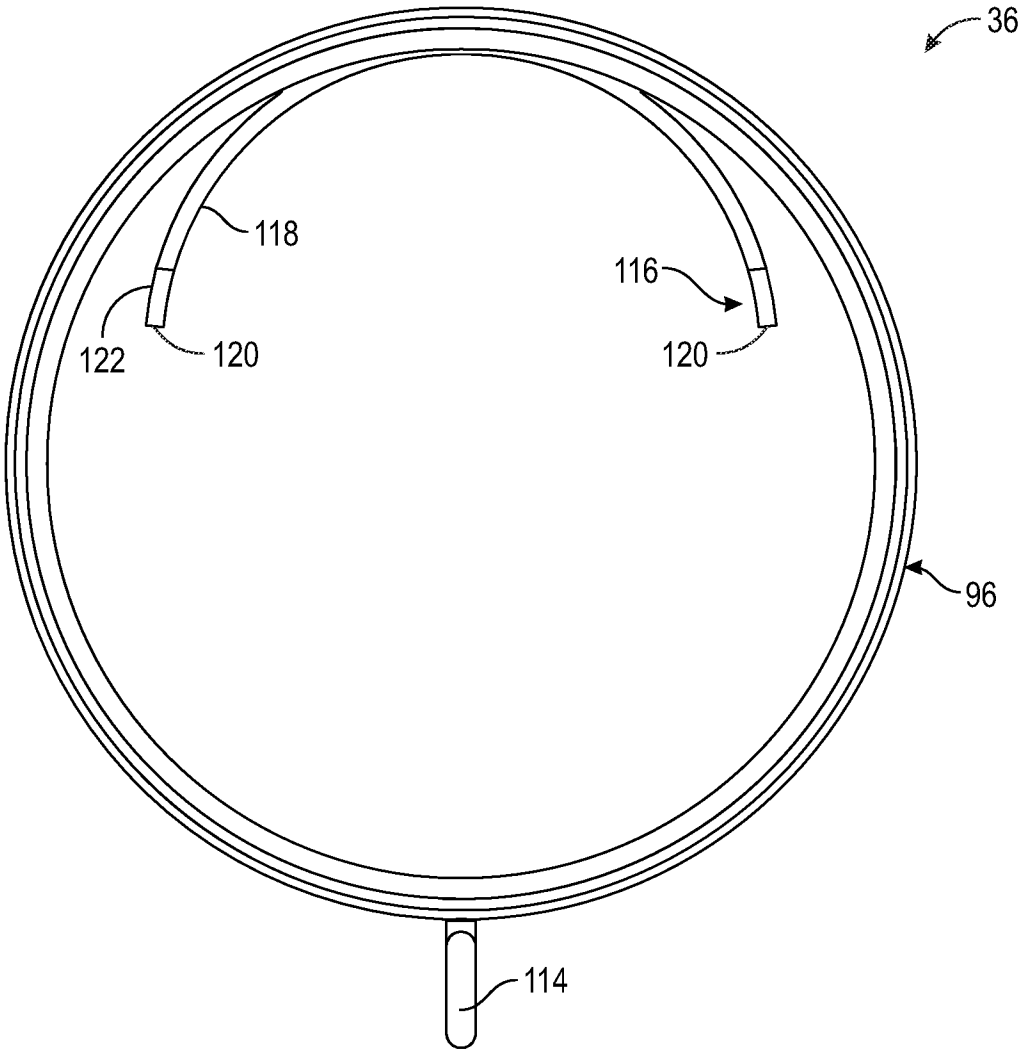
FIG. 6 is an elevation view of the first configuration of an idler ring shown in FIG. 4 with the drive element removed.
Figure 7:
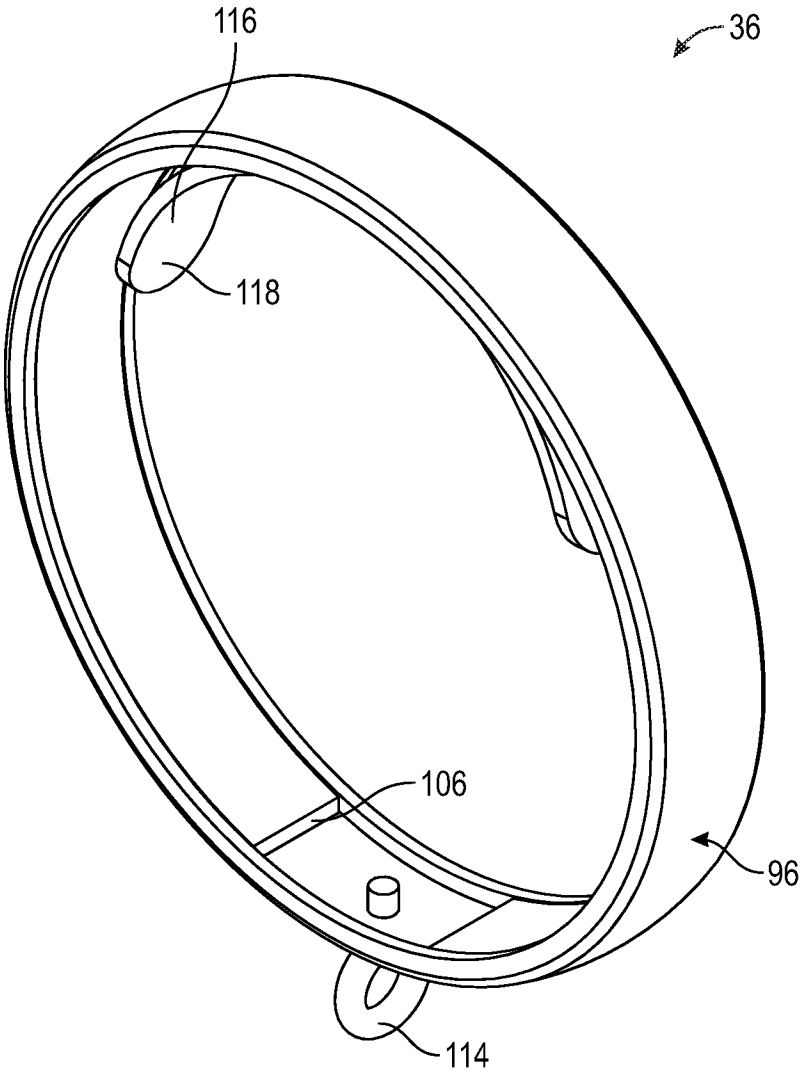
FIG. 7 is a perspective view of the first configuration of an idler ring shown in FIG. 4 with the drive element removed.
Figure 8:
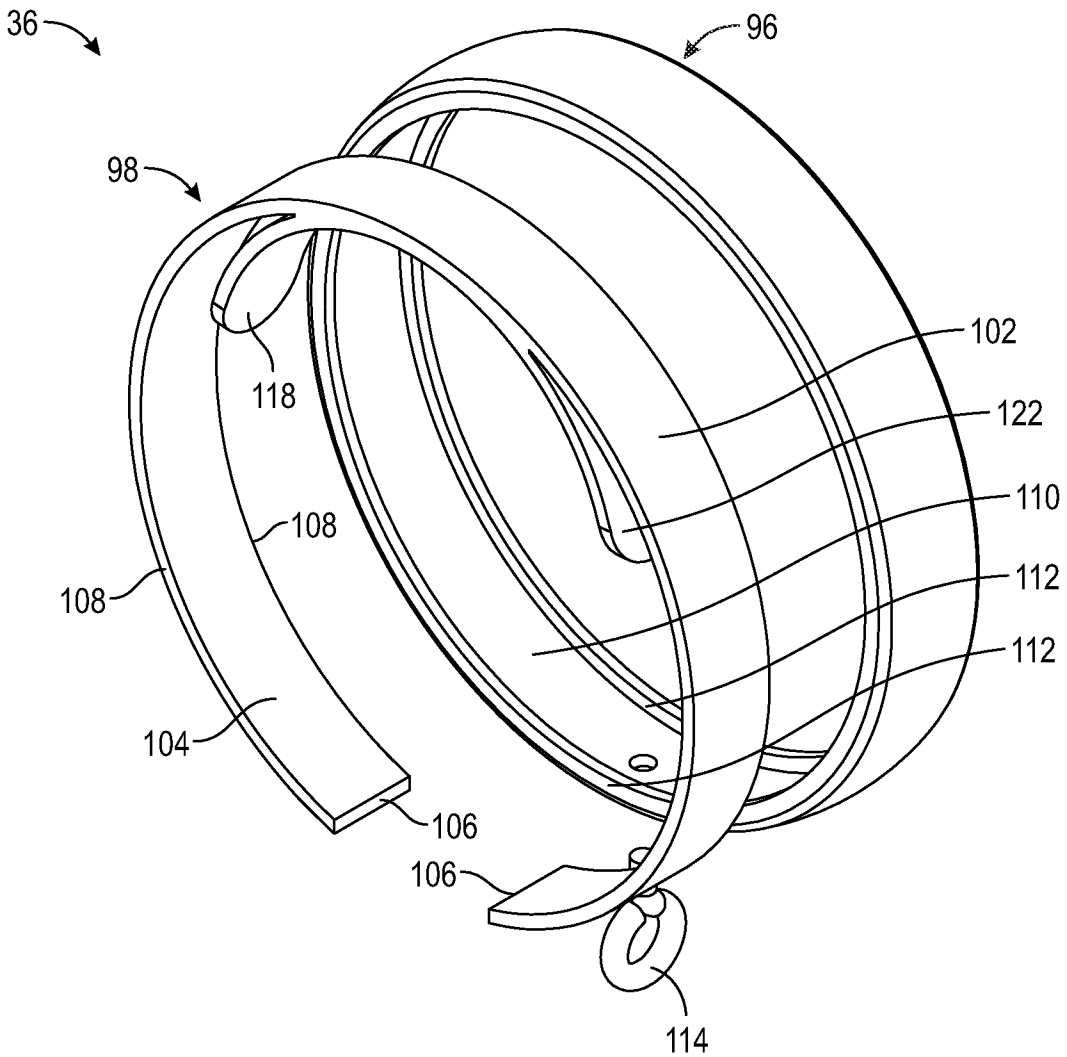
FIG. 8 is an perspective exploded view of the first configuration of an idler ring shown in FIG. 4 with the drive element removed; the view showing the hoop member and interior member exploded from one another.
Figure 9:
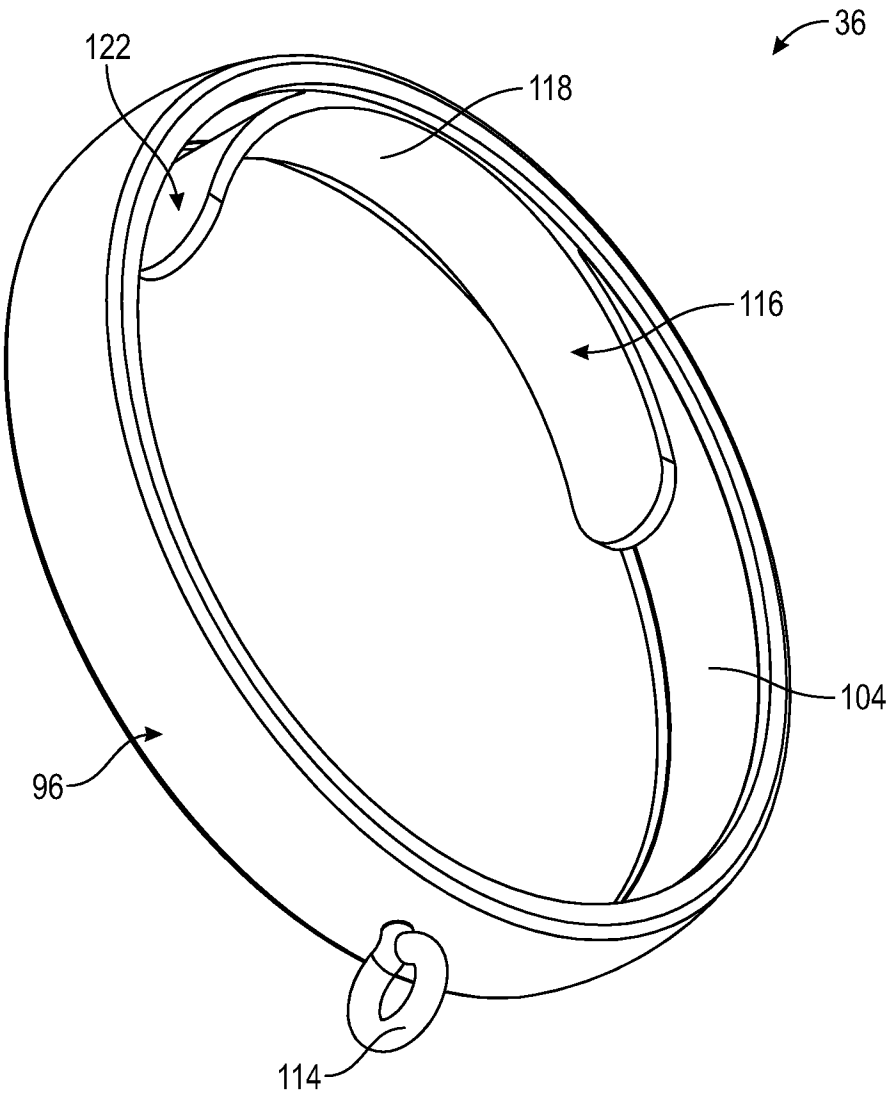
FIG. 9 is another perspective view of the first configuration of an idler ring shown in FIG. 4 with the drive element removed.
Figure 10:
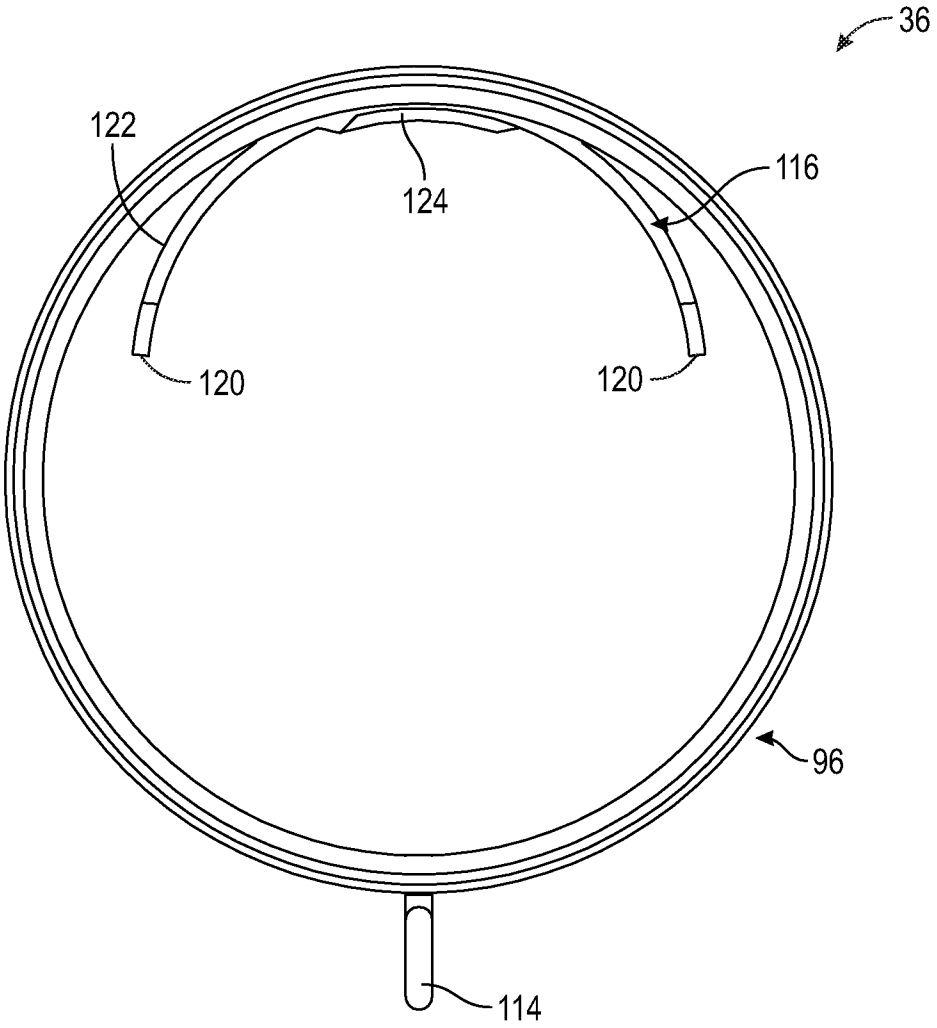
FIG. 10 is a side elevation view of a first configuration of a partial driver ring having an exterior hoop member and an interior member having a stabilizer; the view showing the top center of the interior surface of the stabilizer having a tooth therein that is configured to engage the guide structure of the drive element; the view showing the stabilizer having an interior surface that has a diameter that is matches the exterior diameter of the drive element; the view showing the stabilizer extending approximately half or just less than half of the exterior surface of the drive element; the view showing the stabilizer extending on the forward side and rearward side of the drive element.
Figure 11:
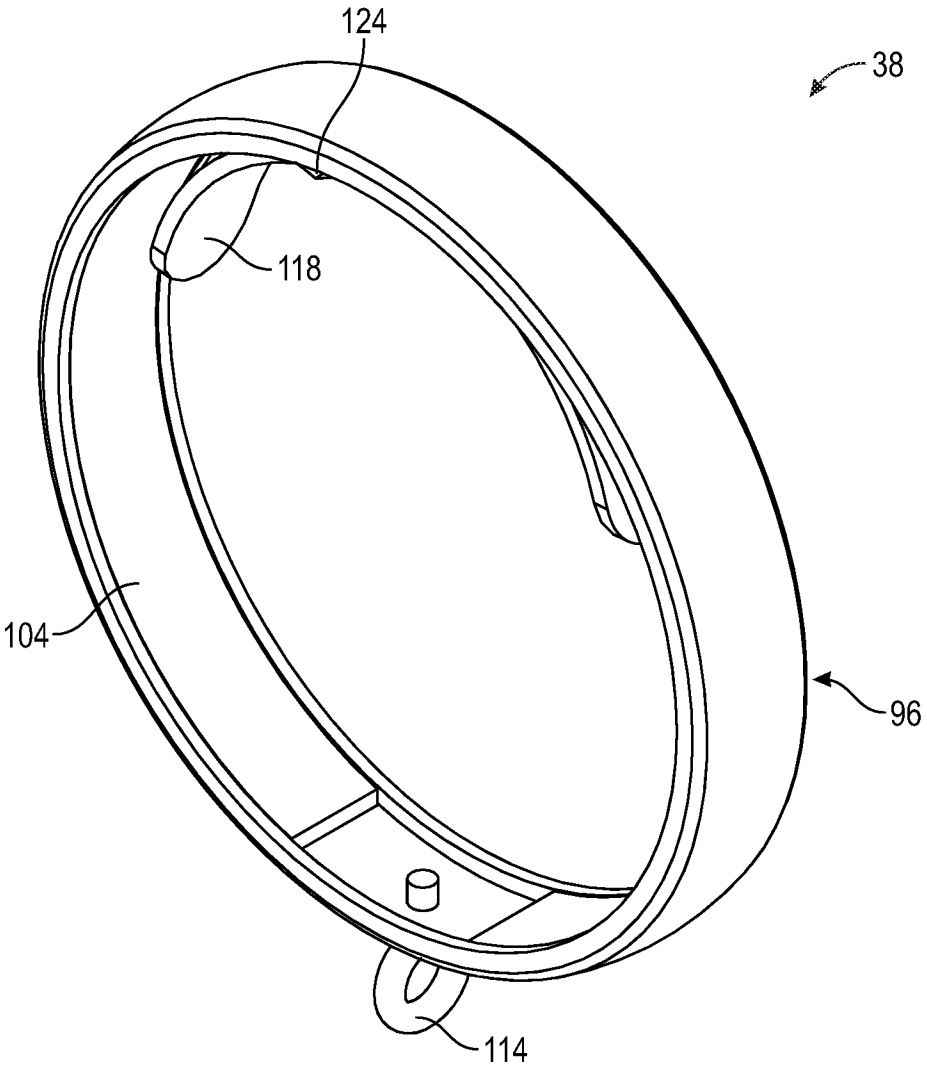
FIG. 11 is a perspective view of the first configuration of a partial driver ring shown in FIG. 10.
Figure 12:
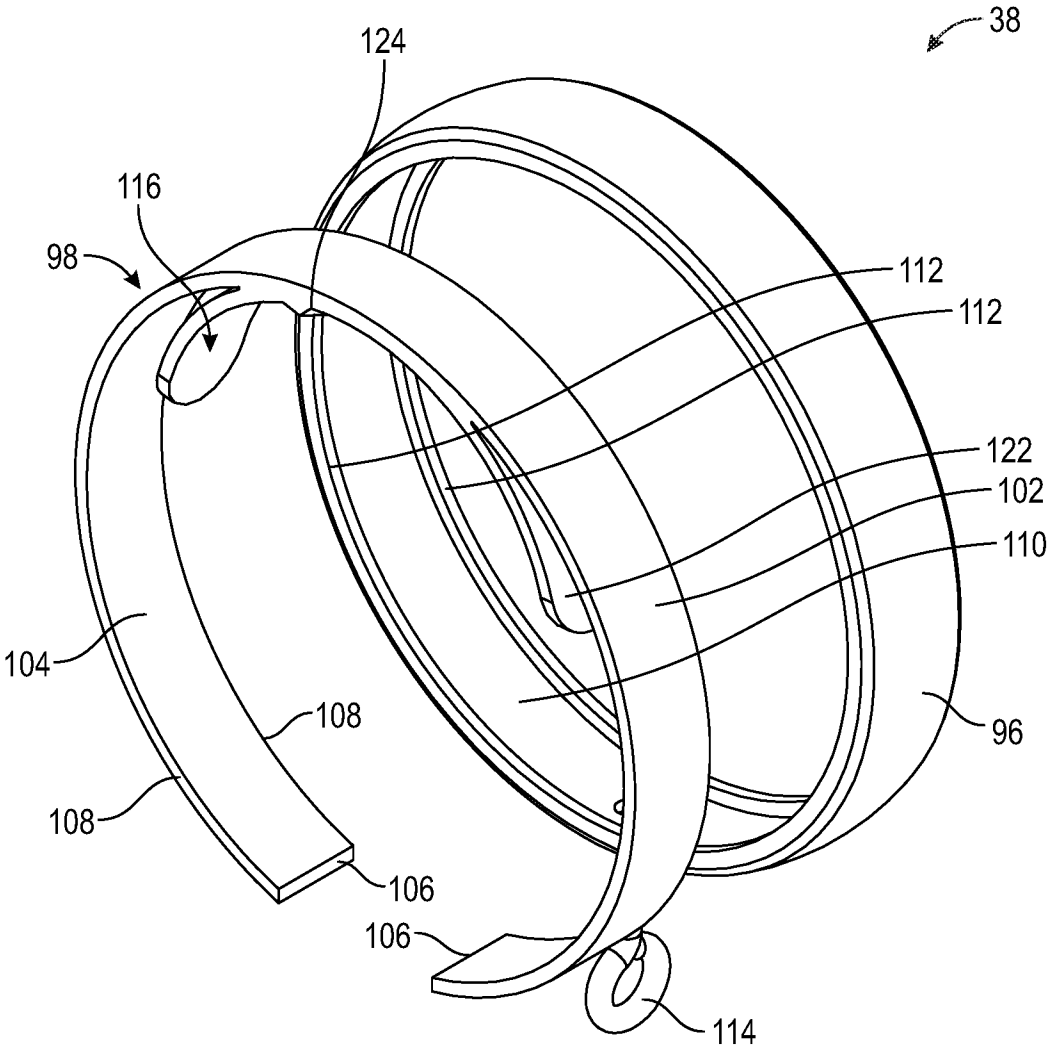
FIG. 12 is a perspective exploded view of the first configuration of a partial driver ring shown in FIG. 10; the view showing the hoop member and interior member exploded from one another.
Figure 13:
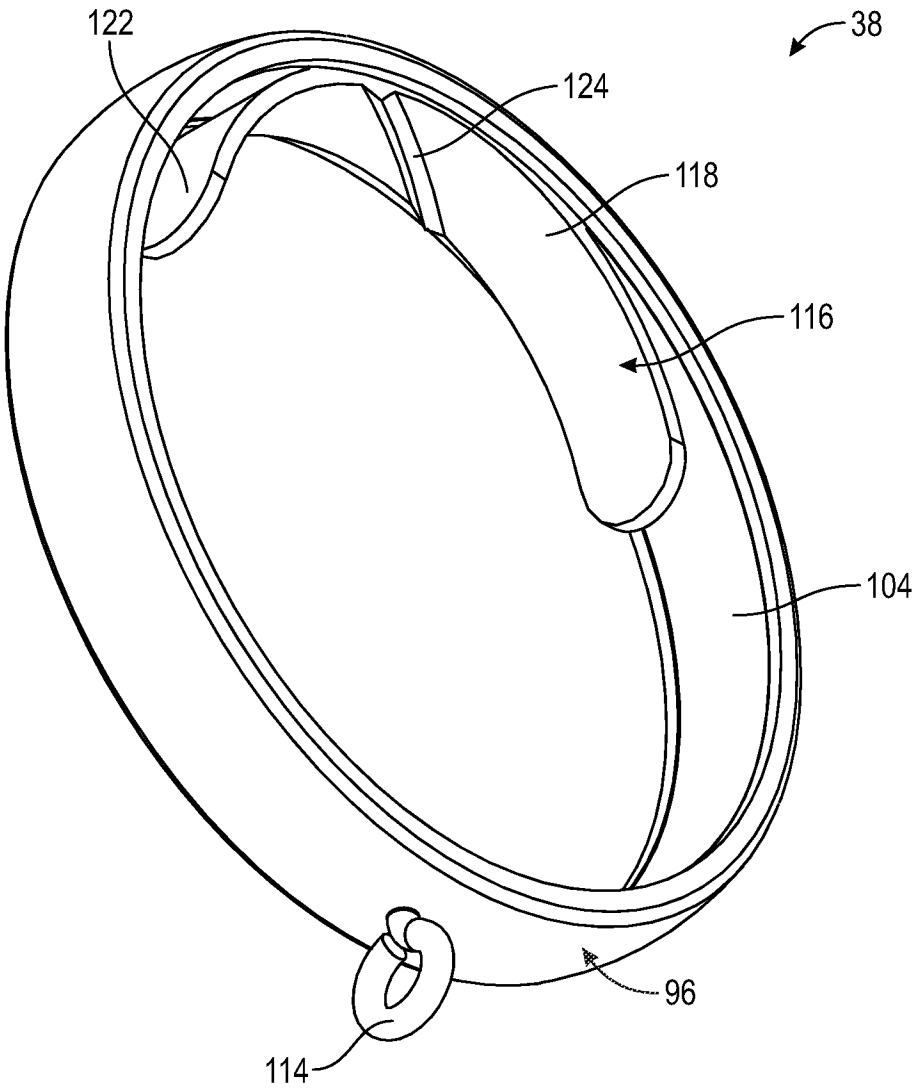
FIG. 13 is another perspective view of the first configuration of a partial driver ring shown in FIG. 10.
Figure 14:
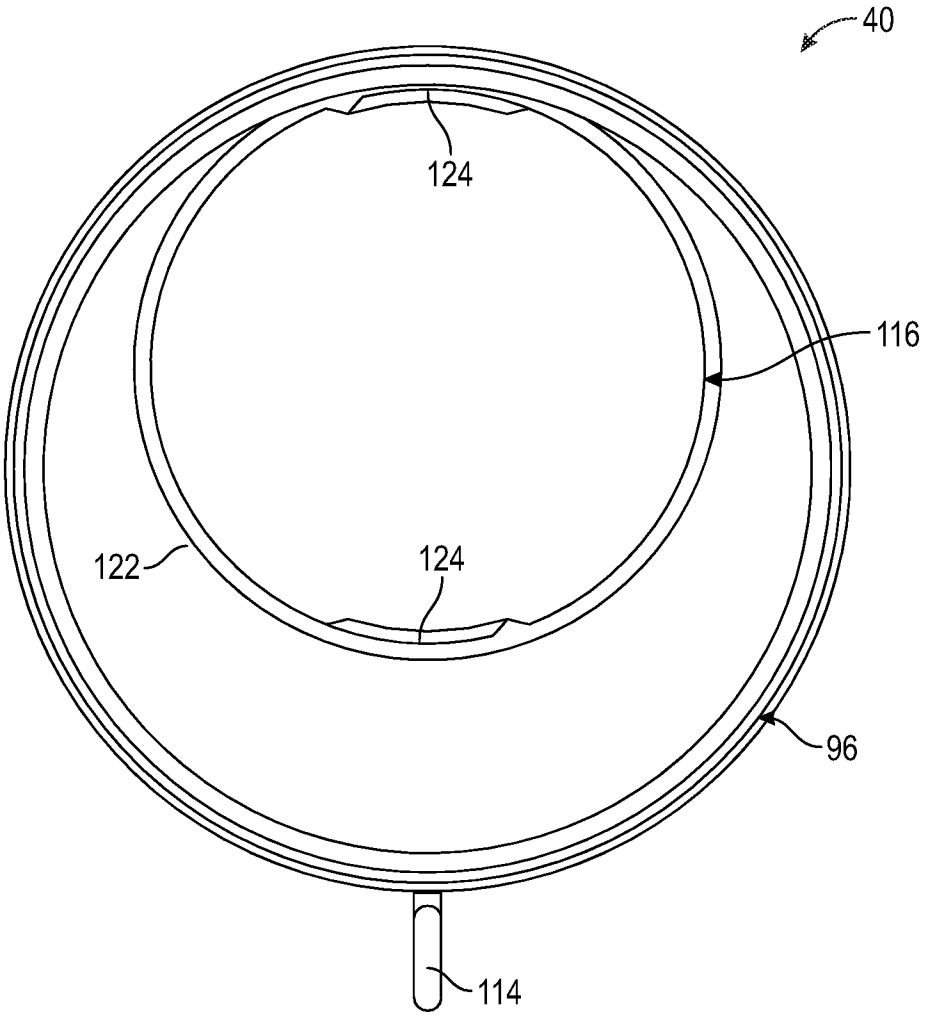
FIG. 14 is a side elevation view of a first configuration of a full driver ring having an exterior hoop member and an interior member having a stabilizer; the view showing the stabilizer having a full complete circle shape; the view showing the top center and bottom center of the interior surface of the stabilizer having a tooth therein that is configured to engage the guide structure of the drive element; the view showing the stabilizer having an interior surface that has a diameter that is matches the exterior diameter of the drive element; the view showing the stabilizer extending all of the way around the exterior surface of the drive element.
Figure 15:
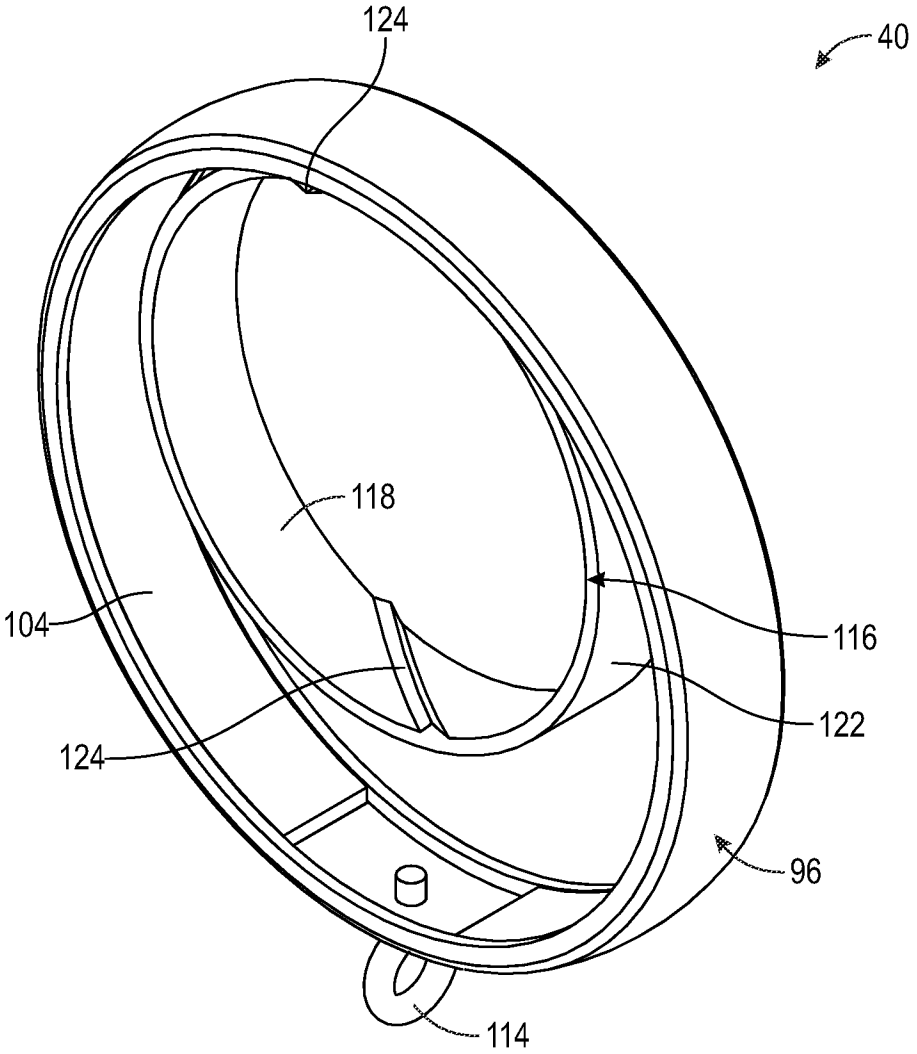
FIG. 15 is a perspective view of the first configuration of a full driver ring shown in FIG. 14.
Figure 16:
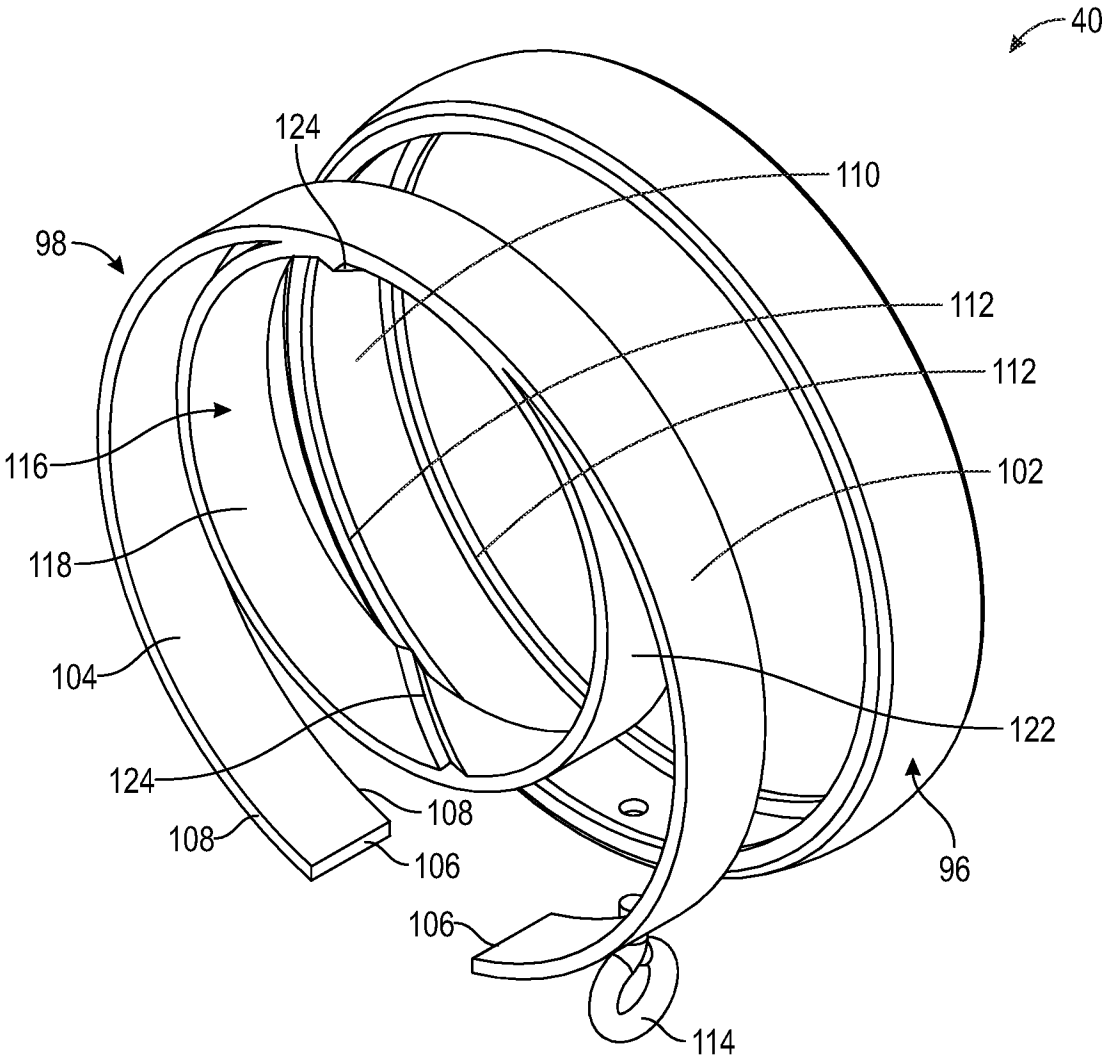
FIG. 16 is a perspective exploded view of the first configuration of a full driver ring shown in FIG. 14; the view showing the hoop member and interior member exploded from one another.
Figure 17:
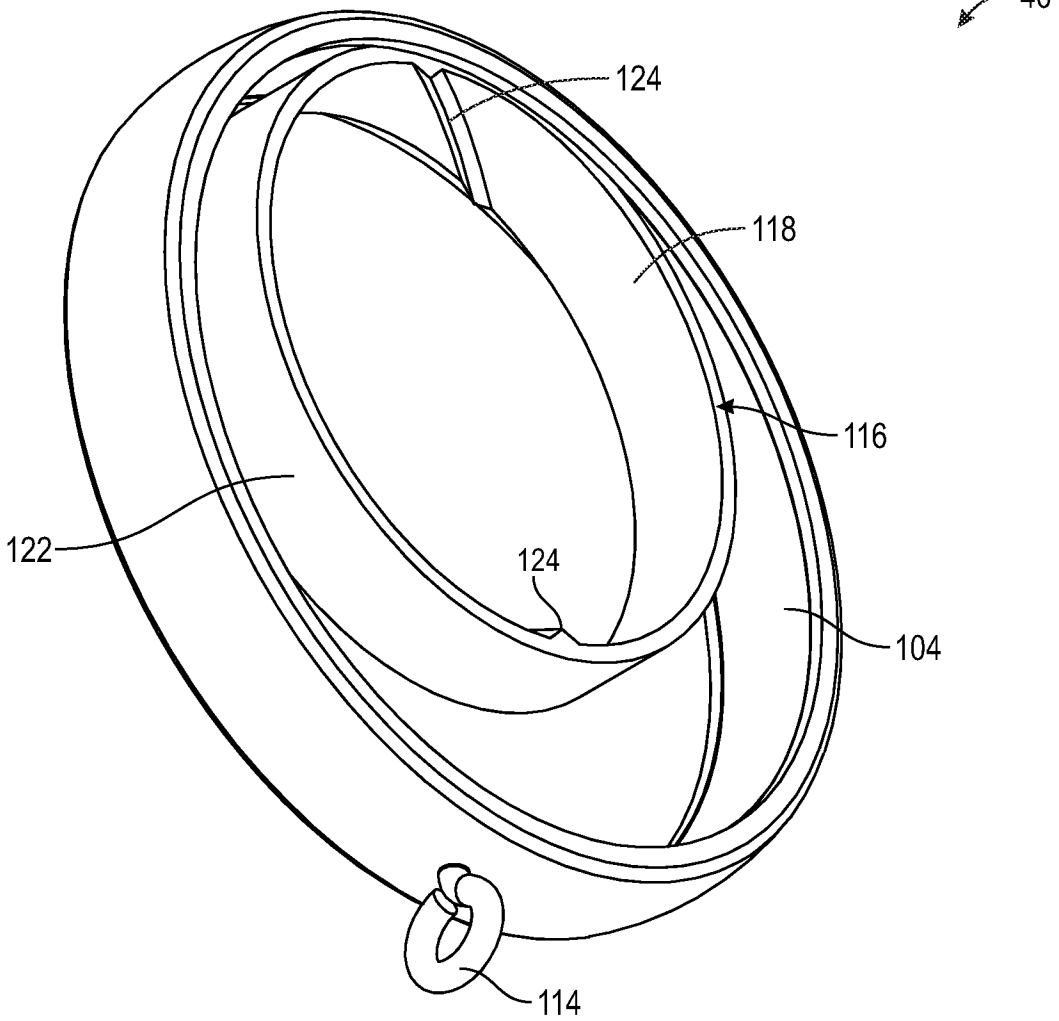
FIG. 17 is another perspective view of the first configuration of a full driver ring shown in FIG. 10.
Figure 18:
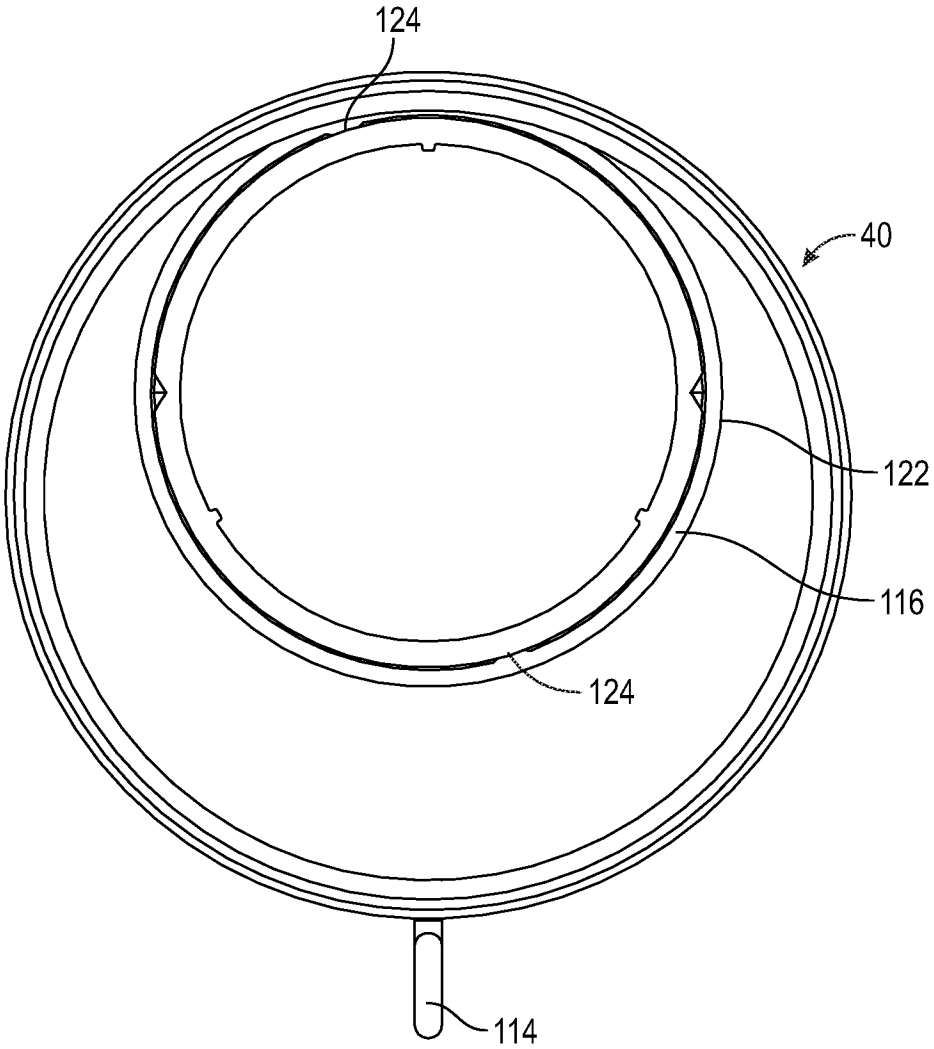
FIG. 18 is a side elevation view of the first configuration of a full driver ring shown in FIG. 14, the view showing the drive element positioned within the stabilizer; the view showing the interior surface of the stabilizer in flat and flush engagement around the entire exterior surface of the drive element.
Figure 19:
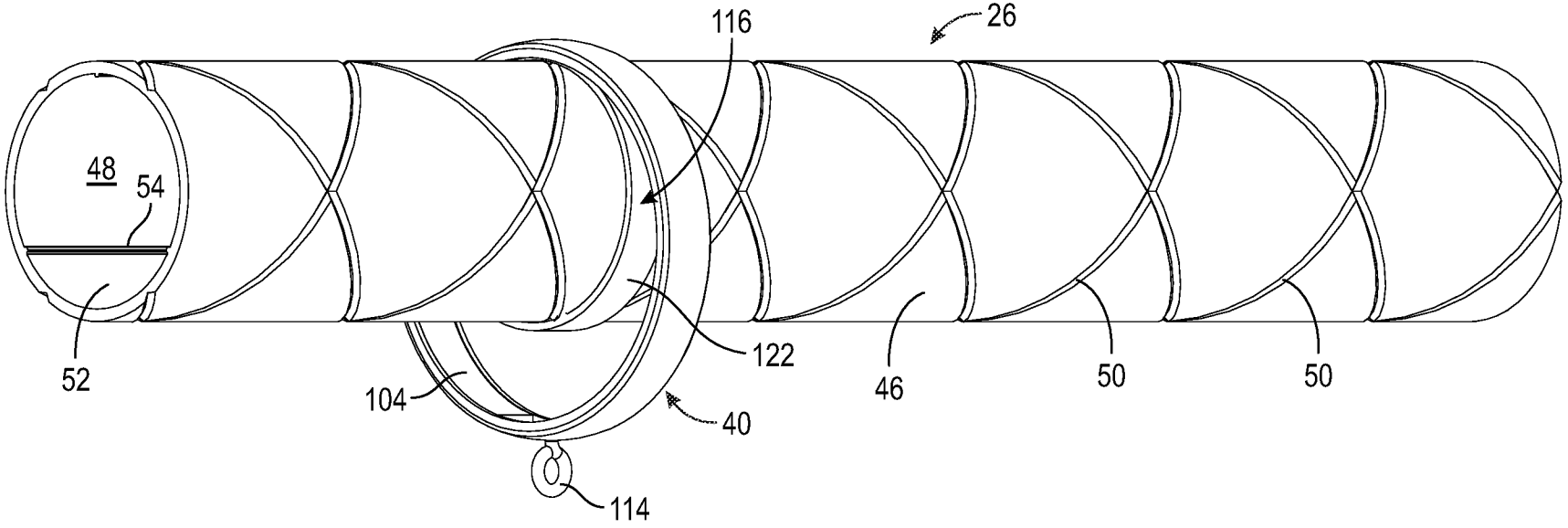
FIG. 19 is another perspective view of the first configuration of a full driver ring shown in FIG. 10; the view showing the drive element positioned within the stabilizer.
Figure 20:
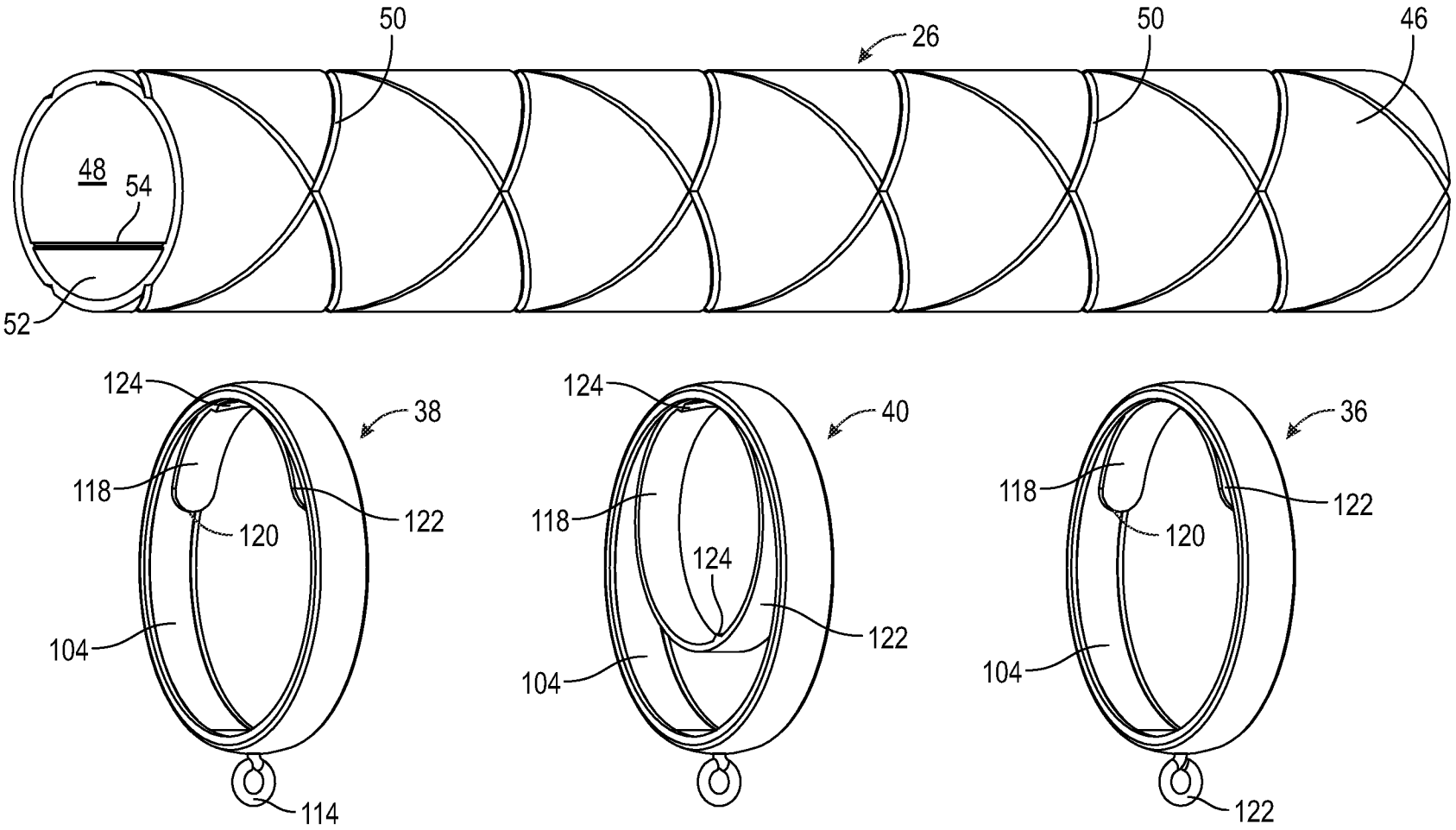
FIG. 20 is a perspective exploded view showing a drive element with an exploded partial driver ring at the left, full driver ring at center, and an idler ring at right.

In the arrangement shown, as one example, hollow interior 48 includes one or more interior features 54. In the arrangement shown, as one example, interior features 54 are formed of a protrusion, such as a rail or guide member or the like, that protrude inward from the interior surface 52 of drive element 26 a distance. Alternatively, interior features 54 may be a recess or groove or the like cut into or protruding into interior surface 52 of drive element 26 a distance. Alternatively, interior features 54 may be formed of a combination of protrusions, such as a rail or guide member or the like, that protrude inward from the interior surface 52 of drive element 26 a distance, and recesses or grooves or the like cut into or protruding into interior surface 52 of drive element 26 a distance. In the arrangement shown, as one example, interior features 54 extend in a generally straight and continuous manner from end 42 to end 44 of drive element 26. In the arrangement shown, as one example, with reference to FIG. 5, three interior features 54 are shown, in use, each interior feature 54 being approximately equally spaced from the adjacent interior features 54, or in the arrangement shown, approximately 120° from one another. Any number of interior features 54 and any configuration of interior features 54 and any placement or positioning of interior features 54 is hereby contemplated for use.

Brackets:

Drapery rod system 10 includes brackets 28. Brackets 28 are formed of any suitable size, shape and design and are configured to attach drive element 26 to wall or other structure thereby providing support for drivee element 26 while also allowing drive element 26 to rotate. In the arrangement shown, as one example, brackets 28, includes a mounting plate 56, a support arm 58, and a collar 60, among other features and elements. Mounting plate 56 is configured to attach the brackets 28 to the wall or other structure. Support arm 58 is configured to extend the collar 60 away from the wall or other structure. Collar 60 is configured to facilitate connection to drive element 26 while allowing rotation of drive element 26. Any other configuration of brackets 28 is hereby contemplated for use.

With reference to FIG. 1, a bracket 28 is positioned adjacent each outward end 42, 44 of drive element 26. With reference to FIG. 2, a bracket 28 is positioned adjacent each outward end 42, 44 of drive element 26 and a center bracket 132 bracket is shown positioned at the approximate middle of drive element 26, between a portion of drive element 26 that has left hand twist grooves only and a portion of drive element 26 that has right hand twist grooves only. Any number of brackets 28 are hereby contemplated for use, as is any configuration of brackets 28.

Finials:

Drapery rod system 10 includes finials 30. Finials 30 are formed of any suitable size, shape and design and are configured to enclose the outward end 42, 44 of drive element 26 or an extension 64 thereto and are configured to improve the aesthetic appearance of drive element 26. In one arrangement, finials 30 include a decorative element 62 which serves a decorative purpose. In another arrangement, as shown, finials 30 include an extension 64 that may serve decorative purposes and/or may serve as a place to house components of drapery rod system 10 such as a motor control assembly 32 or other components. In one arrangement, as shown, extension 64 is configured to mimic the size, shape and configuration of drive element 26 and extends past brackets 28 a length before terminating in decorative element 62.

Motor Control Assembly:

Drapery rod system 10 includes a motor control assembly 32. Motor control assembly 32 is formed of any suitable size, shape and design and is configured to facilitate motorized operation of drapery rod system 10. In the arrangement shown, as one example, motor control assembly 32 includes a motor controller 66, a microprocessor 68, memory 70, a receiver or transceiver 72 (transceiver), antenna 73, a printed circuit board 74 (PCB), a motor 76, a gearbox 78, and a connection assembly 80, among other components.

In the arrangement shown, as one example, motor controller 66 is any component or combination of components that are configured to control operation of motor 76. Microprocessor 68 is any computing device that is configured to receive inputs, processes these inputs according to information or instructions or software or code stored in memory 70 and output commands. Memory 70 is any information storage device that is configured to receive information, store information and provide information on request of microprocessor 68. Memory 70 may be formed of flash, dram, ram, a hard-drive or any combination thereof or the like. Microprocessor 68 and memory 70 may be formed of a single combined unit, separate but operatively connected components, or a plurality of separate but operatively connected components or the like or any combination thereof. Receiver or transceiver 72 may be formed of any communication device that facilitates signal transmission through wired or wireless communication. When operating in only a receive mode (one-way communication), transceiver 72 acts as only a receiver. When operating in send and receive mode (two-way communication), transceiver 72 acts both as a receiver as well as a transmitter. Antenna 73 is formed of any component configured to receive wireless signals as well as transmit wireless signals in over the air communication and may be formed of a loop antenna, a fractal antenna, a slot antenna, a monopole antenna, or any other form of an antenna. Printed circuit board 74 is configured of any structural component that is configured receive electrical components of the motor controller 66 while providing selected electrical isolation as well selected electrical connection between electronic components. Motor 76 is any component that receives electric power and converts this power into motion. Gearbox 78 is any component that changes rotational speed of an output shaft of a motor 76 to a desired speed through an arrangement of gears or other components. Connection assembly 80 is any arrangement of components that facilitate connection of motor control assembly 32 to the other components of drapery rod system 10 such as brackets 28 and/or drive element 26 so as to facilitate operation of the drapery rod system 10.

Power Source:

Drapery rod system 10 includes a power source 34. Power source 34 is formed of any suitable size, shape and design and is configured to provide power to the electronic components of drapery rod system 10. In the arrangement shown, as one example, power source includes a battery tube 82 that is electrically connected to drapery rod system 10 by way of lead 84. In the arrangement shown, as one example, battery tube 82 is formed as an elongated cylindrical member and houses a plurality of batteries 86 therein. Use of an external battery tube 82 provides the benefit of being able to place the power source 34 at any external position in a hidden manner behind shade material 12. Alternatively, power source 34 may be positioned within hollow interior 48 of drive element 26 or finials 30 or within brackets 28, or within any other component of the drapery rod system 10. However, any other configuration of power source is hereby contemplated for use, such as, direct line voltage, solar cell, or any other form of power.

Shade Material:

Drapery rod system 10 includes shade material 12. Shade material 12 is formed of any suitable size, shape and design and is generally configured of a piece of material that hangs from drive element 26 and is moved between an open position and a closed position by drive element and rings 35. Shade material 12 is configured of a piece of material that serves both aesthetic purposes as well as light remediation purposes. For one way opening draperies, shade material 12 may be formed of one piece of shade material 12, whereas in center opening or closing draperies shade material 12 may be formed of more than one piece of shade material 12. In the arrangement shown, as one example, shade material 12 extends vertically from an upper edge 88 to a lower edge 90, and extends laterally from an exterior edge 92 to an interior edge 94 in a generally panel like manner.

In the arrangement shown, as one example, shade material 12 is connected adjacent its upper edge 88 to a plurality of rings 35 that are positioned around drive element 26. As rings 35 move along the length of the drive element 26 shade material 12 is moved from an open position to a closed position or from a closed position to an open position, as is further described herein.

Rings:

Drapery rod system 10 includes a plurality of rings 35. Rings 35 are formed of any suitable size, shape and design and are generally configured to facilitate connection of shade material 12 and drive element 26 while allowing movement of shade material 12 along the length of drive element 26. In the arrangement shown, as one example, there are three similar rings 35 that form part of the system 10 that generally include idler rings 36, partial driver rings 38, and full driver rings 40. In the arrangement shown, as one example, idler rings 36, partial driver rings 38, and full driver rings 40 all include a hoop member 96, an interior member 98, and a connection member 114 among other components, features, and the like.

Hoop Member: In the arrangement shown, as one example, hoop member 96 is formed of a generally cylindrical shape member that is configured to fit around drive element 26. In the arrangement shown, as one example, when viewed from the front or back or top or bottom, hoop member 96 is generally narrow in width as compared to the end-to-end length of drive element 26. In the arrangement shown, as one example, when viewed from the side, hoop member 96 is a relatively thin generally cylindrically shaped member having a hollow interior that is configured to fit around the exterior surface 46 of drive element 26.

In the arrangement shown, as one example, hoop member 96 is configured to serve both a structural purpose as well as an aesthetic purpose. Aesthetically, hoop member 96 is configured to have a pleasing aesthetic appearance, and may have the same surface treatment or appearance or color or texture as that of the exterior surface 46 of drive element 26. Structurally, hoop member 96 is formed of a durable and/or rigid member that adds strength to support shade material 12 while moving shade material 12 between an open position and closed position along drive element 26. While a cylindrical hoop member 96 is shown, hoop member 96 may take on any other shape or design such as square, rectangular, octagonal, egg-shaped, or any other suitable or aesthetically pleasing design or shape. In one arrangement, hoop member 96 is formed of a metallic material to provide optimum strength of rigidity as well as to match the material of drive element 26 (which is generally a metallic material). Alternatively, hoop member 96 may be formed of any other material, such as a non-metallic material, a composite material, a plastic material or the like. Alternatively, hoop member 96 may be formed of a combination of metallic materials and non-metallic materials. Hoop member 96 is configured to house and hold an interior member 98.

Interior Member: In the arrangement shown, as one example, interior member 98 when viewed from the side is formed of a generally cylindrical member that is configured to fit around drive element 26 as well as fit within hoop member 96. In the arrangement shown, as one example, when viewed from the front, interior member 98 is generally narrow in width as compared to the length of drive element 26. In the arrangement shown, as one example, interior member 98 is sized and shaped to fit within hoop member 96. In the arrangement shown, as one example, when viewed from the side, interior member 98 is a relatively thin cylindrical member having a hollow interior.

In the arrangement shown, as one example, interior member 98 includes an exterior surface 102, an opposing interior surface 104, and extends in a generally cylindrical manner between opposing ends 106, and extends a width between opposing edges 108. In the arrangement shown, as one example, the exterior surface 102 of interior member 98 is generally flat and smooth and curves in a generally cylindrical convex manner. In the arrangement shown, as one example, the interior surface 104 of interior member 98 is generally flat and smooth and curves in a generally cylindrical concave manner. Exterior surface 102 extends in approximate parallel space alignment to interior surface 104, albeit the exterior diameter of interior member 98 is slightly larger than the interior diameter of interior member 98. In the arrangement shown, as one example, opposing edges 108 extend in approximate parallel spaced alignment to one another before terminating at ends 106 thereby forming opposing straight edges. Similarly, exterior surface 102 and interior surface 104 extend in approximate equal spaced alignment before terminating at edges 108.

Interior member 98 is configured to fit within hoop member 96. In the arrangement shown, as one example, when interior member 98 is positioned within hoop member 96 the exterior surface 102 of hoop member 96 is positioned in approximate flat and flush engagement with an interior surface 110 of hoop member 96 along most if not all of its length. When in this position exterior edges 108 of interior member 98 are positioned in approximate flat and flush engagement with edges 112 of hoop member 96. In this arrangement, interior member 98 is held within hoop member 96 with close and tight tolerances and frictional locking engagement.

In one arrangement, interior member 98 is sized and shaped to be spring loaded within hoop member 96. That is, when interior member 98 is forced within hoop member 96 interior member 98 has a natural spring bias force that causes interior member 98 to forcibly engage hoop member 96 thereby causing a secure connection between interior member 98 and hoop member 96 thereby securely holding interior member 98 within hoop member 96. In one arrangement, this spring bias force is generated by forming interior member 98 dimensionally to have a slightly larger outer diameter than the interior diameter of hoop member 96 while not making interior member 98 so large that it breaks upon insertion into hoop member 96. In this arrangement, to insert interior member 98 into hoop member 96, interior member 98 is slightly deformed or compacted (by bending the ends 106 inward), and then inserting the compacted interior member 98 into hoop member 96. This spring bias force also helps to eliminate or reduce relative movement between interior member 98 within hoop member 96 and reduce noise or rattling. In one arrangement, to increase the strength of hold between interior member 98 and hoop member 96 an adhesive is placed between interior member 98 and hoop member 96 such as glue, tape, gel, or any other adhesive. Alternatively any other manner or method or means can be used to affix interior member 98 and hoop member 96 together such as crimping, gluing, snap-fitting, having friction-fit members, screwing, bolting, or any other manner, method or means of connecting two components together.

In the arrangement shown, as one example, the lower end of the generally continuous circular shape of interior member 98 is interrupted by the break formed by ends 106. This interruption formed by ends 106 allows interior member 98 to flex so as to lessen the exterior diameter of interior member 98 so as to position interior member 98 within hoop member 96, which eases assembly and installation. However, in an alternative arrangement, ends 106 are not present and instead interior member 98 is forms a single continuous and uninterrupted circular member. In this arrangement, interior member 98 is forced into hoop member 96 or alternatively interior member is formed within or as part of hoop member 96, or manufactured by any other method or means.

One benefit of the space formed by ends 106 is that it provides clearance at the lower end of rings 35 for connection member 114, which facilitates connection of shade material 12 to ring 35. However, in other arrangements the gap formed by ends 106 is not present.

In the arrangement shown, as one example, rings 35 include a stabilizer 116. Stabilizer 116 is formed of any suitable size, shape and design and is configured to closely fit around the exterior surface of drive element 26 so as to provide alignment and guidance of rings 35 as they move along a length of drive element 26, as well as to provide stability to rings 35 as they pass over guide structure 50, as well as to prevent rings 35 from tilting and or binding on drive element 26, as well as to reduce noise and facilitate quieter sliding of the rings 35 across drive element 26. In the arrangement shown, as one example, with reference to idler rings 36 and partial driver rings 38, stabilizer 116 is formed generally of a semi-circular member which extends downward and outward from the upper interior surface 104 of interior member 98. In the arrangement shown, as one example, stabilizer 116 is approximately the same width as interior member 98. Stabilizer 116 includes an interior surface 118 that is sized and shaped to fit over the cylindrical exterior surface of drive element 26 with close and tight tolerances while facilitating easy movement across drive element 26. That is the interior diameter of stabilizer 116 which is formed by interior surface 118 has a smaller diameter than the interior diameter of interior member 98.

In the arrangement shown, as one example, stabilizer 116 extends downward from the approximate upper center of rings 35 in a generally semi-circular manner before terminating at free ends 120 which are unconnected within the space within the hollow interior of hoop member 96 and interior member 98. In the arrangement shown, as one example, each side of stabilizer 116 is of approximate equal length so as to provide balance. Said another way, in one arrangement, the forward positioned arm of stabilizer 116 is approximately the same size, shape, design and length, or extends downward and over drive element 26 approximately the same length and manner as the rearward position arm of stabilizer 116. Or, said another way, the forward and rearward sides of stabilizer 116 are generally symmetric along a center line. In an alternative arrangement, arms of stabilizer 116 may be a different lengths and shapes. As one example, with the forward or rearward side of stabilizer 116 being longer than the other.

In the arrangement shown, as one example, the interior surface 118 of stabilizer 116 covers less than half of the exterior diameter of drive element 26. Covering less than half the diameter of drive element 26 allows for easy placement of ring 35 over drive element 26 as well as minimizing friction while optimizing alignment and guidance. In an alternative arrangement, the interior surface 118 of stabilizer 116 covers half or more than half the exterior diameter of drive element 26. By covering more than half of the drive element 26, stabilizer 116 requires force to get the arms of stabilizer 116 to be installed upon or removed from the drive element 26, unless the ring 35 is slid over the end of drive element 26. By covering more than half of drive element 26, stabilizer 116 helps to hold ring 35 onto drive element 26. In another alternative arrangement, the interior surface 118 of stabilizer 116 extends around the entire exterior diameter of drive element 26.

In the arrangement shown, as one example, the lower ends of the arms of stabilizer 116 extend inward a distance from and are spaced a distance away from the interior surface 104 of interior member 98. That is, the exterior surface 122 of stabilizer 116 is separated the interior surface 104 of interior member 98 a distance. Space between the ends of arms of stabilizer 116 from the other components of ring 35 allow stabilizer 116 the freedom to flex and give as it moves along a length of drive element 26, thereby facilitating smoother operation. In an alternative arrangement, the arms of stabilizer 116 are not spaced from the interior surface 104 of interior member 98 which forms a more rigid but less flexible arrangement. In this arrangement, material extends from the interior surface 104 of interior member 98 to the exterior surface 122 of stabilizer 116.

In the arrangement shown, as one example, the ends 120 of stabilizer 116 are, when viewed from the front or back, curved or rounded in nature. This curved or rounded shape of ends 120 helps to deflect any engagement between stabilizer 116 and guide structure 50 so as to facilitate smooth and consistent operation. This curved arrangement also eases the placement of stabilizer 116 over drive element 26 during installation.

In one arrangement, as stated herein, drive element 26 and or hoop member 96 are formed of a metallic material for strength, rigidity, durability, and aesthetic purposes. While metallic materials provide many benefits, metallic materials have substantial drawbacks including noise generation and vibrational transmission issues. In one arrangement, to minimize noise and vibrational issues, interior member 98 and/or stabilizer 116 is formed of a non-metallic material such as a plastic, a composite, a nylon, a polymer, UHMW material, or any other non-metallic material. In one arrangement, interior member 98 and/or stabilizer 116 is formed of a material which has a low coefficient of friction and/or is self-lubricating so as to facilitate low frictional sliding across a length of drive element 26 while also providing quiet operation. In one arrangement, interior member 98 and/or stabilizer 116 is formed of a material which has a lower durometer than the materials which forms drive element 26 and/or hoop member 96 so as to facilitate vibrational dampening and/or noise reduction. In this way, forming interior member 98 and/or stabilizer 116 out of a non-metallic material when drive element 26 and/or hoop member 96 are formed of a metallic material provide substantial operational advantages.

By having the arms of stabilizer 116 extend inward from the interior surface 104 of interior member 98, this allows the use of an oversized hoop member 96 with a smaller diameter drive element 26 while eliminating wobbling and providing precise guidance to oversize rings 35. This arrangement, with an oversized ring 35 on a smaller drive element 26 provides improved aesthetics as it is preferred to have a ring 35 that is approximately 1.3 to two times the size of the drive element 26.

The teaching of stabilizer 116 described herein apply to idler rings 36, partial driver rings 38, and full driver rings 40 unless specifically stated otherwise.

In a one-way opening drapery application, a plurality of idler rings 36 are positioned around the drive element 26 on the non-opening side. The number of idler rings 36 needed depends on the length of the drive element 26 as well as the property of the materials of the shade element 12 (weight, fullness, length, desired size of ripples, opacity, strength, etc.). Positioned on the opening side of the plurality of idler rings 36 is a full driver ring 40. Positioned on the opening side of the full driver ring 40 is a partial driver ring 38. Any other configuration or arrangement is hereby contemplated for use.

In a center opening and/or center closing drapery application, a plurality of idler rings 36 are positioned around the drive element 26 on the outward sides of drive element 26. The number of idler rings 36 needed depends on the length of the drive element 26 as well as the property of the materials of the shade element 12 (weight, fullness, length, desired size of ripples, opacity, strength, etc.). Positioned on the inward side of the plurality of idler rings 36 is a full driver ring 40. Positioned on the inward side of the full driver ring 40 is a partial driver ring 38. Any other configuration or arrangement is hereby contemplated for use.

The arrangement of a plurality of idler rings 36 followed by a full driver ring 40 followed by a partial driver ring 38 provides operational advantages, namely a partial driver ring 38 drives itself along the length of drive element 26 while allowing the full driver ring 40 to "crush" the shade material 12 at the fully closed position. To crush means to cause the full driver ring 40 to either engage directly the partial driver ring 38 or engage in close proximity the partial driver ring 38, which has the effect of forcing an increased amount of shade material 12 at the fully closed position. This crushing has the effect placing additional shade material 12 at the fully closed position which has the effect of reducing light gaps in the shade material 12 at the fully closed position.

As the drapery rod system 10 rotates, the rings 35 are driven along the length of the drive element 26 to move the shade material 12 between and opened and a closed position. More specifically, full driver ring 40 engages the guide structure 50 of drive element 26 which causes linear movement of full driver ring 40 along the length of drive element 26. As the full driver ring 40 linearly moves along drive element 26, full driver ring 40 has a tendency to push or pull idler rings 36 and partial driver ring 38 as the shade material 12 moves between the opened position and the closed position.

Idler Rings: Drapery rod system 10 includes a plurality of idler rings 36. Idler rings 36 are formed of any suitable size, shape and design and are generally configured to facilitate connection of shade material 12 and drive element 26 while allowing movement of shade material 12 along the length of drive element 26. In the arrangement shown, as one example, idler rings 36 have hoop member 96, interior member 98, and a stabilizer 116, among other features, components and elements. Idler rings 36 are configured to allow free sliding across a length of drive element 26. As such, the interior surface 118 of stabilizer 116 of idler ring 36 is smooth and free of any features or teeth or other members that engage guide structure 50. As such, when shade material 12 is connected to idler ring 36, and idler ring 36 is positioned around drive element 26, shade material 12 can be easily pulled and/or slid along a length of drive element 26. As idler ring 36 moves along the length of drive element 26 the engagement between the interior surface 118 of stabilizer 116 and the exterior surface of drive element 26 provides guidance and alignment to idler ring 36, thereby reducing or preventing the idler ring 36 from wobbling, tilting, canting, or binding on drive element 26. In addition, due to the material properties of the non-metallic material that forms interior member 98 and/or stabilizer 116 as idler ring 36 moves over drive element 26, the material which forms the interior member 98 and/or stabilizer 116 absorbs vibrations, reduces noise, and provides smooth, low friction sliding. In contrast, if stabilizer 116 was formed of a metallic material, like drive element 26, this engagement would have a tendency to click, rattle, or make other noises stabilizer 116 passes over guide structure 50 due to the metal on metal engagement.

The presence of stabilizer 116 with its interior surface 118 that closely fits around the exterior surface 46 of drive element 26 substantially improves the performance of operation of idler ring 36 while also providing a ring 35 that is substantially larger than the drive element 26. That is, the presence of stabilizer 116 with its interior surface 118 that is continuously curved in a semi-circular shape that matches or mates with the exterior surface 46 of drive element 26 reduces or prevents the idler ring 36 from wobbling, tilting, canting, or binding on drive element 26 as idler ring 36 moves along the length of drive element 26. Not only does this improve the function of operation, by preventing hang-ups and provides quieter operation, this improves aesthetics of operation as the idler rings 36 remain relatively motionless as they slide laterally which is desirable to consumers.

Partial Driver Rings: All of the teaching provided above related to idler ring 36 applies to partial driver ring 38 unless specifically stated otherwise. Drapery rod system 10 includes at least one partial driver ring 38. More specifically, center opening drapery rod systems 10 include a pair of partial driver rings 38 positioned at the center of drive element 26 and inward of full driver ring 40 which is inward of a plurality of idler rings 36. One-way opening drapery rod systems 10 include one partial driver ring 38 positioned at the closing side of the drive element 26 which is positioned inward of full driver ring 40 which is positioned inward of a plurality of idler rings 36.

In the arrangement shown, as one example, partial driver ring 38 is similar to, if not identical to, idler ring 36 with one difference being the inclusion of tooth 124 or a plurality of teeth 124. Tooth 124 is formed of any suitable size, shape and design and is configured to engage guide structure 50 of drive element 26 so as to facilitate linear movement along the length of drive element 26 as drive element 26 rotates.

In the arrangement shown, as one example, tooth 124 extends in a generally triangular cross-sectional shape downward from or outward from the interior surface 118 of stabilizer 116. However, any other shape is hereby contemplated for use such as square, round, rectangular or any other shape.

In the arrangement shown, as one example, tooth 124 extends at an angle to the length of drive element 26 that corresponds to the approximate angle of guide structure 50 and extends across all or a portion of the interior surface 118 of stabilizer 116 from edge 108 to edge 108. By extending the entire interior surface 118 of stabilizer 116 this provides tooth 124 with maximum surface area pf engagement with guide structure 50, however, any other arrangement is hereby contemplated for use. While one tooth 124 is shown on the interior surface 118 of stabilizer 116, any other number of teeth are hereby contemplated for use such as two, three, four, five, six or more that are similarly arranged to engage guide structure 50.

While tooth 124 is shown as a protrusion extending outward from interior surface 118 of stabilizer 116, the opposite arrangement is hereby contemplated for use where tooth 124 is formed of a recess, groove, or other deviation into the interior surface 118 of stabilizer 116. When tooth 124 protrudes from interior surface 118 of stabilizer 116 tooth 124 is configured to be received within a groove of guide structure 50 whereas when tooth 124 is a recess into interior surface 118 or stabilizer 116 tooth 124 is configured to receive a rail, thread, or other protrusion of guide structure 50.

In one arrangement shown, as one example, tooth 124 is positioned at the approximate center of the stabilizer 116 which is also positioned at the top of partial driver ring 38. In this arrangement, tooth 124 is position opposite of connection member 114. This arrangement provides the functional advantage that the weight of shade material 12 pulls downward on partial driver ring 38 through its connection to connection member 114, this causes tooth 124 to be pulled downward into maximum engagement with guide structure 50. This reduces the desire of partial driver ring 38 to skip out of guide structure 50. In contrast, the weight of shade material 12 and the top, dead, center positioning of tooth 124 encourages tooth 124 of partial driver ring 40 to remain within guide structure 50 thereby making it easier for partial driver ring 38 to move along drive element 26 rather than skip out of guide structure 50. However, any other arrangement is hereby contemplated for use where tooth 124 or multiple teeth 124 are positioned at other positions along partial driver ring 38.

In one arrangement, interior member 98 may be moved or rotated with respect to hoop member 96 so as to adjust the position of stabilizer 116 and or tooth 124 by rotating interior member 98 within hoop member 96. Alternatively, connection member 114 may be moved relative to interior member 98 and or hoop member 96 so as to adjust the position of stabilizer 116 and or tooth 124 relative to the forces generated by the weight of shade material 12 connected to connection member 114.

During operation of drapery rod system 10, as drive element 26 is rotated, due to the weight of shade material 12 pulling down on partial driver ring 38, this causes tooth 124 to engage with guide structure 50. As the drive element 26 is rotated, the engagement between tooth 124 and guide structure 50, coupled with the downward force on partial driver ring 38, causes partial driver ring 38 to laterally move along the length of drive element 26. This lateral movement continues until partial driver ring 38 engages a non-movable object such as bracket 28 or a stop, such as at the fully closed position. When partial driver ring 38 engages a non-moving stop of bracket 28, partial driver ring 38 no longer moves laterally. This causes the tooth 124 of partial driver ring 38 to come out of, or rise out of, guide structure 50 as the drive element 26 continues to rotate. As the drive element 26 continues to rotate, while partial driver ring 38 is not engaged with guide structure 50, this allows full driver ring 40 to drive closer toward partial driver ring 38 thereby crushing the shade material at the fully closed position. This crushing causes the full driver ring 40 and partial driver ring 38 to be closer to one another than they would be if their respective teeth 124 remained in engagement with guide structure 50. This close proximity of full driver ring 40 and partial driver ring 38 causes an increased amount of shade material 12 at the fully closed position. This stack-up of shade material 12 at the fully closed position helps to reduce light gaps and helps to provide overlap of shade material 12 at the fully closed position.

In the arrangement shown, as one example, the partial driver ring 38 is allowed to disengage the guide structure 50 by the stabilizer 116 only fitting partially around the drive element 26. By stabilizer 116 only fitting around a portion of drive element 26 (such as stabilizer 116 fitting around half or less than half of the exterior circumference of drive element 26) this allows partial driver 38 to selectively move out of engagement with guide structure 50 when the forces moving linearly are greater than the forces of moving vertically. That is, when it is easier for partial driver element 38 to move laterally, partial driver element 38 moves laterally and tooth 124 remains in engagement with guide structure 50. Similarly, when it is easier for partial driver element 38 to move vertically, partial driver element 38 moves vertically and tooth 124 comes out of engagement with guide structure 50. Similarly, by stabilizer 116 only fitting around a portion of drive element 26 this allows partial driver ring 38 to move back into engagement with guide structure 50 when the partial driver ring 38 is pulled downward by the weight of shade material 12 into engagement with guide structure 50. In contrast to this arrangement of partial driver ring 38, the stabilizer 116 of full driver ring 40 extends around the entire exterior diameter of drive element 26, which prevents the teeth 124 of full driver ring 40 from selectively moving in or out of engagement with guide structure 50.

Full Driver Ring: All of the teaching provided above related to idler ring 36 and partial driver ring 38 applies to full driver ring 40 unless specifically stated otherwise. Drapery rod system 10 includes at least one full driver ring 40. More specifically, center opening drapery rod systems 10 include a pair of full driver rings 40, where full driver rings 40 are positioned between a plurality of idler rings 36 positioned at the outward side of drive element 26 and a partial driver ring 38 positioned at the inward side of drive element 26. One-way opening drapery rod systems 10 include one full driver ring 40 positioned between a plurality of idler rings 36 positioned on the non-opening side and a partial driver ring 38 positioned at the opening and closing side.

In the arrangement shown, as one example, full driver rings 40 are similar to partial driver rings 38 with one difference being stabilizer 116 does not terminate at ends 120. Instead the stabilizer 116 of full driver ring 40 extends around the exterior diameter of the drive element 26 in a continuous and uninterrupted manner. In the arrangement shown, as one example, like partial driver rings 38, full driver rings 40 includes a tooth 124 positioned at the upper center of the interior surface 118 of stabilizer 116. However any number of teeth 124 are hereby contemplated for use. Like the tooth 124 of partial driver ring 38, this upper tooth 124 of full driver ring 40 is formed of any suitable size, shape and design and is formed to engage guide structure 50 of drive element 26 so as to facilitate linear movement along the length of drive element 26 as shade material 12 pulls downward on full driver ring 40.

In the arrangement shown, as one example, a second tooth 124 is positioned on interior surface 118 of stabilizer 116 at the bottom center of stabilizer 116. In this arrangement, the first tooth 124 and the second tooth 124 are arranged on opposite sides of stabilizer 116 from one another so as to match the spacing and placement of the features of guide structure 50. As such it is worth noting, the positioning of and number of teeth 124 are dictated by the number of grooves or features of guide structure 50. While two teeth 124 are shown in use, any number of teeth 124 are hereby contemplated for use and are configured to correspond in size, shape and placement to the features of guide structure 50.

As one example, when drive element 26 includes only a single groove as guide structure 50, stabilizer 116 of full driver ring 40 includes only a single tooth 124 positioned at the top-dead-center (or any other position) of stabilizer 116. As another example, as is shown, when drive element 26 includes a pair of grooves as guide structure 50, stabilizer 116 of full driver ring 40 includes a pair of opposed teeth 124, which in the example shown, are positioned at the top-dead-center and bottom-dead-center of stabilizer 116, however any other position is hereby contemplated for use. As another example, when drive element 26 includes three equally spaced of grooves as guide structure 50, stabilizer 116 of full driver ring 40 includes a three equally spaced teeth 124, which in one example includes a tooth positioned the top-dead-center of stabilizer 116, and a pair of teeth 124 positioned approximately one hundred and twenty degrees along the interior surface 118 of stabilizer 116. Any other arrangement is hereby contemplated for use.

In one arrangement, the teeth 124 of full driver ring 40 are shaped similarly to the tooth 124 of partial driver ring 38, and any disclosure related to the teeth 124 of partial driver ring 38 is repeated for the teeth 124 of full driver ring 40.

In the arrangement shown, as one example, the interior diameter of the interior surface 118 of stabilizer 116 of full driver ring 40 is sized and shaped to fit around the exterior surface of drive element 26 with close and tight tolerances, while still allowing for smooth, easy and low friction sliding of full driver ring 40 along the length of drive element 26. As opposing teeth 124 extend inward from interior surface 118 of stabilizer 116 the inner diameter of the inward end of teeth 124 are less than the exterior diameter of drive element 26. Said another way, the teeth 124 extend inward from the interior surface 118 of stabilizer 116 a greater distance than the dimensional tolerances between the interior diameter of stabilizer 116 and the exterior surface of drive element 26. As such, when full driver ring 40 is positioned around drive element 26, teeth 124 are engaged within guide structure 50. As the stabilizer 116 of full driver ring 40 fully extends around the exterior diameter of drive element 26 with close and tight tolerances, teeth 124 are prevented from skipping out of or coming disengaged from guide structure 50 as drive element 26 is rotated. As such, when drive element 26 is rotated, full driver ring 40 moves laterally along the length of drive element 26. This is in contrast to partial driver ring 38 which, due to the stabilizer 116 only extending around a portion of the drive element 26, which is allowed to jump out of or skip out of engagement with guide structure 50 so as to allow free rotation of drive element 26 while partial driver ring 38 remains stationary and/or disengaged.

During operation of drapery rod system 10, as drive element 26 is rotated, teeth 124 of full driver ring 40 are engaged with the grooves of guide structure 50 of drive element 26. Due to the weight of shade material 12 pulling down on full driver ring 40, this maintains the vertical orientation of full driver ring 40 and prevents full driver ring 40 from rotating as drive element 26 rotates. As the drive element 26 is rotated, the engagement between teeth 124 and guide structure 50, coupled with the downward force on full driver ring 40, causes full driver ring 40 to laterally move along the length of drive element 26. Due to the direct engagement of full driver ring 40 with drive element 26, the operational limits, the fully opened and fully closed positions, are programmed and controlled by motor control assembly 32. Motor control assembly 32 powers motor 76 to rotate drive element 26 until full driver ring 40 reaches its desired position (e.g. fully opened, fully closed, or any intermediary position there between) along the length of drive element 26 at which point power to the motor 76 is terminated.

As drive element 26 is rotated, full driver ring 40 causes movement of the idler rings 36 and partial driver ring 38.

In an opening operation, when starting at a fully closed position, partial driver ring 38 tends to be in engagement with or within close proximity of a bracket 28 with full driver ring 40 positioned in engagement with or in close proximity of partial driver ring 36 and idler rings 36 tend to be spaced out along the length of drive element 26 with the outward most ring positioned on the side of a bracket opposite partial driver ring 38 and fully driver ring 40 thereby anchoring the outward end of idler rings 36. As drive element 26 is rotated, the engagement of full driver ring 40 with guide structure 50 has a tendency to move full driver ring 40 toward the open position along the length of drive element 26. As drive element 26 is rotated, full driver ring 40 has a tendency to push the idler rings 36 as full driver ring 40 moves toward the open position. In an opening operation, partial driver ring 38 when engaged with guide structure 50 may drive under its own power, however at other times partial driver ring 38 is pulled along the length of drive element 26 by full driver ring 40 toward the open position. That is, in an opening operation, partial driver ring 38 may move out of a combination of being pulled by the shade material 12 connected to full driver ring 40 and engagement of the tooth 124 of partial driver ring 38 with guide structure 50. The full driver ring 40 continues to move toward the open position until full driver ring 40 compacts the plurality of idler rings 36 between outward bracket 28 and full driver ring 40. This causes a compressed stack of shade material 12 at the opening end of drive element 26 when shade material 12 is in the fully opened position.

In a closing operation, when starting at a fully opened position, the plurality of idler rings 36 are positioned within close proximity within one another between the outward bracket 28 at the open position and full driver ring 40. As drive element 26 is rotated, the engagement of full driver ring 40 with guide structure 50 has a tendency to pull the trailing idler rings 36 along the length of drive element 26 as full driver ring 40 moves toward the closed position. In a closing operation, partial driver ring 36 when engaged with guide structure 50 may drive under its own power however when partial driver ring 38 is disengaged from guide structure 50 full driver ring 40 will push partial driver ring 36 toward the closed position. That is, in a closing operation, partial driver ring 38 may move out of a combination of engagement of the tooth 124 of partial driver ring 38 with guide structure 50 and by being pulled by full driver ring 40.

This lateral movement continues until partial driver ring 38 engages non-movable object such as a bracket 28 or a stop, such as at the fully closed position, at which point partial driver ring 38 no longer moves laterally which causes the tooth 124 to come of out of guide structure 50 as the drive element 26 continues to rotate. As the drive element 26 continues to rotate, while partial driver ring 38 is not engaged with guide structure 50, this allows full driver ring 40 to drive closer toward partial driver ring 38, thereby crushing the shade material at the fully closed position, thereby reducing light gaps.

In the arrangement shown, as one example, the partial driver ring 38 is allowed to disengage the guide structure 50 by the stabilizer 116 only fitting partially around the drive element 26. By stabilizer 116 only fitting around a portion of drive element 26, this allows partial driver 38 to selectively move out of engagement with guide structure 50 when the forces moving linearly are greater than the forces of moving vertically. Similarly, by stabilizer 116 only fitting around a portion of drive element 26 this allows partial driver ring 38 to move back into engagement with guide structure 50 when the partial driver ring 38 is pulled downward by the weight of shade material 12 into engagement with guide structure 50. In contrast to this arrangement of partial driver ring 38, the stabilizer 116 of full driver ring 40 extends around the entire exterior diameter of drive element 26, which prevents the teeth 124 of full driver ring 40 from selectively moving in or out of engagement with guide structure 50.

As the drive element 26 rotates, stabilizers 116 of idler rings 36 and partial driver rings 38 help to smooth the operation of drapery rod system 10 as it moves between the open and closed position by guiding these rings 35, by holding the exterior surface of drive element 26 with close and tight sliding tolerances. In addition, the material properties of stabilizer 116 helps to absorb vibration and noise and helps to smooth guidance of rings 35 over drive element 26 while sliding with a low coefficient of friction. In addition, the operation of the full driver ring 40 that cannot escape engagement with guide structure 50 in concert with partial driver ring 38 that may escape engagement with guide structure 50 allows for crushing of the shade material 12 at fully closed position thereby reducing or eliminating light gaps.

Figure 21:
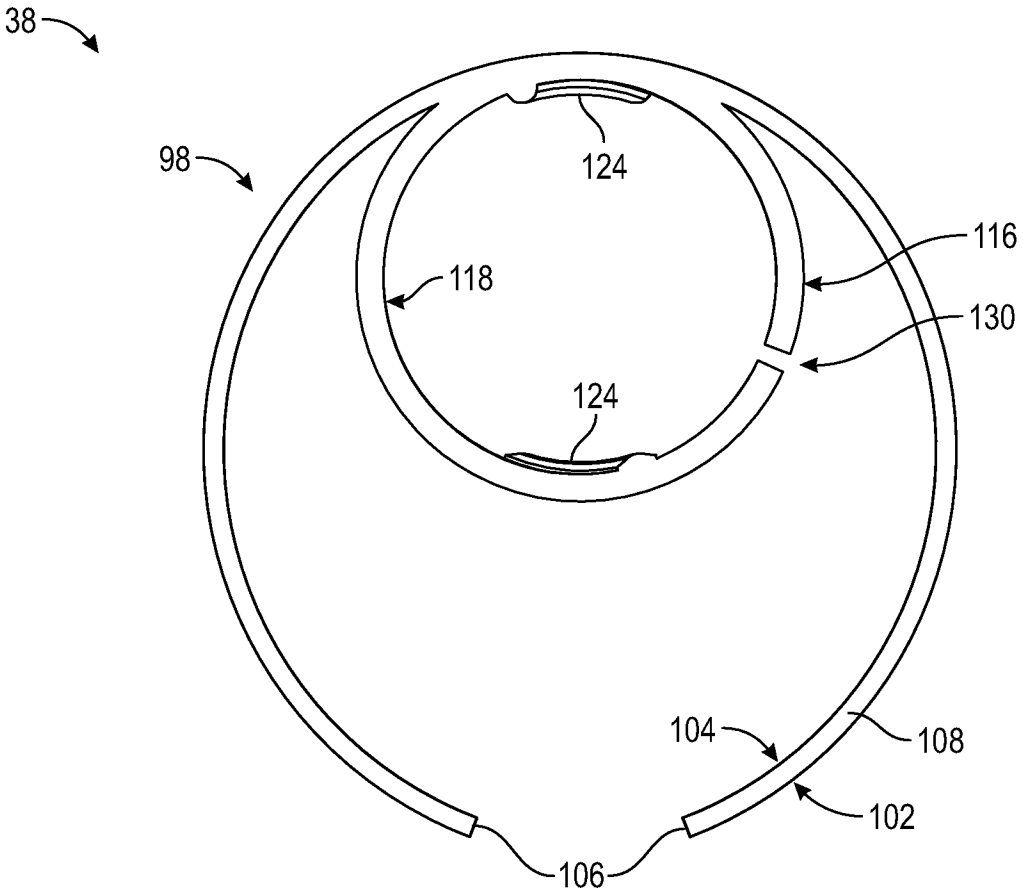
FIG. 21 is a side elevation view of an interior member of another configuration of a partial driver ring; the view showing the interior member terminating at ends at the lower end of the interior member; the view showing the stabilizer extending all the way around the drive element and having a slot therein to allow the stabilizer to flex to allow the teeth out of the guide structure.
Figure 22:
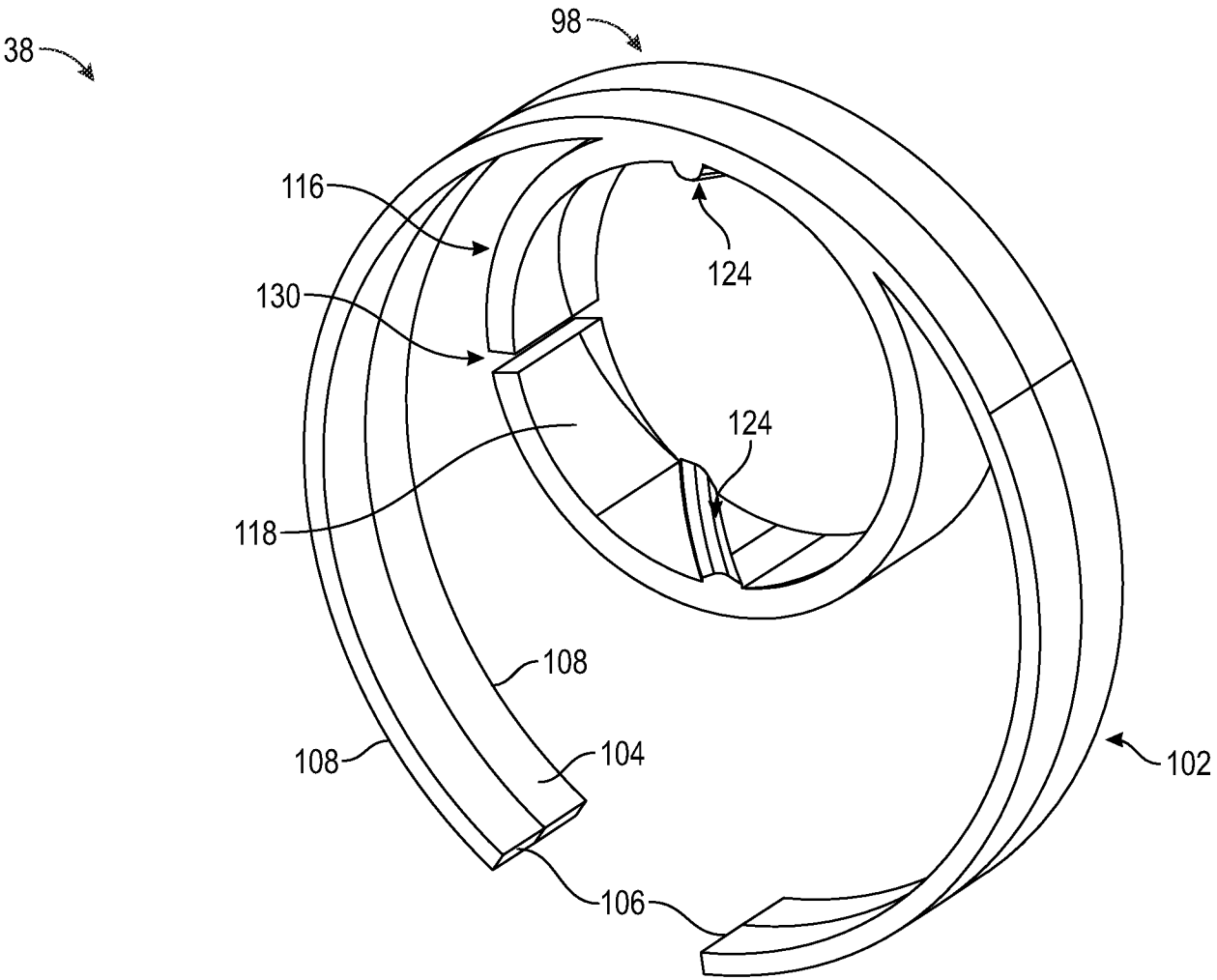
FIG. 22 is a perspective view of the interior member of the partial driver ring shown in FIG. 21.

Alternative Arrangement of Partial Driver Ring:

All of the teaching provided above applies to this alternative arrangement, unless specifically stated otherwise. With reference to FIGS. 21 and 22 an alternative arrangement of a partial driver ring 38 is presented. Drapery rod system 10 includes at least one partial driver ring 38. More specifically, center opening drapery rod systems 10 include a pair of partial driver rings 38 positioned at the center of drive element 26 and inward of full driver ring 40 which is inward of a plurality of idler rings 36. One-way opening drapery rod systems 10 include one partial driver ring 38 positioned at the closing side of the drive element 26 which is inward of full driver ring 40 which is positioned inward of a plurality of idler rings 36.

In the arrangement shown, as one example, partial driver ring 38 is similar to, if not identical to, the configuration of full driver rings 40 previously presented with one difference being stabilizer 116 extends around the exterior diameter of the drive element 26 and includes a slot 130 that interrupts the continuous circular shape of stabilizer 116. This slot 130 allows stabilizer 116, which extends around the entire exterior diameter of drive element 26 save for slot 130, to flex thereby allowing teeth 124 to jump out of or escape the groove of guide structure 50 in the exterior surface 46 of drive element 26 in when extreme forces are encountered such as when an obstacle is engaged. This ability to escape guide structure 50 when extreme or unexpected forces are encountered may help prevent breakage of the partial driver ring 38. This occurs in a center opening drapery rod system 10 when opposing inner-most positioned partial driver rings 38 engage one another, or engage a center bracket 132 when present, at a fully closed position. This also occurs in a side opening drapery rod system 10 when the outward-most positioned partial driver ring 38 engages the opposite bracket 28 at a fully closed position.

This ability for the diameter of stabilizer 116 to flex and expand when an obstacle is engaged by the partial driver ring 38 allows the partial driver ring 38 to stop moving laterally along the drive element 26 while the drive element 26 is rotating. This allows the partial driver ring 38 to be crushed by the full driver ring 40, thereby reducing light gaps. This arrangement also allows force to be applied to the lower positioned tooth 124 while also allowing the lower positioned tooth 124 to escape guide structure 50. This arrangement may allow for a higher predictability of control and higher repeatability of operation. It is to be noted that while the force of insertion of the upper-positioned tooth 124 is largely dependent upon the weight of the shade material 12, the force of insertion of the lower-positioned tooth 124 can be controlled by controlling the dimensions and spring-bias of the stabilizer 116.

In the arrangement shown, as one example, like partial driver rings 38, a tooth 124 is positioned at the top-dead-center of the interior surface 118 of stabilizer 116. This upper tooth 124 of partial driver ring 38 is formed of any suitable size, shape and design and is formed to engage guide structure 50 of drive element 26 so as to facilitate linear movement along the length of drive element 26 as shade material 12 pulls downward on partial driver ring 38.

In the arrangement shown, as one example, a second tooth 124 is positioned on the interior surface 118 at the bottom-dead-center of stabilizer 116. In this arrangement, the first tooth 124 and the second tooth 124 are arranged on approximate opposite sides of stabilizer 116 from one another so as to match the spacing and placement of the features of guide structure 50. While two teeth 124 are shown in use, any number of teeth 124 are hereby contemplated for use and are configured to correspond in size, shape and placement to the features of guide structure 50. As another example, even if two grooves are present in guide structure 50, in one arrangement only a single tooth 124 is present, which in the arrangement shown, may leave the upper or the lower side of interior surface 118 of stabilizer 116 smooth and tooth-free. This arrangement provides the ability of the smooth portion of stabilizer 116 to slide over the drive element 26 while providing a spring force that helps to hold the opposing tooth 124 into guide structure 50 while also providing a predictable amount of force for required for the tooth 124 to escape the guide structure 124. This eliminates the complete reliance on the weight of the shade material 12 to provide the force holding tooth 124 into guide structure 50.

As one example, when drive element 26 includes only a single groove as guide structure 50, stabilizer 116 of partial driver ring 38 includes only a single tooth 124 positioned at the top-center (or any other position) of stabilizer 116. As another example, as is shown, when drive element 26 includes a pair of grooves (that rotate in each direction, clockwise and counterclockwise) as guide structure 50, stabilizer 116 of partial driver ring 38 includes a pair of opposed teeth 124, which in the example shown, are positioned at the top-center and bottom-dead-center of stabilizer 116, however any other position is hereby contemplated for use. As another example, when drive element 26 includes three equally spaced grooves as guide structure 50, stabilizer 116 of partial driver ring 38 includes a three equally spaced teeth 124, which in one example includes a tooth 124 positioned the top-center stabilizer 116, and a pair of teeth positioned approximately one hundred and twenty degrees along the interior surface 118 of stabilizer 116. Any other arrangement is hereby contemplated for use.

In one arrangement, the teeth 124 of partial driver ring 38 are shaped similarly to the other teeth 124 described herein, and any disclosure related to the teeth 124 herein is repeated for the teeth 124 of this embodiment of partial driver ring 38.

It should be noted that in an alternative arrangement, the arrangement shown in FIG. 21 and FIG. 22 as partial driver ring 38 may be used as the full driver ring 40 with the previously disclosed arrangements of partial driver ring 38 being used as partial driver ring 38. That is, one example, the inward most ring 35 may be that shown in FIGS. 10-13 and the second-inward most ring may be that shown in FIGS. 21 and 22.

In the arrangement shown in FIGS. 21 and 22, the continuous circular shape of stabilizer 116 is interrupted by slot 130. Slot 130 is formed of any suitable size, shape and design. In the arrangement shown, as one example, slot 130 is positioned between the one-o'clock position and the five-o'clock position when viewing partial driver ring 38 from one side, or between the seven-o'clock position and the eleven-o'clock position if you view partial driver ring 38 from the opposite side. However any other position on stabilizer 116 is hereby contemplated for slot 130 including the one-o'clock position, two-o'clock position, three-o'clock position, four-o'clock position, five-o'clock position, six-o'clock position, seven-o'clock position, eight-o'clock position, nine-o'clock position, ten-o'clock position, eleven-o'clock position, twelve-o'clock position, or any position there between.

In the arrangement shown, as one example, the interior diameter of the interior surface 118 of stabilizer 116 of partial driver ring 38 is sized and shaped to fit around the exterior surface of drive element 26 with close and tight tolerances, while still allowing for smooth, easy and low friction sliding of partial driver ring 38 along the length of drive element 26. As opposing teeth 124 extend inward from interior surface 118 of stabilizer 116 the inner diameter of the inward end of teeth 124 are less than the exterior diameter of drive element 26. Said another way, the teeth 124 extend inward from the interior surface 118 of stabilizer 116 a greater distance than the dimensional tolerances between the interior diameter of stabilizer 116 and the exterior surface 46 of drive element 26. As such, when partial driver ring 38 is positioned around drive element 26, teeth 124 are engaged within guide structure 50. As the stabilizer 116 of partial driver ring 38 fully extends around the exterior diameter of drive element 26 with close and tight tolerances, teeth 124 are prevented from skipping out of or coming disengaged from guide structure 50 as drive element 26 is rotated (unless and until stabilizer 116 flexes which is allowed by the presence of slot 130). As such, when drive element 26 is rotated, partial driver ring 38 moves laterally along the length of drive element 26. This continues until an obstruction is engaged by partial driver ring 38 at which point the stabilizer 116 flexes and expands thereby allowing teeth 124 to jump out of or skip out of engagement with guide structure 50 so as to allow free rotation of drive element 26 while partial driver ring 38 remains stationary and/or disengaged.

During operation of drapery rod system 10, as drive element 26 is rotated, teeth 124 of partial driver ring 38 are engaged with the grooves of guide structure 50 of drive element 26. Due to the weight of shade material 12 pulling down on partial driver ring 38, this maintains the vertical orientation of partial driver ring 38 and prevents partial driver ring 38 from rotating as drive element 26 rotates. As the drive element 26 is rotated, the engagement between teeth 124 and guide structure 50, coupled with the downward force on partial driver ring 38, and the inward pressing force of stabilizer 116, causes partial driver ring 38 to laterally move along the length of drive element 26. Due to the direct engagement of partial driver ring 38 with drive element 26, the operational limits (the fully opened and fully closed positions) are programmed and controlled by motor control assembly 32. Motor control assembly 32 powers motor 76 to rotate drive element 26 until partial driver ring 38 and full driver ring 40 reach their desired position along drive element 26 at which point power to the motor 76 is terminated.

As drive element 26 is rotated, full driver ring 40 causes movement of the idler rings 36. As drive element 26 is rotated, partial driver ring 38, like full driver ring 40, moves along the length of drive element 26 through the engagement of teeth 124 with guide structure 50. This continues until the partial driver ring 38 engages an obstacle, at which point teeth 124 come out of the guide structure 50 due to flexing or expansion of the stabilizer 116 facilitated by slot 130. This allows the full driver ring 40 to crush the partial driver ring 38 in a closing operation at the fully closed position thereby reducing light gaps.

Figure 23:
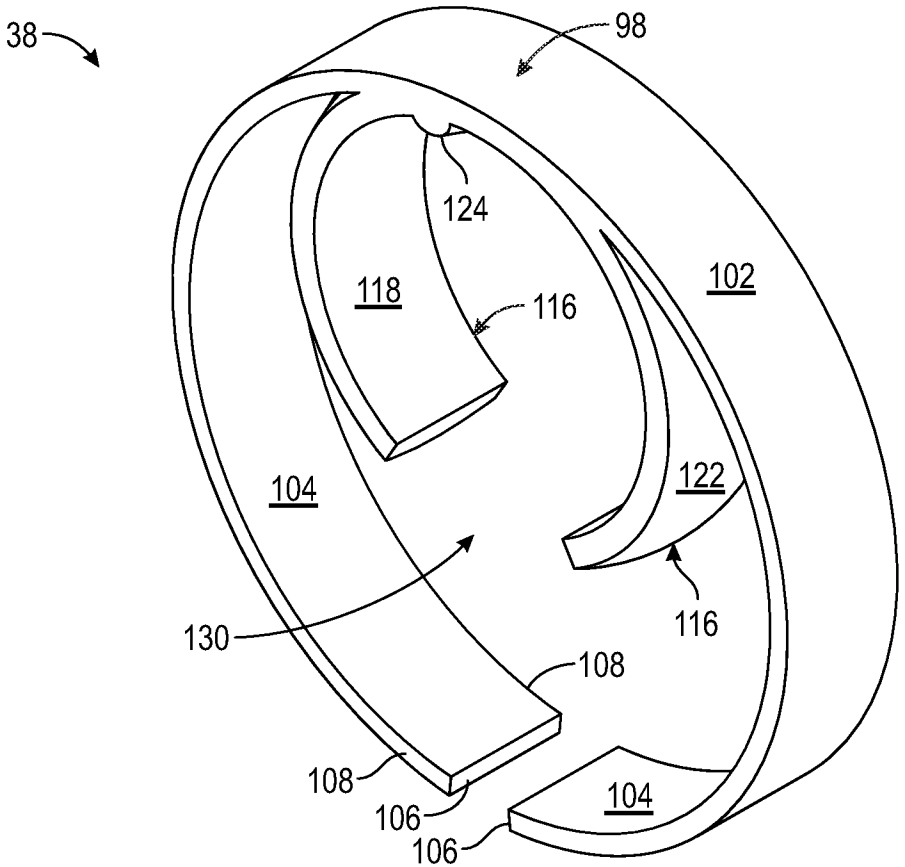
FIG. 23 is a perspective view of an interior member of another configuration of a partial driver ring; the view showing the interior member terminating at ends at the lower end of the interior member; the view showing the stabilizer more than half of the way around the drive element and having a slot therein to allow the stabilizer to flex to allow the teeth out of the guide structure; the view showing the stabilizer having a thicker configuration with a curved exterior surface to provide increased rigidity.
Figure 24:
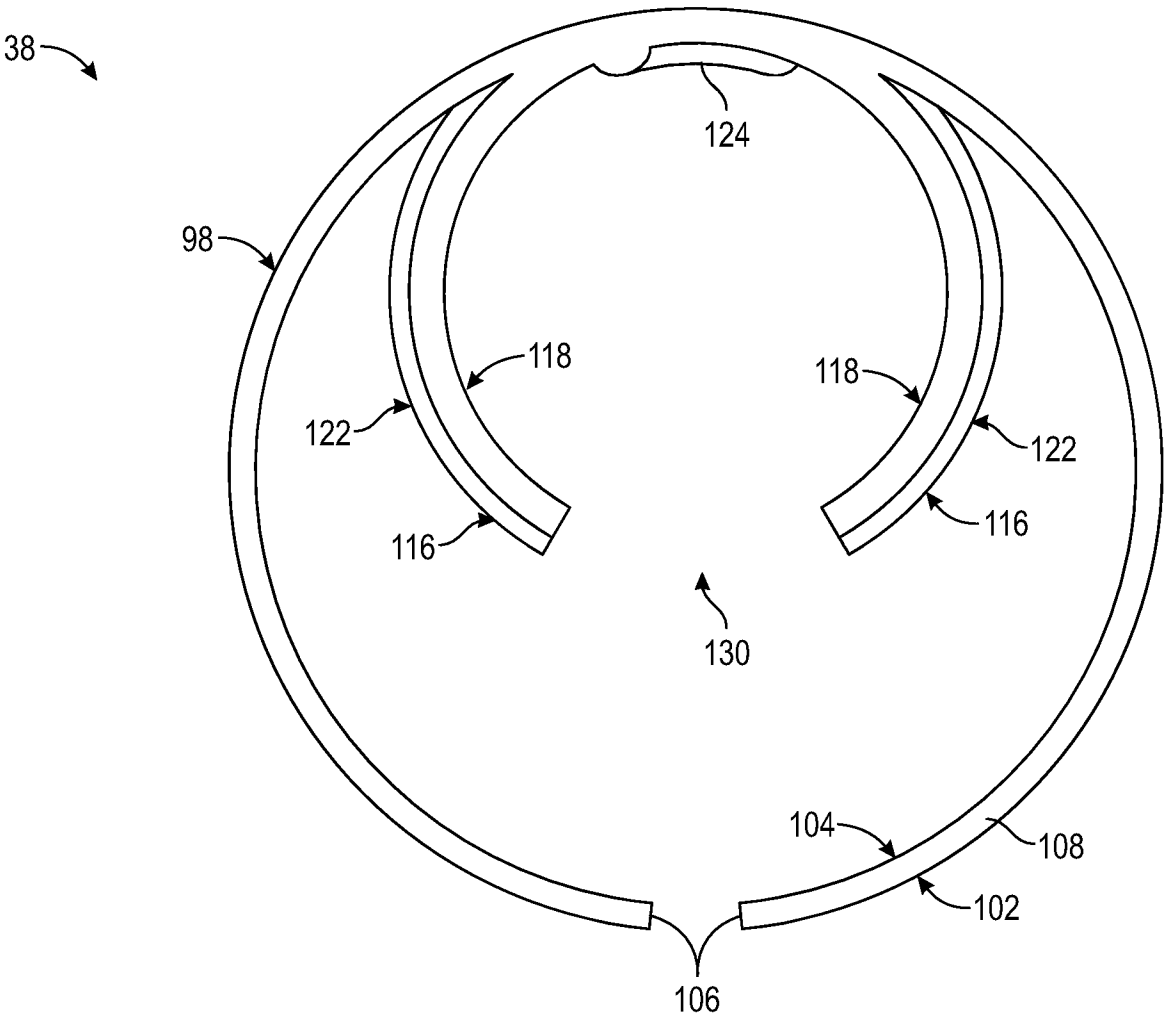
FIG. 24 is a side elevation view of the interior member of the partial driver ring shown in FIG. 23.

Alternative Embodiment of Idler Ring—Rigid Arrangement:

All of the teaching provided above applies to this alternative arrangement, unless specifically stated otherwise. With reference to FIGS. 23 and 24 an alternative arrangement of a partial driver ring 38 is presented. Drapery rod system 10 includes at least one partial driver ring 38. More specifically, center opening drapery rod systems 10 include a pair of partial driver rings 38 positioned at the center of drive element 26 and inward of full driver ring 40 and a plurality of idler rings 36. One-way opening drapery rod systems 10 include one partial driver ring 38 positioned at the closing side of the drive element 26 and inward of full driver ring 40 and a plurality of idler rings 36.

In the arrangement shown, as one example, as compared to other rings 35, shown herein, the thickness of stabilizer 116 is increased. This increase in thickness is intended to stiffen stabilizer 116 and prevent the dimensions of stabilizer 116 from changing when forces are applied to partial driver ring 38, such as when motor 76 starts or stops, when shade material 12 is pulled on, or when other forces are applied to the system 10. Stiffening stabilizer 116 in some arrangements has the effect of helping to maintain the orientation of partial driver ring 38 on drive element 26 when forces are applied. Stiffening stabilizer 116 in some arrangements makes partial driver ring 38 less sensitive to variations in weight of the attached shade material 12. Stiffening stabilizer 116 in some arrangements makes partial driver ring 38 less sensitive to forces applied to the interior member 98 by hoop member 96. Stiffening stabilizer 116 in some arrangements makes partial driver ring 38 less sensitive to variations in the drive element 26 and/or guide structure 50.

In one arrangement, the interior surface 118 and the exterior surface 122 of stabilizer 116 extend in approximate parallel spaced relation to one another. This forms a generally cylindrical interior surface 118 and a generally cylindrical exterior surface 122. In another arrangement, as is shown in FIGS. 23 and 24, the exterior surface 122 of stabilizer 116 curves outward at or near its middle such that the center of stabilizer 116 is thicker than the outward edges of stabilizer 116. This arrangement provides increased strength to stabilizer 116. In another arrangement, the interior surface 118 of stabilizer 116 curves outward at or near its middle such that the center of stabilizer 116 is thicker than the outward edges of stabilizer 116. In another arrangement, the interior surface 118 and exterior surface 122 of stabilizer 116 curve outward at or near their middle such that the center of stabilizer 116 is thicker than the outward edges of stabilizer 116. This arrangement provides increased strength to stabilizer 116. In either arrangement, the added thickness of stabilizer 116 facilitates a stiffer stabilizer 116 that resists deformation by outside forces and thereby facilitates more-consistent operation when varying outside forces are applied.

This stiffness may also be accomplished by using stiffer-material, adding structural elements (such as an embedded metallic bar inside or to the exterior of stabilizer 116, or the like), or by stiffening stabilizer 116 by any other manner, method or means.

In the arrangement shown, as one example, to accommodate the increased stuffiness and rigidity of stabilizer 116, the opening or slot 130 at the bottom of stabilizer 116 is increased. This allows the insertion of interior member 98 over the exterior surface 46 of drive element 26.

Figure 25:
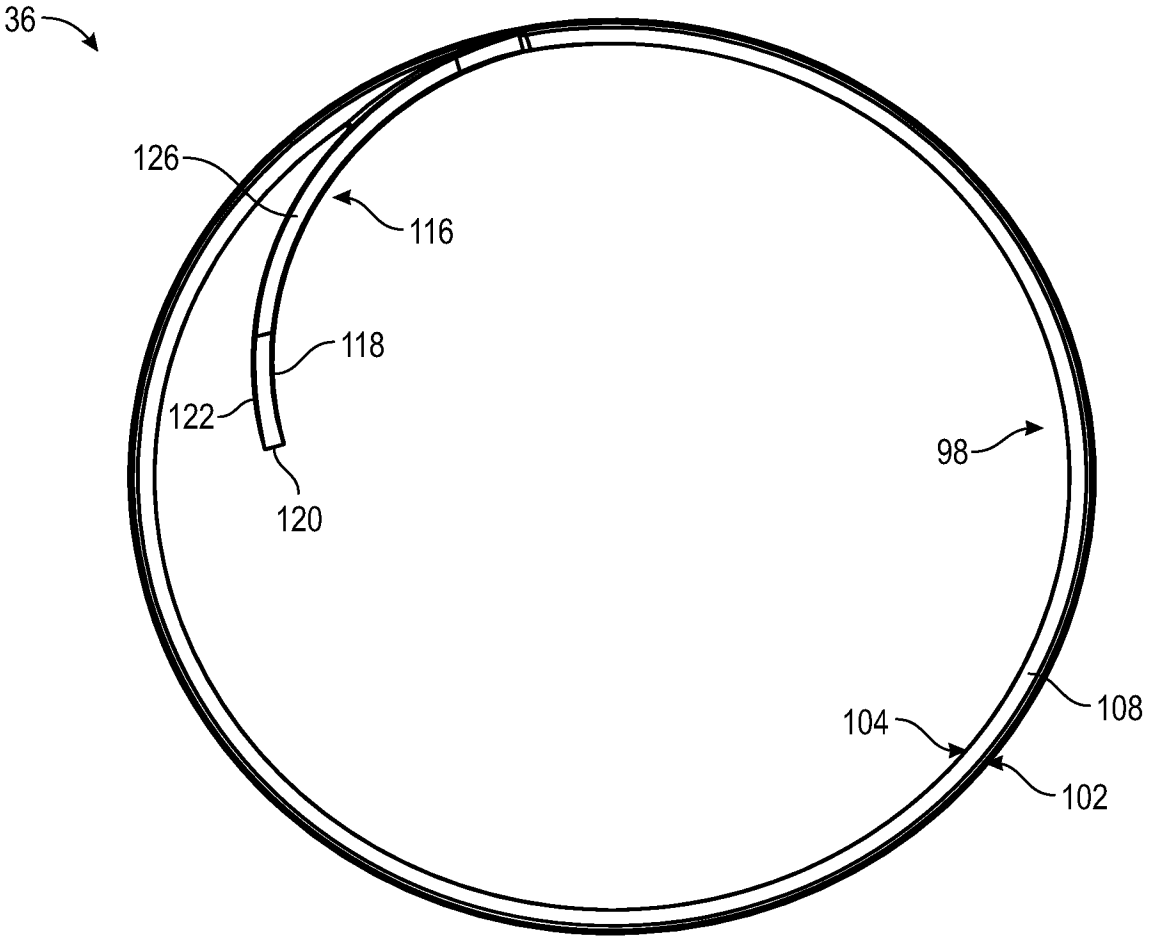
FIG. 25 is a side elevation view of another configuration of an interior member of an idler ring; the view showing the stabilizer extending from the top-center of the interior member and extending downward therefrom on only one side of the drive element; the rear side of the drive element; the view showing the interior member forming a complete circle; the view showing the stabilizer ending in a free end on the rearward side of the drive element rearward of the drive element in the hollow interior of the interior member; the view showing the interior surface of the interior member having a diameter that is larger than the diameter of the stabilizer.
Figure 26:
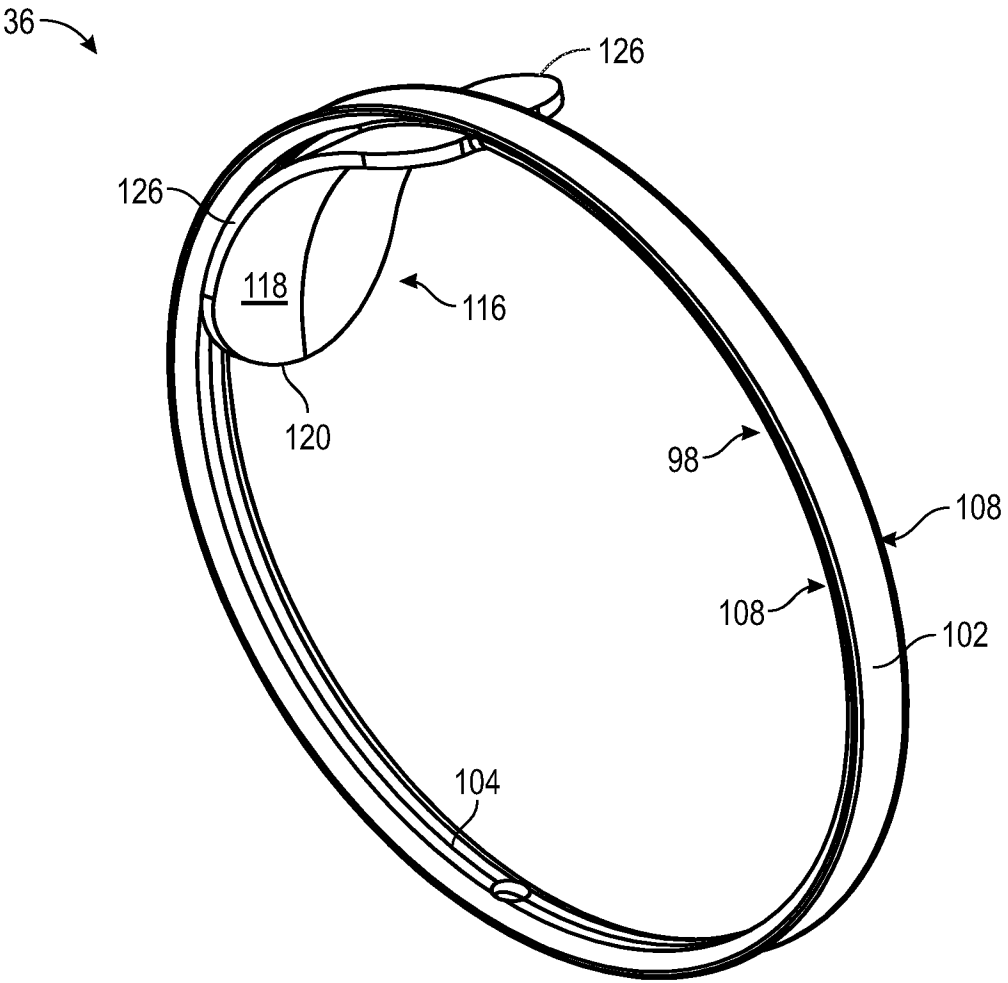
FIG. 26 is a perspective view of the interior member of an idler ring shown in FIG. 25; the view showing the stabilizer extending outward past the sides of interior member a distance; the view showing the upper end and lower ends of the stabilizer having rounded or curved ends so as to reduce engagement with the guide structure of the drive element.
Figure 27:
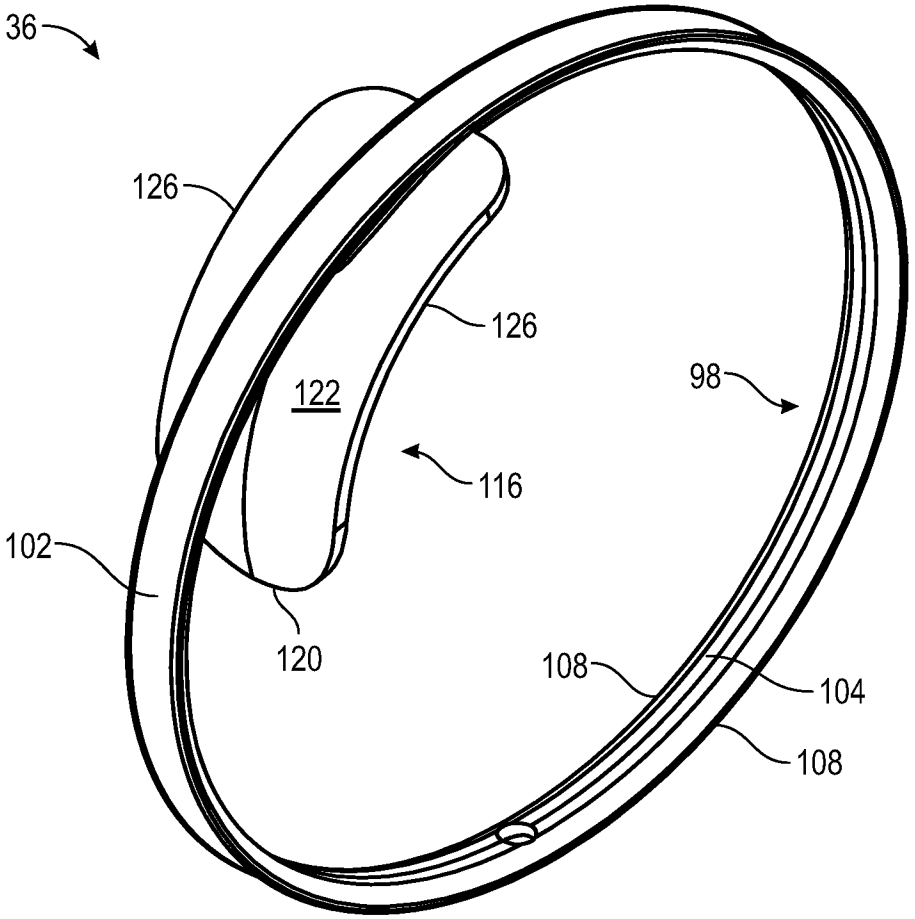
FIG. 27 is another perspective view of the interior member of an idler ring shown in FIG. 25.

Alternative Embodiment of Idler Ring:

All of the teaching provided above applies to this alternative arrangement, unless specifically stated otherwise. With reference to FIGS. 25-27, an alternative arrangement of an idler ring 36 is presented. In this arrangement, idler ring 36 is what is called a "winged" idler ring 36. That is, in the arrangement shown, as one example, idler ring 36 includes a winged stabilizer 116 that extends outward at its sides thereby increasing the surface area of engagement between stabilizer 116 and drive element 26 which provides increased stability during operation.

In the arrangement shown, as one example, stabilizer 116 has an interior surface 118 that smoothly connects to the interior surface 104 of interior member 98. In this arrangement, the interior surface 118 of stabilizer 116 connects to the interior surface 104 of interior member 98 at the noon/midnight/twelve-o'clock/top-dead-center position. From this connection point at the top-dead-center, the interior surface 118 of stabilizer 116 increases the angle of curvature. That is, the curvature of the interior surface 118 of stabilizer 116 conforms to the size and shape of the exterior surface 46 of drive element 26, whereas, the interior surface 104 of interior member 98 has a larger diameter than that of the exterior surface 46 of drive element 26. That is, beginning at this point, the top-dead-center or top center point of the interior surface 104 of interior member 98, the interior surface 118 of stabilizer 116 begins and extends downward with a diameter of curvature that is smaller than the diameter of curvature of the interior surface 104 of interior member 98.

The curved interior surface 118 of stabilizer 116 continues from the top-dead-center of the interior surface 104 of interior member 98 until terminating at the free end 120 of stabilizer 116, which is positioned a distance below and rearward of the top-dead-center of interior member 108 within the hollow interior of interior member 98. In this way, when viewed from the side, stabilizer 116 smoothly and almost-seamlessly curves out of the interior surface 104 of interior member 98 and into the hollow interior of interior member 98. Prior to the top-dead-center, the interior surface 104 of interior member 98 has a curvature that is substantially greater than the curvature of the exterior surface 46 of drive element 26, whereas after the top-dead-center the interior surface 118 of stabilizer 116 has a curvature that approximates the exterior surface 46 of drive element 26. Due to the natural force of gravity pulling directly down upon idler ring 36, this causes the interior surface 118 of stabilizer 116 to lightly engage and cup the exterior surface 46 of drive element 26 during operation. This light engagement between the interior surface 118 of stabilizer 116 with the exterior surface 46 of drive element 26 has a stabilizing effect that helps to smooth the movement of idler ring 36 as it moves laterally across the length of drive element 26.

In the arrangement shown, as one example, stabilizer 116 extends outward from the opposing edges 108 of interior member 98 a distance. That is, the distance between opposing edges 126 of stabilizer 116 is greater than the distance between the edges 108 of interior member 98. In the arrangement shown, as one example, the distance between opposing edges 126 of stabilizer 116 is centered upon the opposing edges 108 of interior member 98 so as to provide balance and symmetry. Or, said another way, stabilizer 116 extends outward from each side of interior member 98 an equal amount. In one arrangement, the width between opposing edges 126 of stabilizer 116 is one quarter wider, or more, as compared to the width between opposing edges 108 of interior member 98. Any ratio of width between opposing edges 126 of stabilizer 116 greater than the width between opposing edges 108 of interior member 98 is hereby contemplated for use, such as 100%, 101%, 102%, 103%, 104%, 105%, 106%, 107%, 108%, 109%, 110%, 125%, 150%, 175%, 200%, 225%, 250%, 275%, 300%, 325%, 350%, 375%, 400%, 425%, 450%, 475%, 500%, or more or any ratio there between.

Having the edges 126 of stabilizer 116 extend outward a distance from the edges 108 of interior member 98 helps to provide stability to idler ring 36 as drive element 26 rotates. That is, by extending the width of stabilizer 116 between edges 126 this helps to prevent wobbling and tilting of idler ring 36. Also, by extending the width of stabilizer 116 between edges 126 this helps to smooth operation of drapery rod system 10 as the increased width of stabilizer 116 helps to smooth sliding over the exterior surface 46 of drive element 26 and helps to reduce noise as the stabilizer 116 engages the guide structure 50 in the exterior surface 46 of drive element 26. As such, the increased surface area of the interior surface 118 of stabilizer 116 when edges 126 are extended provide many benefits.

Another benefit of extending the width of stabilizer 116 between edges 126 is that this extends the width of ends 120 and thereby allows for rounded ends 120 to have an angle oc curvature that is larger as compared to a narrower stabilizer 116. That is, in the arrangement shown, as one example, the ends 120 of stabilizer 116 are, when viewed from the front or back, curved or rounded in nature. This curved or rounded shape of ends 120 helps to deflect any engagement between stabilizer 116 and guide structure 50 so as to facilitate smooth and consistent operation. This curved arrangement also eases the placement of stabilizer 116 over drive element 26 during installation. The wider the stabilizer 116 the wider the angle of curvature of ends 120 which smooths operation and prevents or reduces the potential for an end 120 to engage guides structure 50 in a way that makes noise or vibration. Or, said another way, when stabilizer 116 is wide this allows for a broad or wide curvature of ends 120 which has a lower potential for making noise or vibration when guide structure 50 moves past ends 120 of stabilizer 116.

However, one problem associated with extending with width of stabilizer 116 between edges 126 is that this causes the stabilizer 116 to extend outward from hoop member 96 which makes the stabilizer 116 visible which causes an undesirable aesthetic appearance.

In the arrangement shown, as one example, to improve the aesthetics of the winged stabilizer 116, when idler ring 36 is placed on the exterior surface 46 of drive element 26, stabilizer 116 is positioned on the rearward side of drive element 26, or between the drive element 26 and the window or structure that drapery rod system 10 is connected to. In this position, the interior surface 118 of stabilizer 116 covers the exterior surface 46 of drive element 26 between approximately the nine-o'clock position and the noon/midnight/top-dead-center position. In this position, the stabilizer 116, which extends outward from interior member 98 and hoop member 96 is hidden and practically impossible to see as room-side viewers cannot see the stabilizer 116 which is hidden behind the drive element 26.

In this way, the winged stabilizer 116 provides many advantages including increased stability, less wobbling, less tilting, and quieter operation, all while not hurting the aesthetics of the system 10.

While the winged stabilizer 116 is shown for use in association with idler ring 36, the teachings herein can also be applied to partial driver ring 38 and full driver ring 40 or any other ring of the system 10.

One way to ensure engagement of the interior surface 118 of stabilizer 116 contacts the exterior surface 46 of drive element 26 is by moving stabilizer 116 slightly forward of the top-dead-center of interior member 98. This causes the weight of shade material 12 to pull downward upon ring 35 thereby causing stabilizer 116 to engage the exterior surface 46 of drive element 26. As example, it is contemplated that interior surface 118 of stabilizer 116 begins forward of the top-dead-center position of interior member 98 by 1°, 2°, 3°, 4°, 5°, 6°, 7°, 8°, 9°, 10°, or any other amount or any range or point there between.

In one arrangement, the diameter of curvature of interior surface 118 of stabilizer 116 is slightly larger than that of the diameter of curvature of the exterior surface 46 of drive element 26. This helps to prevent ends 120 of stabilizer 116 from engaging the guide structure 50 of drive element 26 in a way that makes noise or vibration.

In an alternative arrangement, the ends 120 of stabilizer 116 are chamfered or angled such that they do not have a sharp edge that engages the exterior surface 46 of drive element 26. This helps to prevent ends 120 of stabilizer 116 from engaging the guide structure 50 of drive element 26 in a way that makes noise or vibration.

In an alternative arrangement, the ends 120 of stabilizer 116 taper away or angle slightly away or feather outward slightly. That is, while the interior surface 118 of stabilizer 116 has an angle or diameter of curvature that closely matches the angle or diameter of curvature of the exterior surface 46 of drive element 26, the upper end 120 and/or lower end 120 of stabilizer 116 break trend with that curvature and transition to a slightly larger diameter of curvature. This helps to prevent ends 120 of stabilizer 116 from engaging the guide structure 50 of drive element 26 in a way that makes noise or vibration. Instead, the approximate center of interior surface 118 of stabilizer 116 engages the exterior surface 46 of drive element 26.

Alternative Embodiment of Idler Ring:

All of the teaching provided above applies to this alternative arrangement, unless specifically stated otherwise. In the arrangement shown, in FIGS. 25-27, interior member 98 is continuous. That is, interior member 98 completes a full circle.

Figure 28:
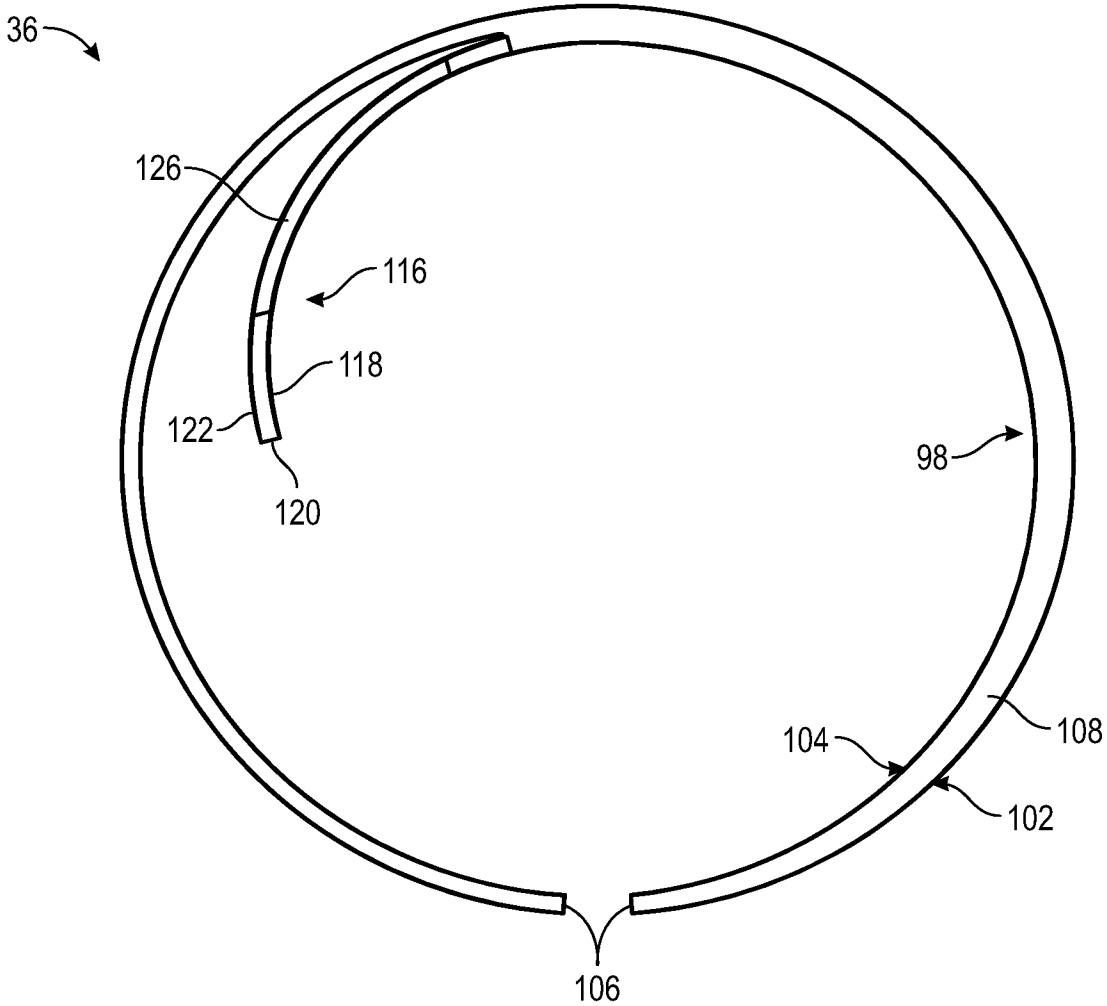
FIG. 28 is a side elevation view of another configuration of an interior member of an idler ring; the view showing the interior surface of the interior member smoothly curving to meet the interior surface of the stabilizer.
Figure 29:
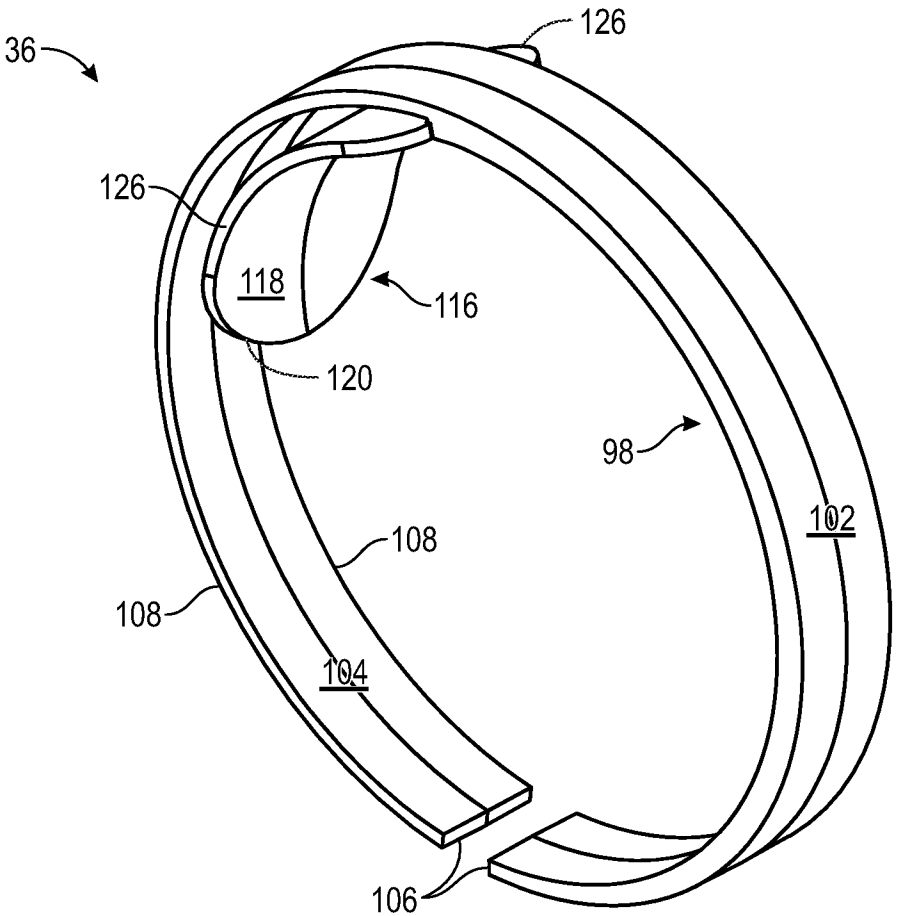
FIG. 29 is a perspective view of the interior member the interior member of an idler ring shown in FIG. 28; the view showing the stabilizer extending outward past the sides of interior member a distance; the view showing the upper end and lower ends of the stabilizer having rounded or curved ends so as to reduce engagement with the guide structure of the drive element.
Figure 30:
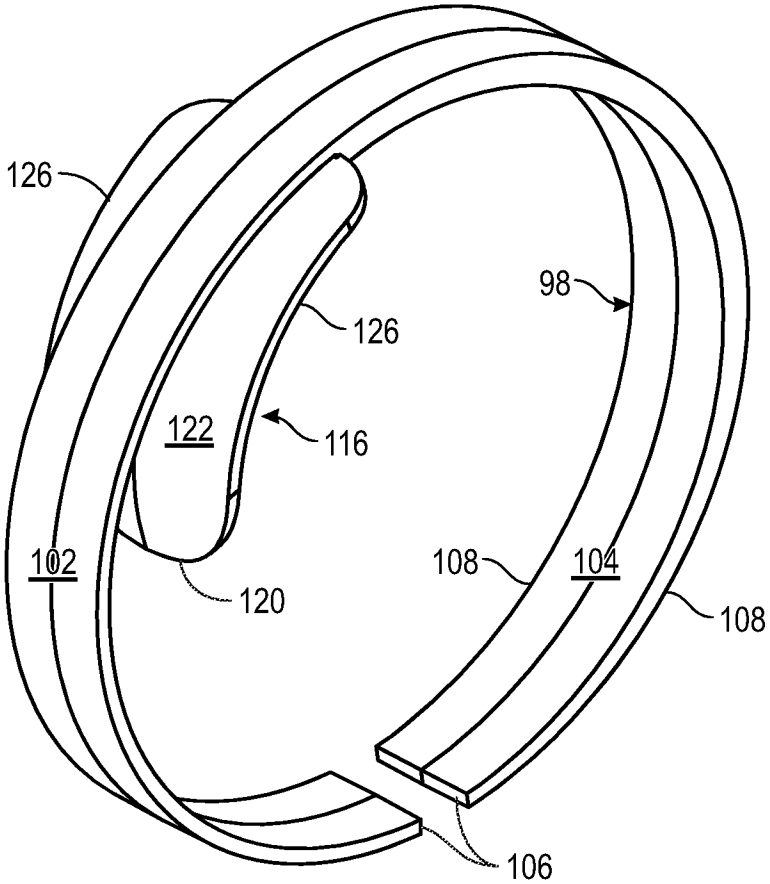
FIG. 30 is another perspective view of the interior member the interior member of an idler ring shown in FIG. 28; the view showing the stabilizer extending outward past the sides of interior member a distance; the view showing the upper end and lower ends of the stabilizer having rounded or curved ends so as to reduce engagement with the guide structure of the drive element.
Figure 31:
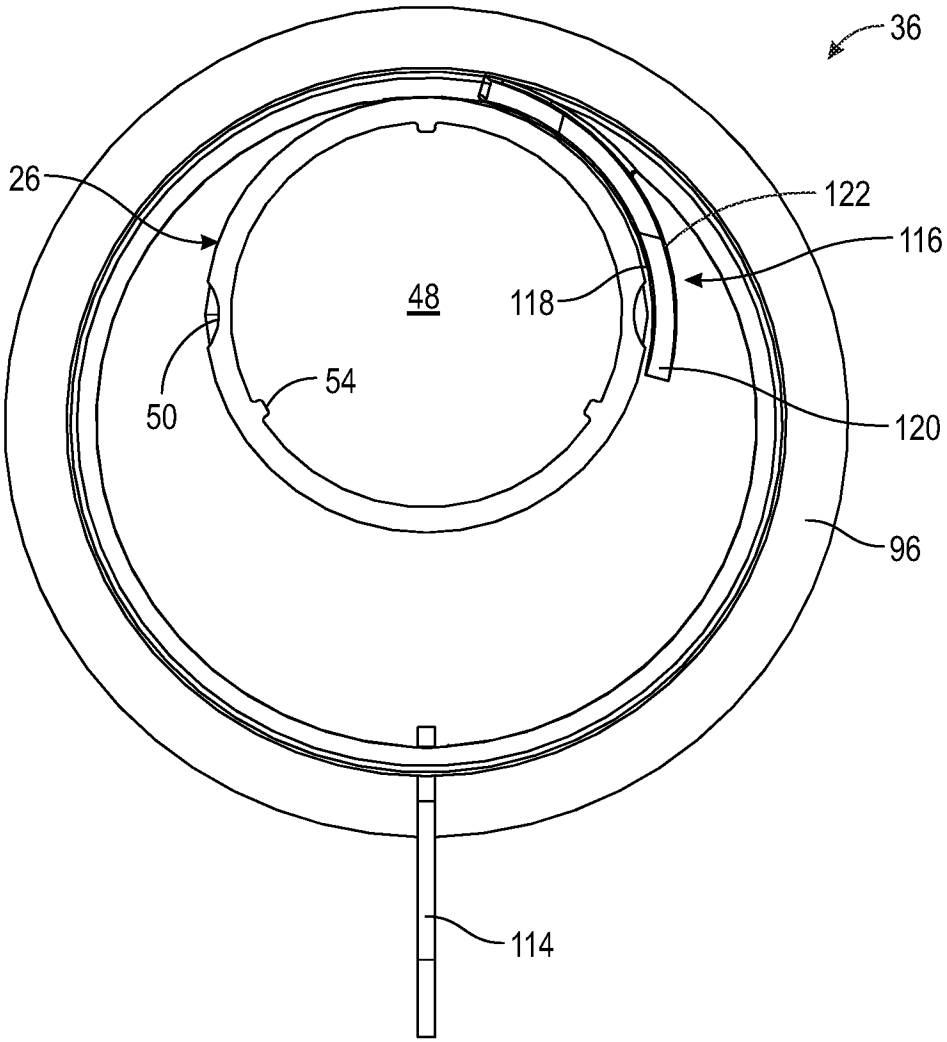
FIG. 31 is a side elevation view of an idler ring with an interior member such as that shown in FIG. 25, the view showing the interior member positioned within a hoop member; the view showing the interior surface of the stabilizer engaged with the exterior surface of a drive element in matching flush engagement.
Figure 32:
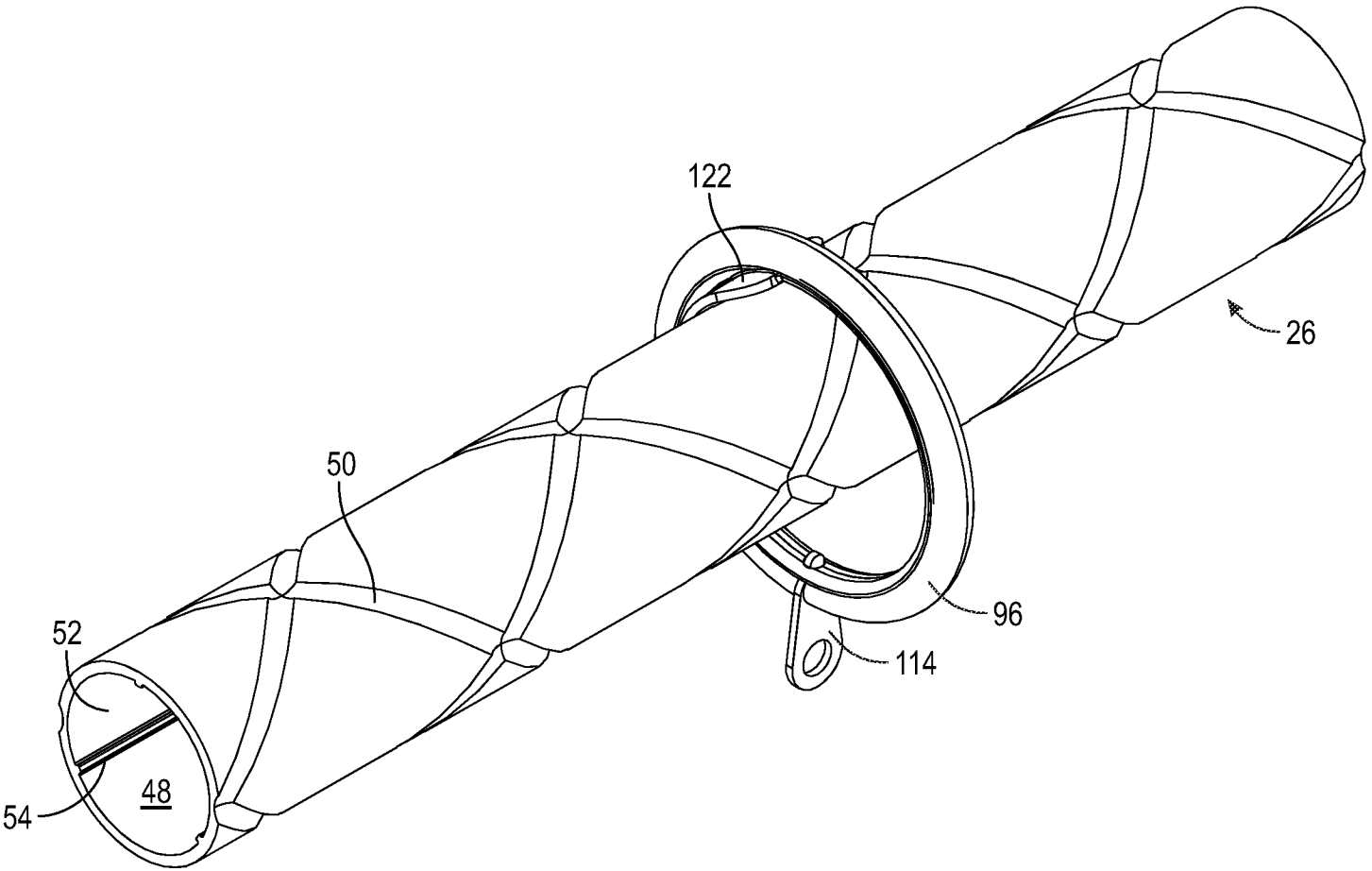
FIG. 32 is a perspective view of an idler ring with an interior member such as that shown in FIG. 25, the view showing the interior member positioned within a hoop member; the view showing the interior surface of the stabilizer engaged with the exterior surface of a drive element in matching flush engagement.
Figure 33:
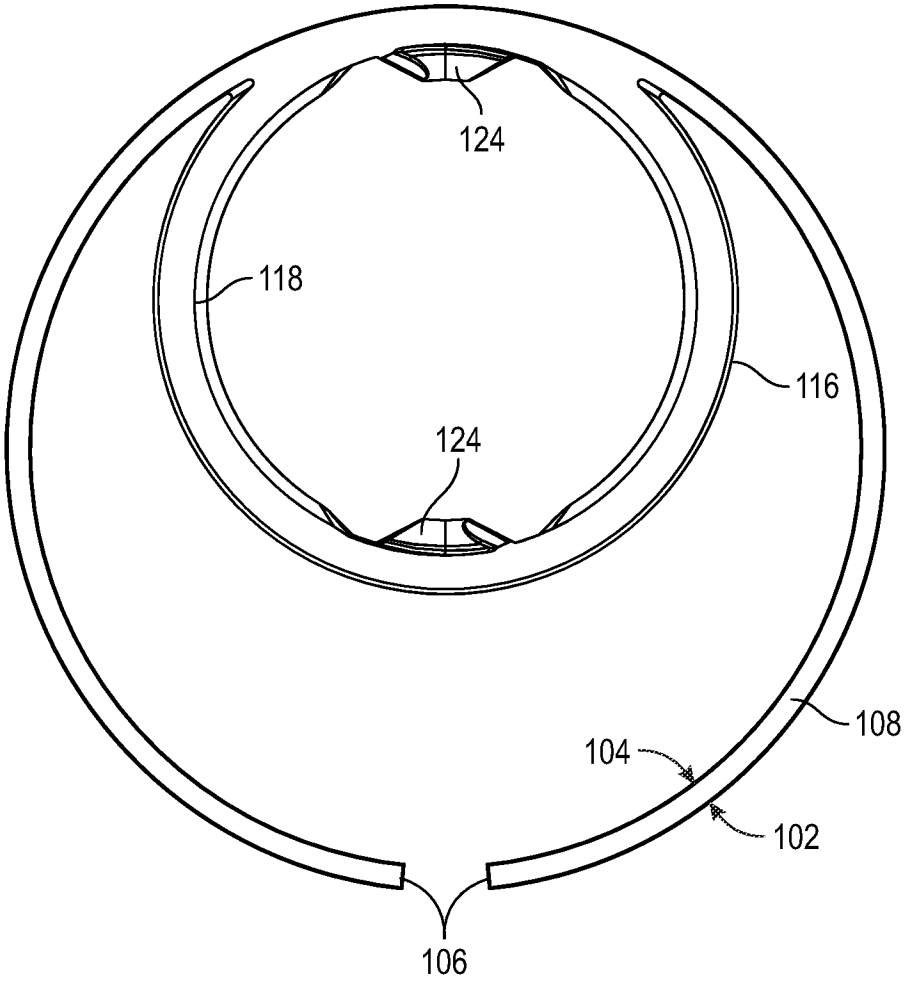
FIG. 33 is a side elevation view of an interior member of a full driver ring, the view showing the interior surface of the stabilizer having a tooth at the top center and bottom center of the stabilizer; the view showing the stabilizer having a rounded interior surface; the view showing a cut away area around the tooth on the interior surface of the stabilizer.
Figure 34A:
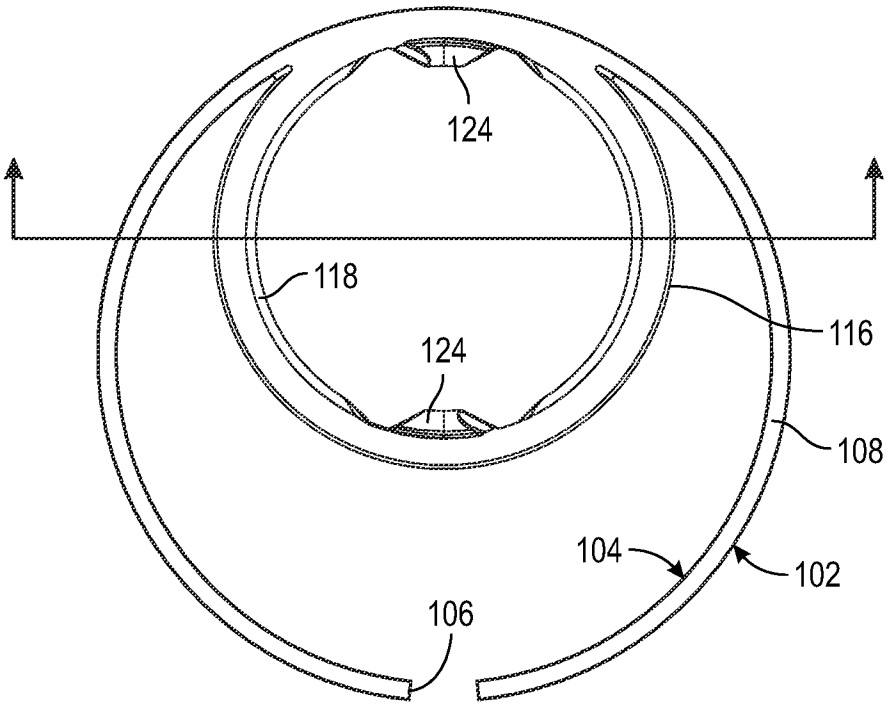
FIG. 34A is a side elevation view of the interior member shown in FIG. 33 with a section line there through FIG. 34B is a side elevation section view along the section line of FIG. 34A; the view showing the tooth of the interior surface of the stabilizer within a cutaway area; the view showing the curved interior surface of the interior member.
Figure 34B:
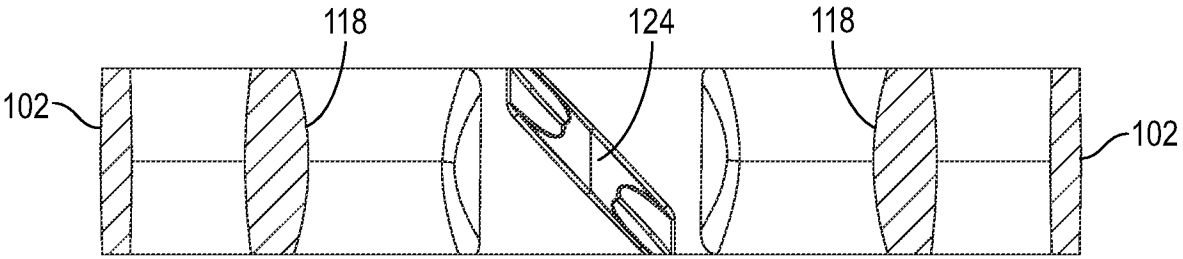
Figure 35:
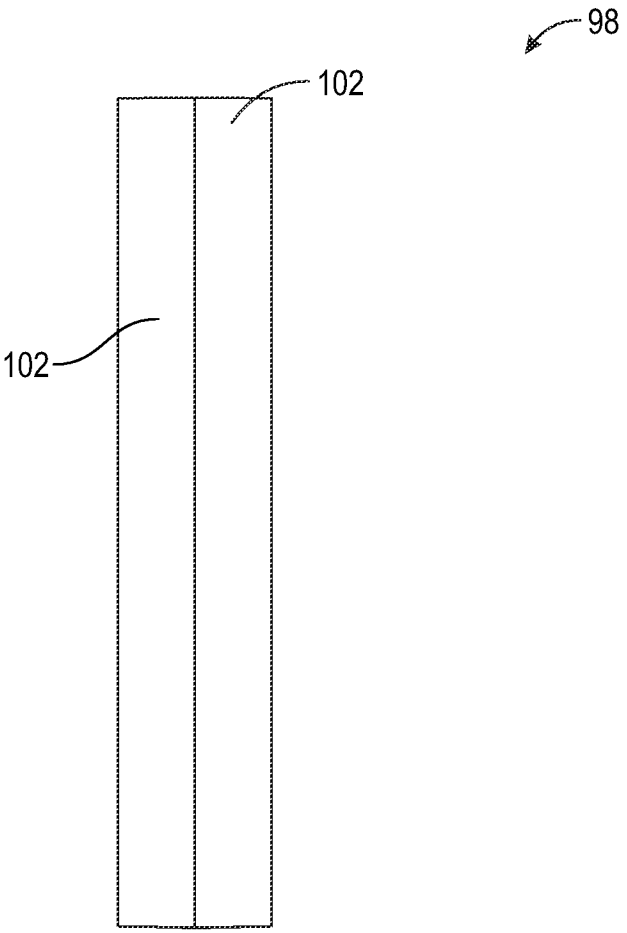
FIG. 35 is a front elevation view of the interior member shown in FIG. 33, the view showing the interior member having straight edges.
Figure 36:
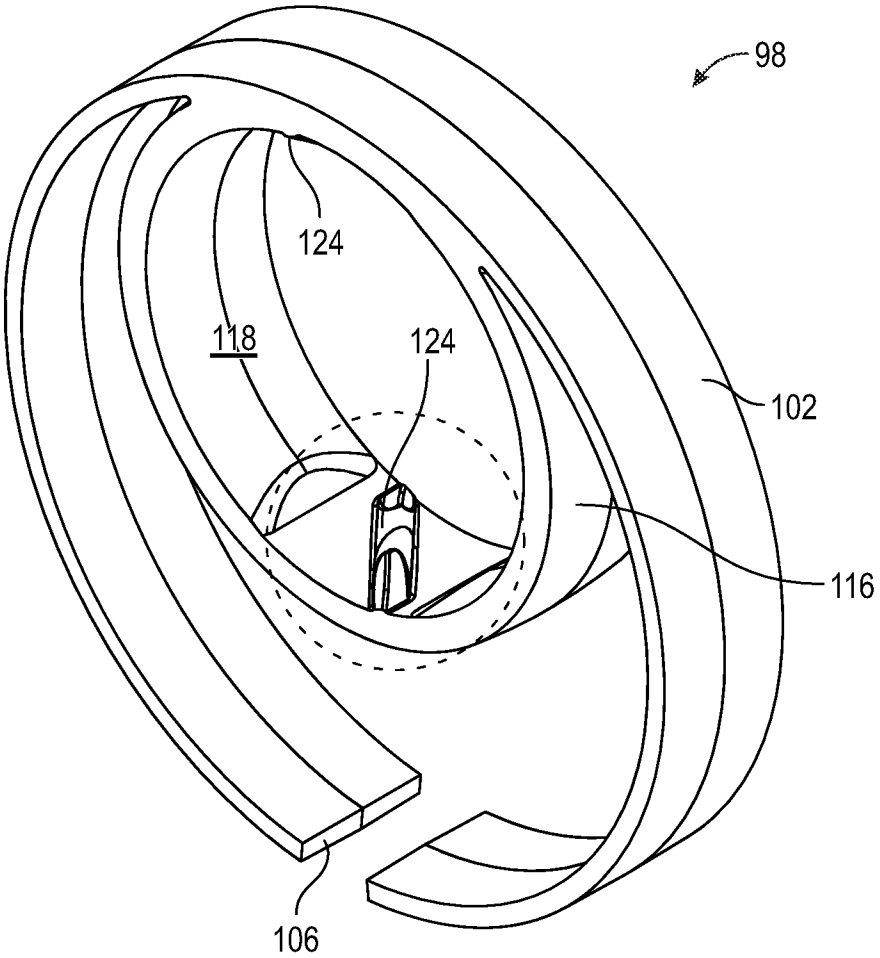
FIG. 36 is a perspective view of the interior member shown in FIG. 33.
Figure 37:
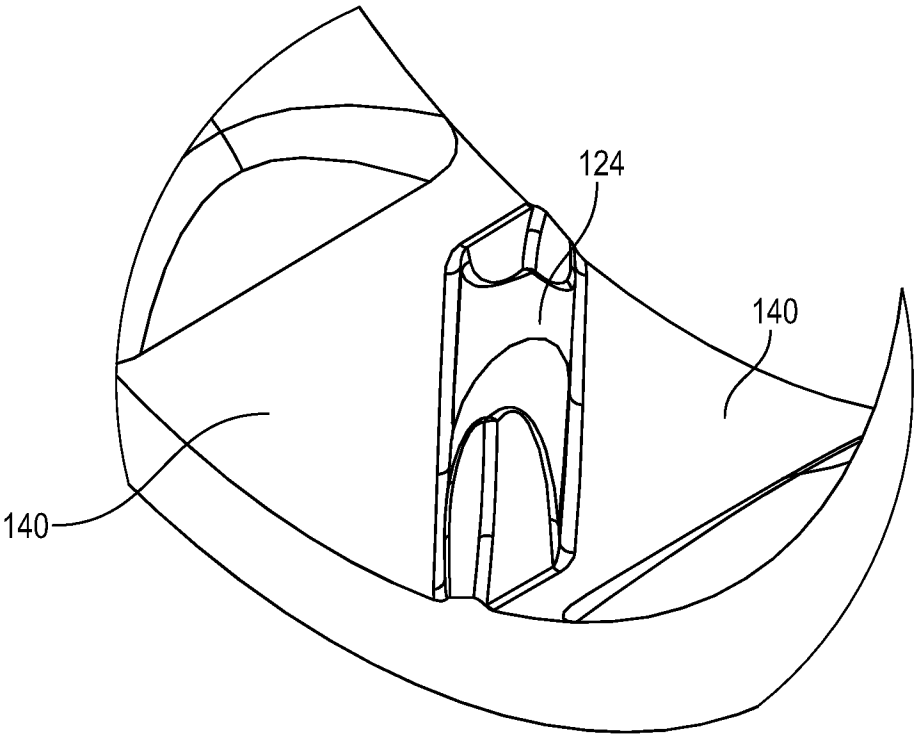
FIG. 37 is a close up perspective of the area of the interior surface of the stabilizer around the tooth and cutaway area shown in FIG. 36.
Figure 38:
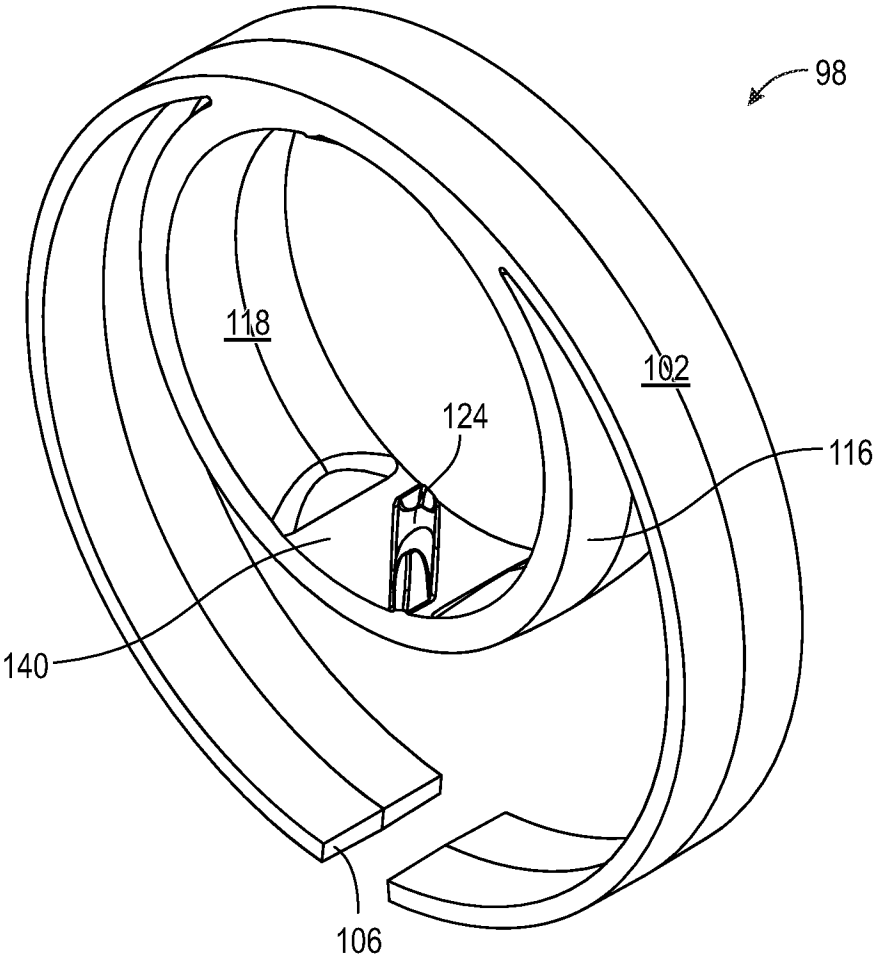
FIG. 38 is another perspective view of the interior member shown in FIG. 33.

With reference to FIGS. 28-30, an alternative arrangement of a winged stabilizer 116 is presented wherein the lower end of interior member 98 does not complete a full circle and instead terminates in ends 106 with a space between them. This gap allows for insertion of interior member 98 into hoop member 96. To accommodate the weakness in interior member 98 caused by the gap between ends 106 in one arrangement, the strength of interior member 98 is increased by increasing the thickness of, strength, rigidity and/or stiffness of interior member 98 by increased material, using a stiffener, using a stiffer material (such as a metal attachment or insertion), or by any combination thereof or by any other manner, method or means.

As is also shown, in FIGS. 28-32, the interior surface 104 of interior member 98 smoothly curves to meet the interior surface 118 of stabilizer 116. That is, said another way, the interior diameter of interior surface 104 continually narrows as it leads from the bottom of interior member 98 (at reference numeral 106 on the right side of FIG. 28) to the top-dead-center of interior member 98, where the interior surface 104 of interior member 98 connects to the interior surface 118 of stabilizer 116. In this way, this arrangement provides a smooth fitting stabilizer 116 that fits over the exterior surface 46 of drive element 26. Due to the natural force of gravity pulling directly down upon idler ring 36, this causes the interior surface 118 of stabilizer 116 to lightly engage and cup the exterior surface 46 of drive element 26 during operation. This light engagement between the interior surface 118 of stabilizer 116 with the exterior surface 46 of drive element 26 has a stabilizing effect that helps to smooth the movement of idler ring 36 as it moves laterally across the length of drive element 26.

Alternative Interior Surface:

All of the teaching provided above applies to this alternative arrangement, unless specifically stated otherwise. In the arrangement shown, in FIGS. 33-40, the interior surface 118 of stabilizer 116 is a curved surface. That is, the interior surface 118 of stabilizer 116 is not a flat surface from one opposing end 108 to the other opposing end 108.

With reference to FIGS. 33-40, an alternative arrangement of the interior surface 118 of stabilizer 116 is presented wherein the interior surface 118 of the stabilizer 116 is a curved surface, and/or has a curved cross-sectional shape that curves outward in a convex manner with the apex of curvature at the approximate center of the ring 35. This arrangement allows the rings 35 to tilt slightly, to an angle of incidence 134, such that the interior surface 118 of the stabilizer 116 is still engaged in consistent contact with the exterior surface 46 of the drive element 26 when the ring 35 tilts. In addition, due to the material properties of the non-metallic material that forms interior member 98 and/or stabilizer 116, as idler ring 36 moves over drive element 26, the curvature which forms the interior member 98 and/or stabilizer 116 absorbs vibrations, reduces noise, and provides smooth, low friction sliding.

In other words, the curved surface between the opposing edges 108 of the interior surface 118 of the stabilizer 116 creates an engagement which prevents a hard engagement, or sharp engagement, or ninety degree engagement, or edge from catching along the exterior surface 46 of the drive element 26, or a feature of the guide structure 50. Said in yet another way, the radial curvature of the interior surface 118 of the stabilizer 116 allows for a smoother and more constant engagement of rings 35 with the exterior surface 46 of the drive element 26 as the rings 35 move laterally along the length of the drive element 26. This feature allows the rings 35 to have an amount of give or kink or angle to an angle of incidence 134 while still having consistent and smooth contact with the exterior surface 46 of the drive element 26. That is, irrespective of the angle of the ring 35, the surface contact of the interior surface 118 of stabilizer 116 is the same. This is important because when opening or closing shade material 12, the lower end of rings 35 are pulled one way or another thereby causing the lower end of the rings 35 to angle slightly away from the direction of travel (when viewed from the front or back of drive element 26) when moving in a closing direction, as well as when moving in an opening direction.

In the arrangement shown, as one example, with the interior surface 118 of stabilizer being curved, a cut away area 140 is positioned around tooth 124. That is, in the arrangement shown, while the interior surface 118 of stabilizer 116 is generally curved, tooth 124 rises out of cut away area 140 that is generally flat and square, or said another way, cut away area 140 has the curvature of interior surface 118 removed. In the arrangement shown, as one example, cut out area 140 has a flat surface that mimics the curvature of the exterior surface 46 of drive element 26 in approximate parallel spaced relation. This space, provided by cut out area 140, provides clearance for tooth 124 to cleanly enter and follow along in guide structure 50 of drive element 26 without interference from the curved surface of interior surface 118.

Figure 39:
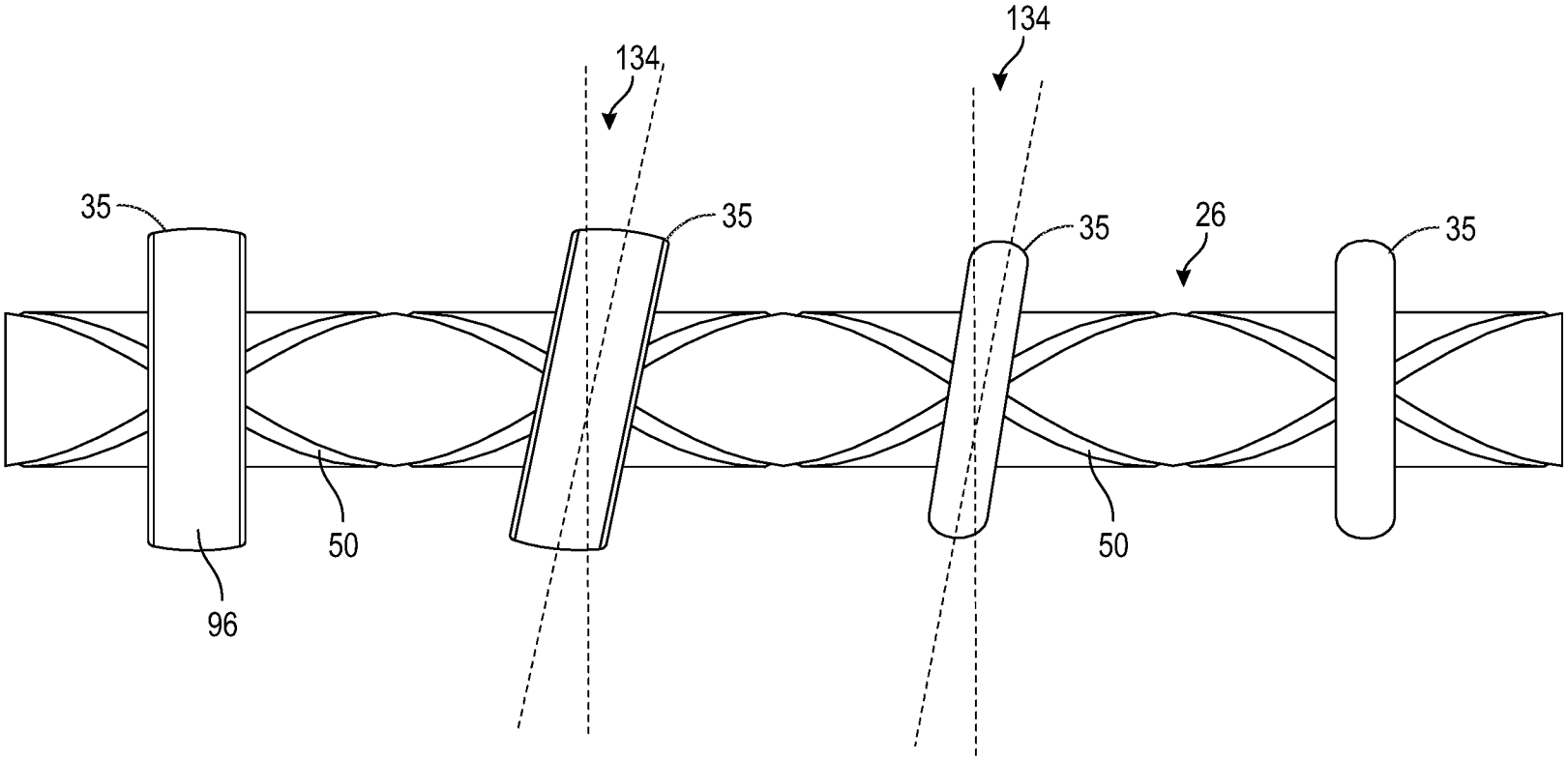
FIG. 39 is an elevation view of a pair of wide full driver rings and a pair of narrow full driver rings positioned around the drive element; the view showing one of each of the wider and narrower driver rings in a perpendicular alignment, such as when they are stationary, and in an angled alignment, such as when they are moving in a closed direction.
Figure 40:
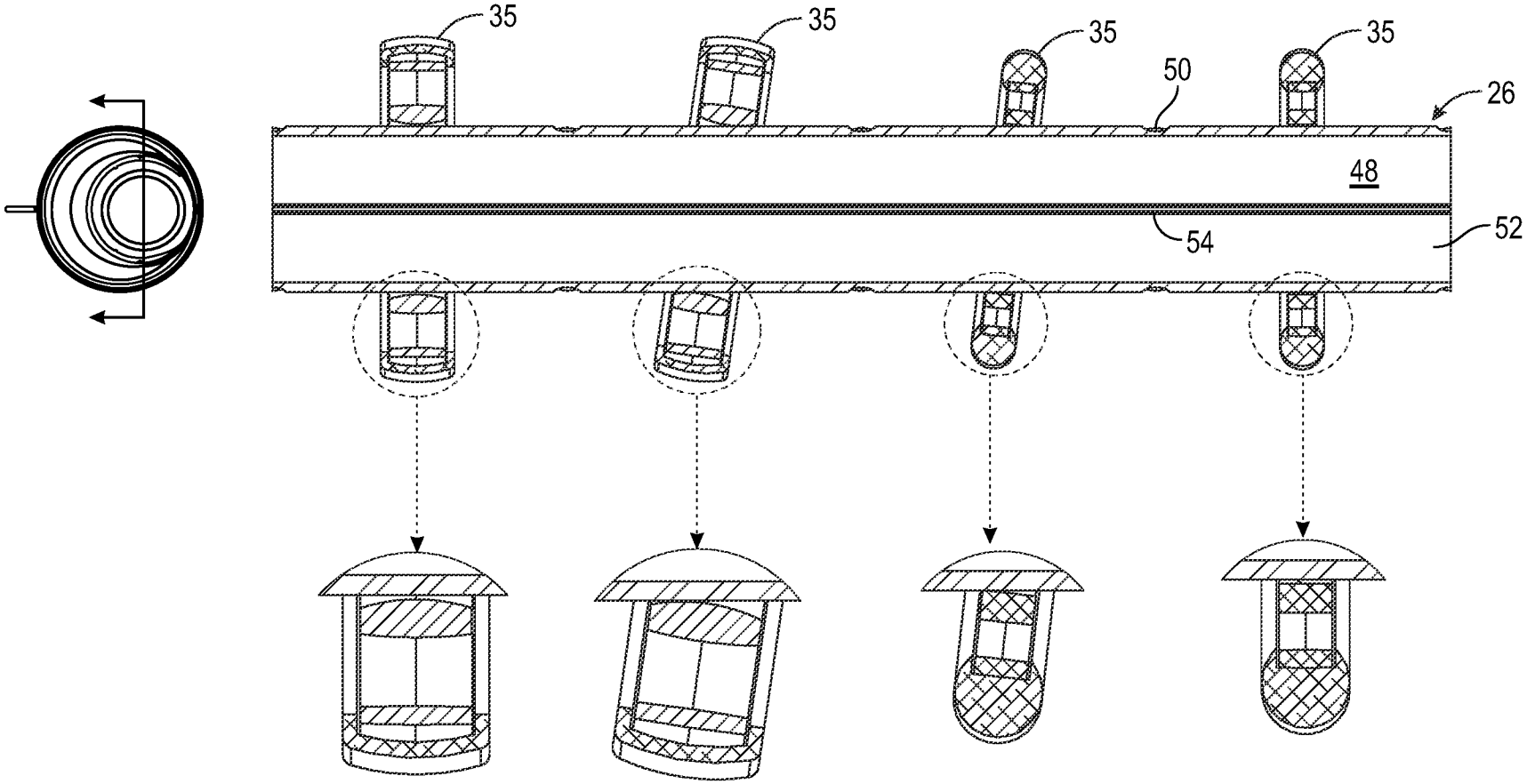
FIG. 40 is a cut-away section elevation view of a pair of wide full driver rings and a pair of narrow full driver rings positioned around the drive element; the view showing one of each of the wider and narrower driver rings in a perpendicular alignment, such as when they are stationary, and in an angled alignment, such as when they are moving in a closed direction.

FIGS. 39 and 40 show the outside positioned rings 35 positioned around drive element 26 in a generally perpendicular arrangement, whereas the interior positioned rings are tilted to the angle of incidence 134. As is shown in FIG. 40, the amount of contact between the curved interior surface 118 of stabilizer 116 and the exterior surface 46 of drive element 24 is approximately equal when the ring 35 is positioned in an approximate perpendicular alignment as well as when ring 35 is tilted to the angle of incidence 134 and every angle in between. This constant amount of contact provides consistent operation of system 10 regardless of the angle of tilt of rings 35.

Notably, it is hereby contemplated that all configurations of idler rings 36 may be converted to partial driver rings 38 by the addition of a tooth 124 or teeth 124 onto the stabilizer 116 of idler ring 36.

It will be appreciated by those skilled in the art that other various modifications could be made to the device without parting from the spirit and scope of this disclosure. All such modifications and changes fall within the scope of the claims and are intended to be covered thereby.

What is claimed:

1. A drapery system comprising:

a drive element;

the drive element extending a length from a first end to a second end;

the drive element having an exterior surface;

wherein when viewed from an end the exterior surface of the drive element is generally circular in shape;

the exterior surface of the drive element having a guide structure;

a ring;

the ring positioned around the drive element;

the ring having a hoop member, and an interior member;
the interior member extending a width between opposing interior member edges;
the interior member having an interior surface;
the interior member having a stabilizer;
the stabilizer extending a length between opposing stabilizer ends;
the stabilizer extending a width between opposing stabilizer edges;
wherein the stabilizer extends outward beyond the opposing interior member edges of the interior member;
the stabilizer having an interior surface;
wherein when the ring is placed around the drive element, the interior surface of the stabilizer is configured to receive the exterior surface of the drive element;
wherein when the ring moves along the length of the drive element, the stabilizer of the ring facilitates smooth sliding of the ring over the exterior surface of the drive element.

2. The system of claim 1, wherein the guide structure is formed of at least one groove in the exterior surface of the drive element.

3. The system of claim 1, wherein the interior surface of the stabilizer extends in a generally cylindrical manner between opposing stabilizer ends.

4. The system of claim 1, wherein the interior surface of the stabilizer extends in a generally cylindrical manner between opposing stabilizer edges.

5. The system of claim 1, wherein the interior surface of the stabilizer has a diameter of curvature approximately matching the exterior surface of the drive element.

6. The system of claim 1, wherein the interior surface of the stabilizer forms approximately half or less than half of a circular shape.

7. The system of claim 1, wherein the interior surface of the stabilizer forms less than a full circular shape.

8. The system of claim 1, wherein the interior surface of the stabilizer extends rearward and downward from an upper edge positioned at the approximate top- center of the interior member on a rearward side of the drive element so that the stabilizer is hidden from view behind the drive element, when viewed from the front.

9. The system of claim 1, wherein the interior surface of the stabilizer is free of any features that engage the guide structure.

10. The system of claim 1, wherein the interior surface of the stabilizer has a smaller radius of curvature than the interior surface of the interior member.

11. The system of claim 1, wherein the interior surface of the stabilizer has at least one tooth that is configured to engage the guide structure of the drive element.

12. The system of claim 1, wherein the stabilizer has an exterior surface;
wherein the exterior surface and the interior surface of the stabilizer extend between opposing stabilizer edges from an upper edge at a first one of the opposing stabilizer ends to a lower edge at a second one of the opposing stabilizer edges;
wherein a first set of corners between the upper edge and the opposing stabilizer edges are rounded so as to prevent the first set of corners from catching on the guide structure and thereby smooth engagement with the exterior surface of the drive element;
wherein a second set of corners between the lower edge and the opposing stabilizer edges are rounded so as to prevent the second set of corners from catching on the guide structure and thereby smooth engagement with the exterior surface of the drive element.

13. The system of claim 1, wherein the opposing stabilizer ends are angled so as to smooth engagement with the exterior surface of the drive element.

14. The system of claim 1, wherein a portion of the interior surface of the interior member of the ring is flush with a portion of the interior surface of the stabilizer.

15. The system of claim 1, wherein the interior surface of the interior member of the ring is configured to engage and glide along the exterior surface of the drive element as the ring moves along the length of the drive element.

16. A drapery system comprising:
a drive element;
the drive element extending a length from a first end to a second end;
the drive element having an exterior surface;
wherein when viewed from an end the exterior surface of the drive element is generally circular in shape;
the exterior surface of the drive element having a guide structure;
a ring;
the ring positioned around the drive element;
the ring having a hoop member, and an interior member;
the interior member extending a width between opposing interior member edges;
the interior member having an interior surface;
the interior member having a stabilizer;
the stabilizer extending a length between opposing stabilizer ends;
the stabilizer extending a width between opposing stabilizer edges;
the stabilizer having an interior surface;
wherein the width between opposing stabilizer edges is wider than the width between interior member edges;
wherein the stabilizer extends outward beyond the opposing interior member edges of the interior member;
wherein when the ring is placed around the drive element, the interior surface of the stabilizer is configured to receive the exterior surface of the drive element;
wherein when the drive element rotates, the ring moves along the length of the drive element and the stabilizer of the ring facilitates smooth sliding of the ring over the exterior surface of the drive element.

17. The system of claim 16, wherein the width between opposing stabilizer edges is at least twice as wide than the width between interior member edges.

18. The system of claim 16, wherein the interior surface of the stabilizer extends downward from the approximate top-center of the interior member on a rearward side of the drive element.

19. The system of claim 16, wherein the guide structure is formed of at least one groove in the exterior surface of the drive element.

20. The system of claim 16, wherein the interior surface of the stabilizer extends in a generally cylindrical manner between opposing stabilizer ends.

21. The system of claim 16, wherein the interior surface of the stabilizer extends in a generally cylindrical manner between opposing stabilizer edges.

22. The system of claim 16, wherein the interior surface of the stabilizer has a diameter of curvature approximately matching the exterior surface of the drive element.

23. The system of claim 16, wherein the interior surface of the stabilizer forms approximately half or less than half of a circular shape.

24. The system of claim 16, wherein the interior surface of the stabilizer forms less than a full circular shape.

25. The system of claim 16, wherein the interior surface of the stabilizer is free of any features that engage the guide structure.

26. The system of claim 16, wherein the interior surface of the stabilizer has a smaller radius of curvature than the interior surface of the interior member.

27. The system of claim 16, wherein the interior surface of the stabilizer has at least one tooth that is configured to engage the guide structure of the drive element.

28. The system of claim 16, wherein the stabilizer has an exterior surface;

wherein the exterior surface and the interior surface of the stabilizer extend between opposing stabilizer edges from an upper edge at a first one of the opposing stabilizer ends to a lower edge at a second one of the opposing stabilizer edges;

wherein a first set of corners between the upper edge and the opposing stabilizer edges are rounded so as to prevent the first set of corners from catching on the guide structure and thereby smooth engagement with the exterior surface of the drive element;;

wherein a second set of corners between the lower edge and the opposing stabilizer edges are rounded so as to prevent the second set of corners from catching on the guide structure and thereby exterior surface of the drive element and thereby smooth engagement with the exterior surface of the drive element.

29. The system of claim 16, wherein the opposing stabilizer ends are angled so as to smooth engagement with the exterior surface of the drive element.

30. A drapery system comprising:

a drive element;

the drive element extending a length from a first end to a second end;

the drive element having an exterior surface;

wherein when viewed from an end the exterior surface of the drive element is generally circular in shape;

the exterior surface of the drive element having a guide structure;

a ring;

the ring positioned around the drive element;

the ring having a hoop member, and an interior member;

the interior member extending a width between opposing interior member edges;

the interior member having an interior surface;

the interior member having a stabilizer;

the stabilizer extending a length between opposing stabilizer ends;

the stabilizer extending a width between opposing stabilizer edges;

wherein the stabilizer extends outward beyond the opposing interior member edges of the interior member;

the stabilizer having an interior surface;

wherein the interior surface of the stabilizer extends downward from the approximate top-center of the interior member on a rearward side of the drive element so that the stabilizer is hidden from view behind the drive element, when viewed from the front;

wherein when the ring is placed around the drive element, the interior surface of the stabilizer is configured to receive the exterior surface of the drive element;

wherein when the drive element rotates, the ring moves along the length of the drive element and the stabilizer of the ring facilitates smooth sliding of the ring over the exterior surface of the drive element;

wherein the stabilizer has an exterior surface;

wherein the exterior surface and the interior surface of the stabilizer extend between the opposing stabilizer edges from an upper edge at a first one of the opposing stabilizer ends to a lower edge at a second one of the opposing stabilizer edges;

wherein a first set of corners between the upper edge and the opposing stabilizer edge are rounded so as to prevent the first set of corners from catching on the guide structure and thereby smooth engagement with the exterior surface of the drive element;

wherein a second set of corners between the lower edge and the opposing stabilizer edge are rounded so as to prevent the second set of corners from catching on the guide structure and thereby smooth engagement with the exterior surface of the drive element.

31. The system of claim 30, wherein the width between opposing stabilizer edges is wider than the width between interior member edges.

32. The system of claim 30, wherein the guide structure is formed of at least one groove in the exterior surface of the drive element.

33. The system of claim 30, wherein the interior surface of the stabilizer extends in a generally cylindrical manner between the opposing stabilizer ends.

34. The system of claim 30, wherein the interior surface of the stabilizer extends in a generally cylindrical manner between the opposing stabilizer edges.

35. The system of claim 30, wherein the interior surface of the stabilizer has a diameter of curvature approximately matching the exterior surface of the drive element.

36. The system of claim 30, wherein the interior surface of the stabilizer forms approximately half or less than half of a circular shape.

37. The system of claim 30, wherein the interior surface of the stabilizer is free of any features that engage the guide structure.

38. The system of claim 30, wherein the interior surface of the stabilizer has a smaller radius of curvature than the interior surface of the interior member.

39. The system of claim 30, wherein the interior surface of the stabilizer has at least one tooth that is configured to engage the guide structure of the drive element.

* * * * *